US011547949B2

(12) United States Patent
Shweka et al.

(10) Patent No.: US 11,547,949 B2
(45) Date of Patent: Jan. 10, 2023

(54) UNIVERSAL MODULAR MARBLE COURSE SYSTEM

(71) Applicant: MAKEWAY LTD, Kfar Etzion (IL)

(72) Inventors: Elyasaf Shweka, Neve Daniel (IL); Reuven Shahar, Jerusalem (IL)

(73) Assignee: MAKEWAY LTD, Kfar Etzion (IL)

( * ) Notice: Subject to any disclaimer, the term of this patent is extended or adjusted under 35 U.S.C. 154(b) by 0 days.

(21) Appl. No.: 16/952,607

(22) Filed: Nov. 19, 2020

(65) Prior Publication Data

US 2022/0152518 A1 May 19, 2022

(51) Int. Cl.
*A63H 29/08* (2006.01)
*A63H 18/02* (2006.01)

(52) U.S. Cl.
CPC ..... *A63H 18/02* (2013.01)

(58) Field of Classification Search
CPC ..... A63H 18/02; A63H 33/04; A63H 33/046; A63F 2007/3662; A63F 2007/405; A63F 7/0088; A63F 7/02
USPC ..... 446/168
See application file for complete search history.

(56) References Cited

U.S. PATENT DOCUMENTS 197,127 A * 11/1877 Hasbrouck ..... A63F 7/3622 273/120 R
1,103,865 A * 7/1914 Caler ..... A63F 7/3622 273/120 R
1,826,215 A * 10/1931 Hutchison ..... A63F 7/3622 273/121 B
1,896,607 A * 2/1933 Brunner ..... A63F 7/3622 446/170
2,000,808 A * 5/1935 Williams ..... A63F 7/3622 446/168

(Continued)

FOREIGN PATENT DOCUMENTS

DE 20 2014 001 072 U1 5/2014
RU 2 719 694 C1 4/2020
WO WO 2015/118107 8/2015

OTHER PUBLICATIONS

Veit, Machine Translation of DE 202014001072U1, uploaded Aug. 19, 2021, Espacenet, 11 pages.*

(Continued)

*Primary Examiner* — Eugene L Kim
*Assistant Examiner* — Matthew B Stanczak
(74) *Attorney, Agent, or Firm* — Lewis Roca Rothgerber Christie LLP

(57) ABSTRACT

In accordance with embodiments of the invention, a modular marble course system with universal connectors among the components which can be mounted upon a vertical surface, has a large number of attachments, and which utilizes a unilateral construction for among the tracks, is disclosed. In combination, the features of present embodiments may permit a user to build a large number of customized and modular marble courses on substantially any vertical surface, and across multiple vertical surfaces in different planes. The system may include a variety of linear and non-linear tracks, including tracks which span around corners, smoothly move from one vertical level to the next, and which can be rotated to move a marble upwards. The system may further include unique trick attachments such as cannons, catapults, rotating attachments which pivot about an axis, and other attachments.

19 Claims, 47 Drawing Sheets

(56) References Cited

U.S. PATENT DOCUMENTS 2,001,366 A * 5/1935 Mittelman ..... A63F 7/02 273/144 R
2,239,030 A * 4/1941 Biddle ..... A63F 7/00 273/120 R
2,522,133 A * 9/1950 Sanders ..... A63F 7/2409 446/171
2,528,250 A * 10/1950 Slutzker ..... A63F 7/3622 273/120 R
2,670,206 A * 2/1954 Brewster ..... A63F 7/40 463/69
2,917,864 A * 12/1959 Payne ..... A63F 7/3622 446/168
3,314,169 A * 4/1967 Wold ..... G09B 23/04 434/189
3,379,440 A * 4/1968 Jaffe ..... A63F 7/3622 463/69
3,559,637 A * 2/1971 Fyanes ..... A61B 5/16 600/558
3,587,190 A * 6/1971 Ashton ..... A63H 18/021 446/168
3,801,094 A * 4/1974 Treaster ..... A63F 7/3622 472/72
4,037,355 A * 7/1977 Street ..... A63F 7/3622 446/173
4,135,715 A * 1/1979 Soulos ..... A63F 7/02 273/120 R
4,153,250 A * 5/1979 Anthony ..... A63F 7/02 273/120 A
4,171,090 A * 10/1979 Eisenburg ..... A63F 7/3622 238/10 E
4,319,425 A * 3/1982 Shine ..... A63F 7/3622 238/10 E
4,537,401 A * 8/1985 Smith ..... A63F 7/044 273/112
4,553,749 A * 11/1985 Bender ..... A63F 7/3622 273/459
4,713,038 A * 12/1987 Wichman ..... A63F 7/02 446/168
4,932,917 A * 6/1990 Klitsner ..... A63F 7/3622 446/168
5,078,642 A * 1/1992 Glessner ..... A63F 7/386 4/546
5,169,317 A * 12/1992 Hollander ..... G09B 19/00 434/208
5,184,970 A * 2/1993 Binkley ..... A63H 17/262 335/285
5,312,285 A * 5/1994 Rieber ..... A63F 7/3622 273/109
5,344,143 A * 9/1994 Yule ..... A63F 7/3622 273/118 R
5,477,814 A * 12/1995 Krause ..... A01K 15/025 119/702
5,709,581 A * 1/1998 Rothbarth ..... A63F 7/3622 446/171
5,785,573 A * 7/1998 Rothbarth ..... A63F 7/3622 446/171
5,800,240 A * 9/1998 Jackson ..... A63F 7/3622 446/120
5,924,907 A * 7/1999 Tobin ..... A63F 7/386 446/168
5,944,575 A * 8/1999 Tolnay ..... A63F 7/3622 446/168
5,964,635 A 10/1999 Krog
5,967,052 A * 10/1999 Prokopf ..... A63H 18/02 104/126
6,010,130 A * 1/2000 Schreiber ..... A63F 7/02 273/118 R
6,056,620 A * 5/2000 Tobin ..... A63F 7/3622 273/120 R
6,409,132 B2 * 6/2002 Heisler ..... G09F 3/204 248/220.22
6,736,691 B1 5/2004 Bach
6,811,401 B1 * 11/2004 Cruickshank ..... G09B 19/02 235/68
6,945,839 B2 * 9/2005 Quercetti ..... A63H 18/06 104/123
6,953,377 B2 * 10/2005 Quercetti ..... A63H 18/06 104/104
8,568,188 B2 * 10/2013 Horowitz ..... A63F 7/3622 446/168
9,345,979 B2 * 5/2016 Matthes ..... A63H 18/028
9,947,241 B2 * 4/2018 O'Neill ..... G09B 23/12
10,653,970 B2 * 5/2020 Forgrave ..... A63H 33/08
2002/0034982 A1 * 3/2002 Mejia ..... A63F 7/3622 463/69
2007/0004313 A1 * 1/2007 Maeda ..... A63F 7/40 446/168
2007/0209543 A1 * 9/2007 Beaulieu ..... A63F 7/3622 104/53
2009/0084863 A1 * 4/2009 Sorenson ..... A63F 7/3622 238/122
2009/0130946 A1 * 5/2009 Fink ..... A63H 18/026 446/95
2010/0178840 A1 * 7/2010 Hoffman ..... A63F 7/3622 446/168
2011/0070803 A1 * 3/2011 Hoffman ..... A63F 7/3622 446/168
2012/0108139 A1 * 5/2012 Horowitz ..... A63F 7/3622 446/168
2012/0164914 A1 * 6/2012 O'Connor ..... A63H 18/02 446/444
2013/0252506 A1 * 9/2013 Ridinger ..... A63F 7/3622 446/168
2014/0011425 A1 * 1/2014 Christopherson ..... A63H 18/02 446/227
2015/0122903 A1 * 5/2015 Boyce ..... A63H 18/02 238/10 A
2018/0192793 A1 * 7/2018 Goh ..... B42F 9/001
2018/0236350 A1 * 8/2018 Johnston ..... A63H 18/023
2019/0001232 A1 * 1/2019 Forgrave ..... A63H 33/26
2019/0030445 A1 * 1/2019 Luo ..... A63H 33/062
2019/0038963 A1 * 2/2019 Forgrave ..... A63F 7/3622
2020/0054954 A1 * 2/2020 Forgrave ..... A63H 33/08
2020/0254329 A1 8/2020 Hodek et al.
2021/0093981 A1 * 4/2021 Forgrave ..... A63H 18/08
2021/0101087 A1 * 4/2021 Hu ..... A63H 18/04

OTHER PUBLICATIONS

Wonderstrucks, Make your Own Marble Masterpiece, Dec. 3, 2018, https://www.kickstarter.com/projects/373030214/wonderstructs-make-your-own-marble-masterpiece, 21 pages.*
Internet Page: Vortex Gifts Frigits Deluxe—NPL http://vortexgifts.com/index.php?main_page=product_info&cPath=26_61&products_id=132 Page accessed Nov. 24, 2020. Corresponding document with URL address submitted herewith.
Internet Page: Ravensburger / Gravitrax https://www.ravensburger.org/uk/products/gravitrax/gravitrax-starter-set/gravitrax-pro-starter-set-vertical-26832/index.html https://www.ravensburger.org/uk/products/gravitrax/index.html https://www.ravensburger.org/uk/products/gravitrax/index.html Page accessed Nov. 24, 2020. Corresponding document with URL address submitted herewith.
Internet Page: magtrax.co https://magtrax.co/ Page accessed Nov. 24, 2020. Corresponding document with URL address submitted herewith.
Internet Page: Cuboro Marble Tracks https://cuboro.ch/en/Info/Products/cuboro_marble_track_system Page accessed Nov. 25, 2020.
Internet Page: Marble Genius https://www.marblegenius.com/collections/all-products Page accessed Nov. 25, 2020.
Internet Page: Q-Ba-Maze https://www.mindware.orientaltrading.com/q-ba-maze-a1-560191.fltr Page accessed Nov. 25, 2020.
Internet Page: Tumble Trax https://www.learningresources.com/tumble-traxr-magnetic-marble-run Page accessed Nov. 25, 2020.
Internet Page: Quadrilla https://www.hape.com/us/en/wooden-toys/quadrilla Page accessed Nov. 25, 2020.
Internet Page: Space Rail https://spacerails.com/ Page accessed Nov. 25, 2020.

(56) References Cited

OTHER PUBLICATIONS

Internet Page: Marble Run 80 Piece Set https://www.amazon.com/Toysmith-4645-80-Piece-Marble-Run/dp/Boo8CFoKBYPage Accessed Dec. 1, 2020.
Internet Page: Hasbro Gaming Mouse Trap Game https: //www.amazon.com/Hasbro-C0431-Mouse-Trap-Game/dp/B01ISKSRK8/ref=sr_1_2?dchild=1&gclid=EAIaIQobChMIg8npiOCt7QIVoyCtBh2t1ww3EAAYAiAAEgKTUvD_BwE&hvadid=178141288553&hvdev=c&hvlocphy=9061145&hvnetw=g&hvqmt=e&hvrand=3519195895900050937&hvtargid=kwd-2010015513&hydadcr=2361_9913591&keywords=hasbro+mouse+trap+game&qid=1606858958&sr=8-2&tag=googhydr-20 Accessed Dec. 1, 2020.
Internet Page: Wonderstructs: Make Your Own Marble Masterpiece https://www.kickstarter.com/projects/373030214/wonderstructs-make-your-own-marble-masterpiece?ref=nav_search&result=project&term=Wonderstructs%3A%20%20Make%20Your Accessed Dec. 1, 2020.
Internet Page: Wood Marble Machine https://woodmarblemachine.com/ Accessed Dec. 1, 2020.
Internet Page: House of Marbles Marble Run 70 Piece Set https://shop.houseofmarbles.com/product/70-piece-marble-run/ Accessed Dec. 1, 2020.
Internet Page: Galt Toys Mega Marble Run https://www.amazon.com/Galt-Toys-Mega-Marble-Construction/dp/B0099PKZS4/ref=sr_1_2?dchild=1&gclid=EAIaIQobChMIk5Pgpuit7QIVsx-tBh3g1QLXEAAYAiAAEgIZCfD_BwE&hvadid=409942233342&hvdev=c&hvlocphy=9061145&hvnetw=g&hvqmt=e&hvrand=17936903955552482068&hvtargid=kwd-1723658003&hydadcr=24660_11410818&keywords=galt+marble+run&qid=1606861177&sr=8-2&tag=googhydr-20 Accessed Dec. 1, 2020.
Internet Page: Teifoc 800 Marble Run https://www.newegg.com/global/uk-en/teifoc-educational-construction-toys/p/N82E16886043024 Accessed Dec. 1, 2020.
Internet Page: Marble Run Blocks—Starter Pack https://www.newegg.com/global/uk-en/teifoc-educational-construction-toys/p/N82E16886043024 Accessed Dec. 1, 2020.
Internet Page: Ibamgo Marble Run Building Blocks 330 Pieces https://aztesoccer.com/product/ibamgo-marble-run-building-blocks-construction-toys-set-330pcs-educational-marble-maze-race-tracks-toy-for-kids/ Accessed Dec. 1, 2020.
Internet Page: Earsoon Wooden Marble Run Blocks 60 Pieces https://www.amazon.co.uk/EARSOON-Wooden-Construction-Learning-storage/dp/B07YDBVXW3 Accessed Dec. 1, 2020.
Internet Page: Think Fun Gravity Maze Marble Run Logic Game https://www.amazon.com/ThinkFun-Gravity-Marble-Logic-Girls/dp/BooIUAAK2A/ref=sr_1_1?dchild=1&gclid=EAIaIQobChMIkJ_4pu2t7QIVoRx9ChotpwBSEAAYAiAAEgLq3_D_BwE&hvadid=410015824049&hvdev=c&hvlocphy=9061145&hvnetw=g&hvqmt=e&hvrand=5712613140402058051&hvtargid=kwd-81104602848&hydadcr=4120_11139844&keywords=thinkfun+gravity+maze&qid=1606862514&sr=8-1&tag=googhydr-20 Accessed Dec. 1, 2020.
Internet Page: Quercetti Skyrail Otoovolante Elevator Marble Run https://www.amazon.com/Quercetti-Skyrail-Ottovolante-Elevator-Playset/dp/B01AYEYFDY/ref=sr_1_1?dchild=1&keywords=quercetti+skyrail+ottovolante+elevator+marble+run+construction&qid=1606863884&sr=8-1 Accessed Dec. 1, 2020.
Internet Page: National Geographic Glowing Marble Run 80 Pieces https://www.amazon.eom/NATIONAL-GEOGRAPHIC-Glowing-Marble-Glow/dp/B07R92KFZR Accessed Dec. 1, 2020.
Internet Page: Cheatwell Games Engenius Contraptions https://www.amazon.com/Cheatwell-Games-Engenius-Contraptions-Marble/dp/B07KCRXNM1 Accessed Dec. 1, 2020.
Internet Page: Techno Gears Marble Mania Galaxy Marble Run https://www.ebay.com/i/373126714160?chn=ps&norover=1&mkevt=1&mkrid=711-117182-37290-0&mkcid=2&itemid=373126714i60&targetid=935083617507&device=c&mktype=pla&googleloc=9061145&poi=&campaignid=10829254239&mkgroupid=106351041813&rlsatarget=pla-935083617507&abcId=9300396&merchantid=6296724&gclid=EAIaIQobChMIsd3U9_Wt7QIVoRx9ChotpwBSEAQYASABEgL2T_D_BwE Accessed Dec. 1, 2020.
Internet Page: Hubelino Marble Run 200 Pieces https://www.amazon.com/Hubelino-Marble-Run-Award-Winning-Compatible/dp/BooTRZAYPA Accessed Dec. 1, 2020.
Internet Page: B.Toys Marble Palooza 62 Piece Marble Run Toy With Lights and Sound https://www.amazon.com/B-toys-Battat-Marble-Light/dp/B07D7H5RJT Accessed Dec. 1, 2020.
Internet Page: Marble Genius Run Pipes & Spheres Accessory Set https://www.amazon.com/Marble-Genius-Pipes-Spheres-Accessory/dp/B07M719GL5/ref=asc_df_B07M719GL5/?tag=hyprod-20&linkCode=dfo&hvadid=242020810967&hvpos=&hvnetw=g&hvrand=8457989804408727865&hvpone=&hvptwo=&hvqmt=&hvdev=c&hvdvcmdl=&hvlocint=&hvlocphy=9061145&hvtargid=pla-676986581738&psc=1 Accessed Dec. 2, 2020.
Internet Page: Ravensburger UK 27602 Gravitrax Add on Building Pack https://www.amazon.co.uk/Ravensburger-GraviTrax-Building-English-Version/dp/B07B7FB47R Accessed Dec. 2, 2020.
Internet Page: Plan Toys Marble Run Deluxe https://www.amazon.co.uk/Plan-Toys-Marble-Run-Deluxe/dp/BooBIROH1C Accessed Dec. 2, 2020.
Internet Page: Wood and Metal Marble Race Run Toy Roller https://www.houzz.com/products/wood-and-metal-marble-race-run-toy-roller-prvw-vr~49483863 Accessed Dec. 2, 2020.
Internet Page: Quickstarter: Plico Woodblocks Marble Run https://www.kickstarter.com/projects/745961915/quickstarter-plico-wood-blocks-for-marble-run?ref=nav_search&result=project&term=plico%20WOODBLOCKS%20 Accessed Dec. 2, 2020.
Internet Page: Hippococo Magnetic 3D Building Blocks With Marble Run Game https://www.ebay.com/c/18033851735 Accessed Dec. 2, 2020.
Internet Page: Space Odyssey Marble Run 270 Pieces https://www.amazon.co.uk/BUKI-PM517-Marble-Space-Odyssey/dp/B00656DDT8 Accessed Dec. 2, 2020.
Internet Page: The Learning Journey Techno Gears Marble Mania Mega 430 Pieces https://www.amazon.ca/Learning-Journey-Techno-Marble-Construction/dp/1400659477 Accessed Dec. 2, 2020.
Internet Page: Can You Imagine Time Machine Tabletop Clock https://www.amazon.com/Can-You-Imagine-Machine-Tabletop/dp/BooooBEWO6 Accessed Dec. 2, 2020.
Internet Page: Magnext iCoaster 64 Pieces https://www.amazon.com/Mega-Brands-29305U-Magnext-iCoaster/dp/B00175KE3U Accessed Dec. 2, 2020.
Internet Page: Eitech Fun N' Roll Marble Run Science Kit 340 Pieces https://www.rainbowresource.com/product/061835/Fun-N-Roll-Marble-Run-340-pieces.html?trackcode=googleBase&utm_source=google&utm_medium=cpc&adpos=&scid=scplpo61835&sc_intid=061835&gclid=EAIaIQobChMIg9vgorKw7QIVhAh9Ch2fHQ8QEAQYASABEgKVhPD_BwE Accessed Dec. 2, 2020.
Internet Page: Cuboro Standard Marble Maze https://www.amazon.com/Cuboro-111-Standard-Marble-Maze/dp/B0002W0RBI Accessed Dec. 2, 2020.
Internet Page: Quadrilla E6009 Vertigo Marble Run Set https://www.legacystation.com/quadrilla-e6009-vertigo-16485 Accessed Dec. 2, 2020.
Internet Page: Vertiplay Stem Marble Run Original Set of 2 https://www.loveoribel.com/collections/vertiplay-stem-marble-run/products/vertiplay-stem-marble-run-original-set https://www.loveoribel.com/collections/vertiplay-stem-marble-run Accessed Dec. 2, 2020.
Internet Page: Kickstarter Gold: Anaconda https://www.kickstarter.com/projects/meandermind/kickstarter-gold-anaconda?ref=discovery&term=Kickstarter%20Gold%3A%20Anaconda Accessed Dec. 2, 2020.
Internet Page: Hubelino Marble Run Set XL https://www.hubelino.com/product/marble-run-set-xl/ Accessed Dec. 2, 2020.
Internet Page: Clementoni Science Museum Action & Reaction Marble Run Kit https://www.amazon.com/Clementoni-Action-Reaction-Starter-Set/dp/B07QTVH74N Accessed Dec. 2, 2020.
Internet Page: Brik Ball / Lego® Compatible Marble Run Wall https://www.kickstarter.com/projects/joltteam/brik-ball-lego-compatible-

(56) References Cited

OTHER PUBLICATIONS marble-run?ref=nav_search&result=project&term=Brik%20Ball%20LEGO%20Compatible%20Marble%20Run Accessed Dec. 2, 2020.
Internet Page: Modular Marble Machine https://woodgears.ca/marbles/modular.html Accessed Dec. 3, 2020.
Internet Page: Marble Clock By Gorkem Bozkurt https://www.instructables.com/Marble-Clock/ Accessed Dec. 3, 2020.
Internet Page: Fischertechnik Dynamic Plus Looping Marble Run Construction Accessory https://www.amazon.com/fischertechnik-Dynamic-Looping-Construction-Accessory/dp/B079ZMLJTR Accessed Dec. 3, 2020.
Internet Page: Construction Function Magnetic Marble Run https://www.cjreuse.org/reuse/magnet-marble-run/1-marble-run-on-wall-1s/ Accessed Dec. 4, 2020.
Internet Page: Quadrilla Wooden Toys https://www.hape.com/us/en/wooden-toys/quadrilla Accessed Dec. 4, 2020.
Internet Page: Etsy—Gula Magnetic Marble Run https://www.etsy.com/listing/193681767/?show_sold_out_detail=1&ref=nla_listing_details Accessed Dec. 21, 2020.

* cited by examiner

UNIVERSAL MODULAR MARBLE COURSE SYSTEM

FIELD

The invention relates to customizable track systems for marbles. More specifically, the invention relates to universal, modular marble course systems.

BACKGROUND

There are a number of products for customizable marble tracks sets which are sold on the market that allow for a user to produce a marble course of their own design by connecting various components of the system. Prior art marble course systems may include general track attachments along with a number of components for receiving and launching the marbles. However, most prior art marble course systems generally require the various tracks to be directly in contact with one another, and are often defined by a two-rail support system or a full support system which contact the marble on each side with a rail.

Due to the direct connection requirements among dual rail systems, end users are often limited in the complexity of the courses they are able to build, due to the limited number of ways in which the tracks can be connected, inflexible nature of the systems, and lack of attachments in the system beyond the basic tracks. Further, many prior art marble course systems can only be built on structures which are sold with the system, or upon ferromagnetic surfaces. There remains a need in the art for a highly modular system with universal features that allow for a large number of possible courses to be constructed in different environments.

SUMMARY

It is appreciated by the inventors that prior art marble course systems are limited in the manner in which the tracks can be connected, the number components in the systems, and in the possible environments where courses may be constructed. In accordance with the teachings of present embodiments, a modular marble course system which utilizes a universal connection system that allows for a course to be constructed in many different environments, is disclosed.

In accordance with embodiments of the invention, a modular marble course system with universal connectors among the components, which is mounted upon a vertical surface when in use, and which utilizes a unilateral construction for the tracks, is described. In combination, the features of the invention permit a user to build a large number of customized and modular marble courses on substantially any vertical surface, and across multiple vertical surfaces in different planes.

The system may comprise a plurality of stationary connectors, each stationary connector comprising a body, a fastener capable of attaching it to a vertical surface, and a universal male connector configured to connect to a universal female connector; a plurality of linear tracks, each linear track comprising a rounded upper surface and a universal female connector configured to connect to a universal male connector; and a plurality of non-linear tracks, the non-linear tracks comprising a rounded upper surface, and a universal female connector to connect to a universal male connector. Alternatively, the universal male connector can be described as a tongue member and the universal female connector can be described as a groove member.

The stationary connector may be configured to support the linear tracks, non-linear tracks, and dual rail tracks by connecting to the stationary connector's universal male connector to the universal female connector of the linear tracks and non-linear tracks. Each linear track and non-linear track may be comprised of only a single rail. Each track may contact a marble at a point along its surface between 0 degrees and 90 degrees when mounted upon a stationary connector with the marble on the track. A marble positioned on top of a track may contact the vertical surface when the stationary connector is fastened to the vertical surface.

The plurality of non-linear tracks may comprise: a plurality of stair shaped tracks, each stair shaped track comprising a rounded upper surface, a universal female connector configured to connect to a universal male connector, a plurality of generally horizontal surfaces, a plurality of vertical surfaces positioned in between and orthogonal to the horizontal surfaces; a plurality of flexible tracks, each flexible track comprising a segmented body, a rounded upper edge along the segmented body, and a universal female connector configured to connect to a universal male connector, the flexible tracks being configured to bend in at least one direction; and a plurality of edge tracks, each edge track comprising a rounded upper surface, a curved path defined by the body, and a universal male connector configured to connect to a universal female connector, or vice versa in some embodiments. Some flexible tracks may have a connecting spine which bisects the segmented body and runs the length of the track, and may be configured to bend in at least two directions. The plurality of non-linear tracks may further comprise a spiral track which rotates a marble 360-degrees and moves it up or down as it moves along the track.

The system may further include a plurality of hinge connectors, each hinge connector comprising a body, a hinge pin, and a securing edge at the end of the hinge pin.

The system may further include a fork attachment, the fork attachment comprising a rounded upper surface, a curved lower member, and a hinge attachment point.

The system may further include a pole attachment, the pole attachment comprising a body with at least one hinge attachment point, a marble clamp, and a hook shaped upper member with two sides, with one side approximately twice as long as the other.

The system may also have a spiral lift attachment, the spiral lift attachment comprising a spiral shaped body, an asymmetrical cross shaped male connector positioned on the top of the spiral shaped body, and an asymmetrical cross shaped female connector positioned on the bottom of the spiral shaped body.

The system may further comprise a cannon attachment, the cannon attachment comprising a housing, a spherical recess on one end of the housing, two ferromagnetic spheres permanently locked in the housing; one that moves back and forth in a dedicated channel, and another which is locked in place.

The system may also include a catapult attachment, the catapult attachment comprising a tension band, at least two anchor points configured to attach to the tension band, a fastener capable of attaching it to a vertical surface, a catapult palm with a trigger slot, and a trigger which partially extends through the trigger slot. The system may further comprise a flip attachment, the flip attachment comprising an elongated body with an inward facing hook member on a first end and a linear member extending orthogonally from a curved second end, and a hinge attachment point.

The system tracks may also have a U turn attachment, the U turn attachment comprising a two-track body, the two-track body defining a 180-degree curve, and a universal female connector configured to connect to a universal male connector.

The system tracks may also have a corner attachment, the corner attachment comprising a two-track body, the two-track body defining a rounded path which ends at a trajectory with a 90-degree difference relative to its initial trajectory, and a universal female connector configured to connect to a universal male connector.

The fastener capable of attaching the stationary connectors and the hinge connectors to the vertical surface may be at least one magnet inside the housing, or a suction cup.

The system may further comprise a starter attachment for storing and releasing marbles into the course, a plurality of different spinner attachments which rotate as a marble moves along them, a bell attachment which can be rung by a rolling marble, a fan attachment which rotates, makes sound, and lights up when triggered by a marble, as well as numerous other components which are more fully described in the detailed description.

The system may further comprise a ferromagnetic wall assembly which comprises a plurality of thin metal plates, a plastic frame, connecting cross members, and keys and keyholes to connect multiple plastic frames to form a larger ferromagnetic wall assembly. The ferromagnetic wall assembly may be covered with a fabric or other material having a one or more pockets to store components of the system and attach falling marbles. The ferromagnetic wall assembly may be supported by a suction cup connector or screw which inserts into a connecting cross members attached to the plastic frame.

BRIEF DESCRIPTIONS OF DRAWINGS

DETAILED DESCRIPTION

Figure 1:
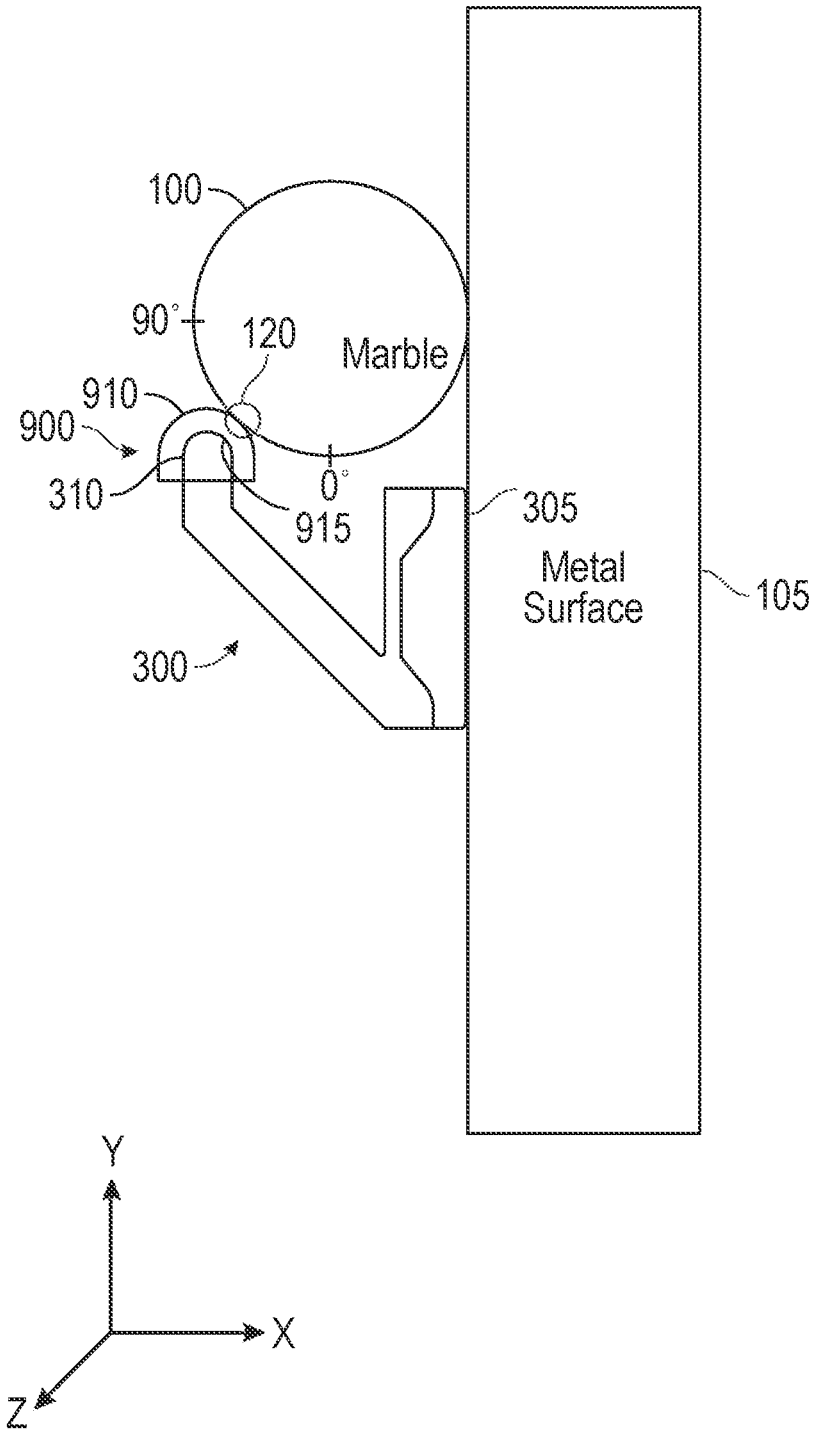
FIG. 1 shows a side view of components of the system attached to a ferromagnetic surface, with a marble on a track.

In accordance with embodiments of the invention, a modular marble course system with universal connectors among the components which can be mounted upon a vertical surface, has a large number of attachments, and which utilizes a unilateral construction for among the tracks, is disclosed. In combination, the features of present embodiments may permit a user to build a large number of customized and modular marble courses on substantially any vertical surface, and across multiple vertical surfaces in different planes. The system may include a variety of linear and non-linear tracks, including tracks which span around corners, smoothly move from one vertical level to the next, and which can be rotated to move a marble upwards. The system may further include unique trick attachments such as cannons, catapults, rotating attachments which pivot about an axis, and other attachments.

The rails and various components of the system described herein may comprise a semicircular upper surface upon which a marble travels, and a universal connection joint defined by a semicircular recess underneath the rounded upper surface. This universal connector joint may be generally in the shape of a U, can be described as a universal connection groove or female connector, and be adapted to fit onto corresponding semicircular upper surfaces (male connectors), which are defined by various connector attachments used in the system to support the rails and other components of the system. The universal connection joint and the system may be scalable in that the same approach can be applied to parts of different size, and can be applied to components of the system which are subsequently developed. The inner diameter of the semicircular U-shaped recess underneath the rounded upper surface which functions as the universal connection joint may be approximately 3 mm in diameter. The diameter of the corresponding hemicylindrical universal connectors, which can be described as a universal connection tongue member or male connector, and which may insert into the semicircular U-shaped universal connector groove or female connector may also be approximately 3 mm. While the rails are described as having a rounded upper surface, the upper surface need not be rounded and could also be a flat edge, or a polygonal edge with multiple flat portions. The size of the universal connection members need not be 3 mm or hemicylindrical in shape, and can be any size and shape which is suitable for forming a physical connection.

All of the component magnets in the various components of the system may comprise at least two covers in order to prevent them from breaking, and possibly to comply with applicable regulations on ferromagnetic toys. The first cover may be a tight fit housing which holds the magnet tightly inside, and a second cover may be a casing covering the rear body of a given component. In the unlikely event the second casing over the rear body is worn or torn, the magnet will still be securely held in place in the tight fit housing. The second casing, which may be a rubber over molding, may add friction to the magnetic attachment part to help hold it tight, as well as protect the surface of the ferromagnetic material underneath from scratching.

FIG. 1 shows a side view of a components of the system attached to a ferromagnetic surface, with a marble on a track. The track 900 is attached to a ferromagnetic surface 105 with a magnet that is set within the body of the connector 300. The rounded upper surface 910 of the track contacts the surface of the marble 100 approximately at a 45-degree angle 120, such that the marble is positioned in between the track 900 and the ferromagnetic surface 105. This supports the marble from a point of contact on each side such that it may roll along the path established by the track without falling off. The various components of the system described herein may support a 16 mm marble at a distance of approximately 13-15 mm away from the ferromagnetic wall, or other surface upon which the system is mounted. The marble size and distance from the wall may vary, and need not be the 16 mm marble and 13-15 mm distance described herein. Also shown is the rounded upper male connector of the connector attachment (front rail 310), and the female connector 915 of the rail attachment.

Figure 2A:
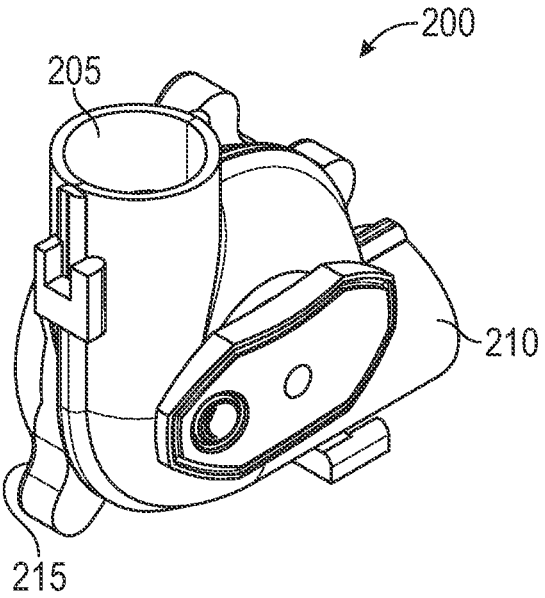
FIG. 2A shows a perspective view of a starter attachment of present embodiments.

FIG. 2A shows a perspective view of a starter attachment 200 of present embodiments. Shown is the upper marble insertion slot 205, the lower marble egress slot 210, and the generally L shaped housing 215 which defines the path taken by the marble through the starter attachment 200. The attachment may have a circular quarter arc shape connecting each leg of the L shaped housing. There may be a raised lip which bisects the housing where the housing splits in half and each half connects. The upper marble insertion slot 205 and the lower marble egress slot 210 may also be described as a first upper insertion slot and a second lower egress slot.

Figure 2B:
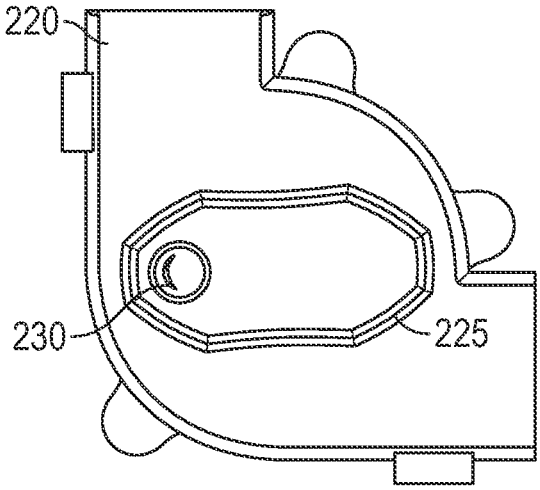
FIG. 2B shows a front view of a starter attachment of present embodiments.
Figure 2C:
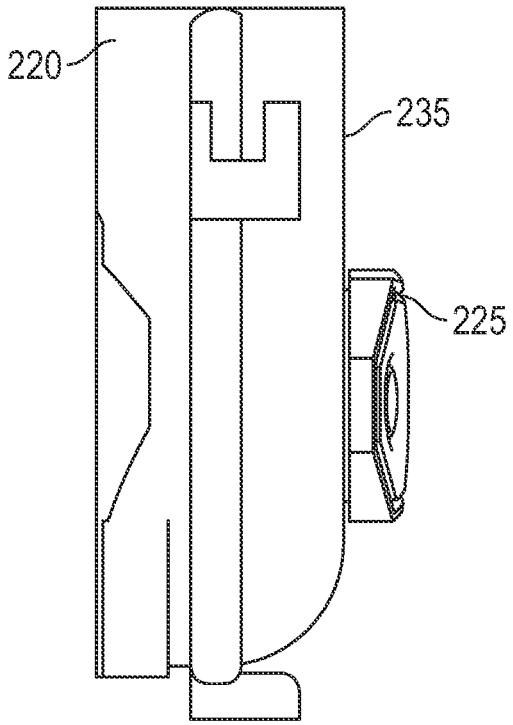
FIG. 2C shows a side view of a starter attachment of present embodiments.
Figure 2D:
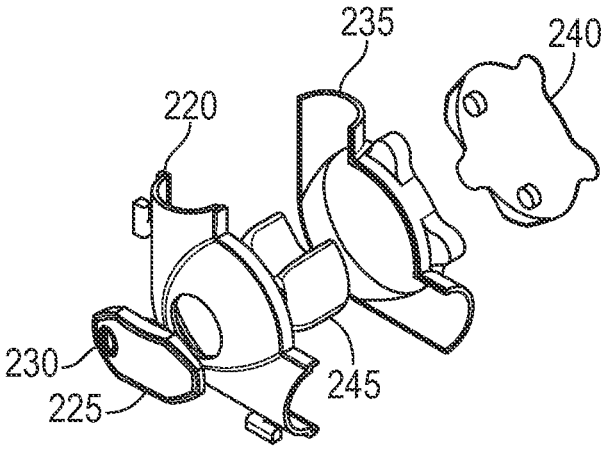
FIG. 2D shows an exploded view of a starter attachment of present embodiments.

FIG. 2B shows a front view of a starter attachment of present embodiments. Shown is the front cover 220, the turn wheel 225, and an imprinted design mark 230 in the turn wheel which may be a logo or trademark. FIG. 2C shows a side view of a starter attachment of present embodiments. Shown is the turn wheel 225, the back cover 235, and the front cover 220. FIG. 2D shows an exploded view of a starter attachment of present embodiments. Shown is the turn wheel 225, design mark 230, front cover 220, the recessed marble holder 245, the back cover 235, and the back rubber casing 240 which, in this embodiment, is pictured holding two magnets. A marble can be placed into the marble insertion slot 205 where it will fall into the recessed marble holder 245, which will hold the marble until it is rotated approximately 90 degrees by the turn wheel 225 attached to the front cover 220. The marble will then roll out of the lower marble egress slot 210, and onto subsequent attachments.

Figure 3A:
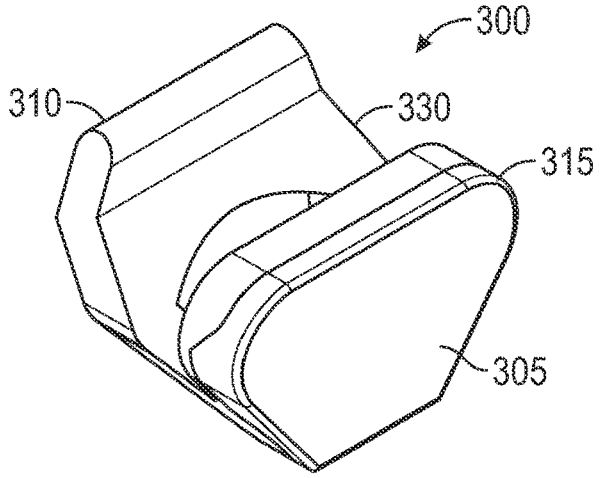
FIG. 3A shows a rear perspective view of a connector attachment of present embodiments.

FIG. 3A shows a rear perspective view of a connector 300 of present embodiments. Shown is the rear rubber casing 305, the front rail 310, the rear upper edge 315, and the connector body 330. The connector body may be generally trapezoidal in shape. The front rail may have a semicircular upper surface and may be semi-cylindrical in shape, and define the universal male connector. There may be a trapezoidal shaped slot in the front surface of the connector 300 which, among other possible uses, may reduce the amount of material required to manufacture the attachment.

Figure 3B:
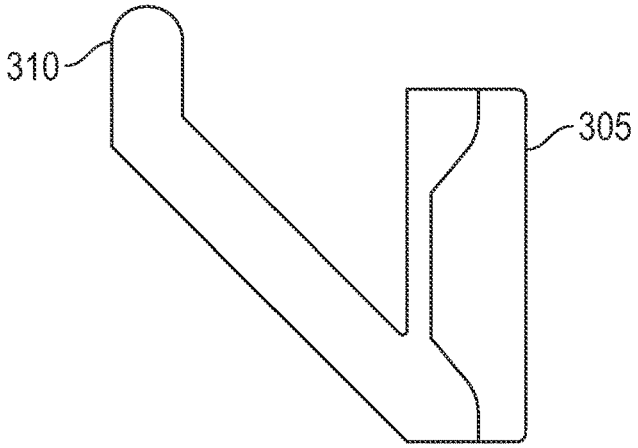
FIG. 3B shows a side view of a connector attachment of present embodiments.
Figure 3C:
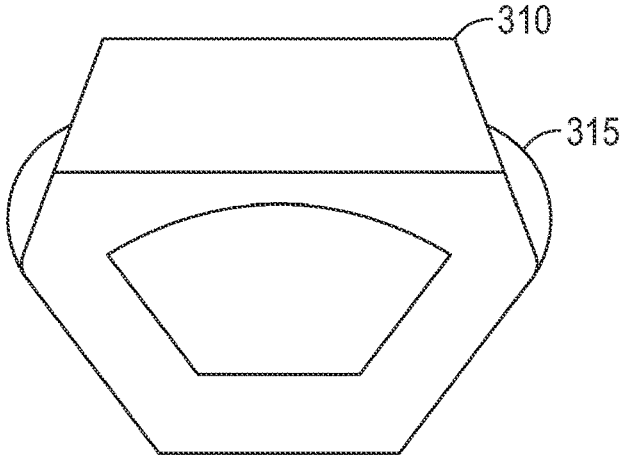
FIG. 3C shows a front view of a connector attachment of present embodiments.
Figure 3D:
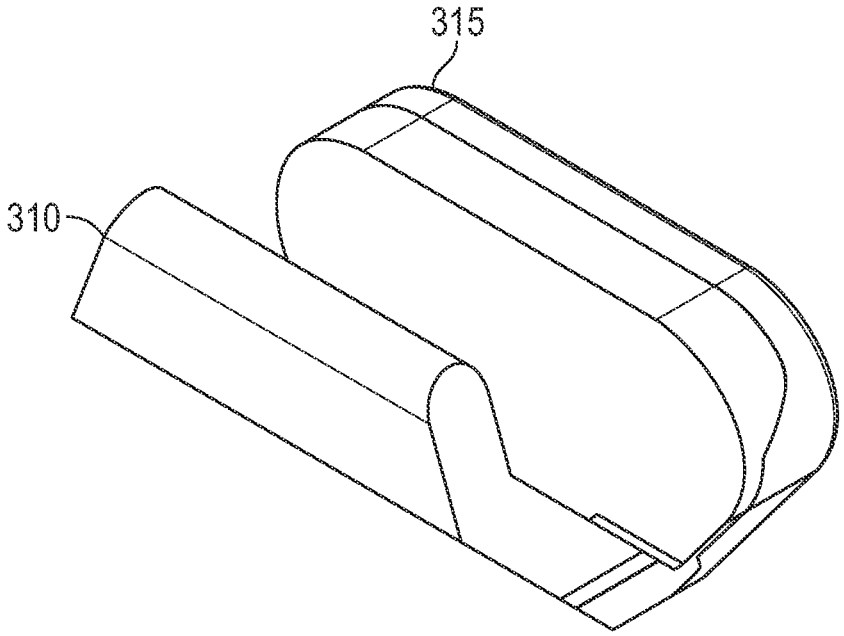
FIG. 3D shows a front perspective view of a connector attachment of present embodiments.
Figure 3E:
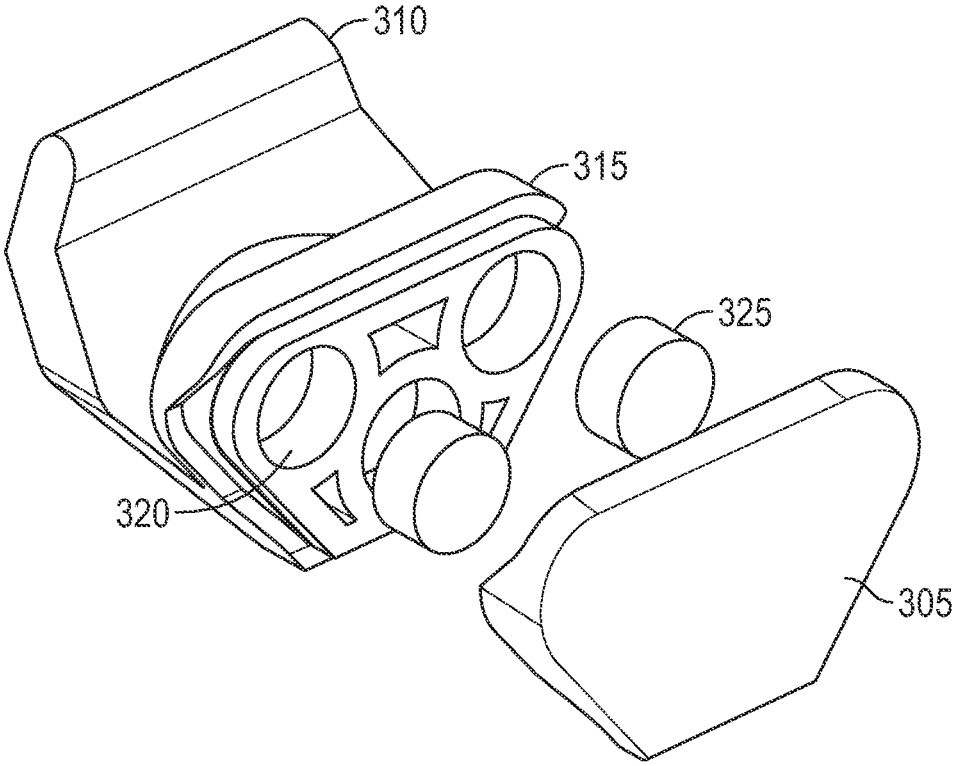
FIG. 3E shows a rear exploded view of a connector attachment of present embodiments.

FIG. 3B shows a side view of a connector of present embodiments. Shown is the front rail 310, and the rear rubber casing 305. FIG. 3C shows a front view of a connector of present embodiments. Shown is the front rail 310, the rear upper edge 315. FIG. 3D shows a front perspective view of a connector of present embodiments. Shown is the front rail 310, and the rear upper edge 315. FIG. 3E shows a rear exploded view of a connector of present embodiments. Shown is the front rail 310, rear upper edge 315, the magnet slots 320, which may be circular in shape and correspond to the shape of the magnets 325, and the rear rubber casing 305. The rear rubber casing 305 covers the magnets and holds then in place. The magnets 325 and magnet slots 320 can be any shape, such as rectangular, and need not be circular. It however may be advantageous to use a standard size for the magnets and magnet slots, as is shown in this embodiment.

Figure 4A:
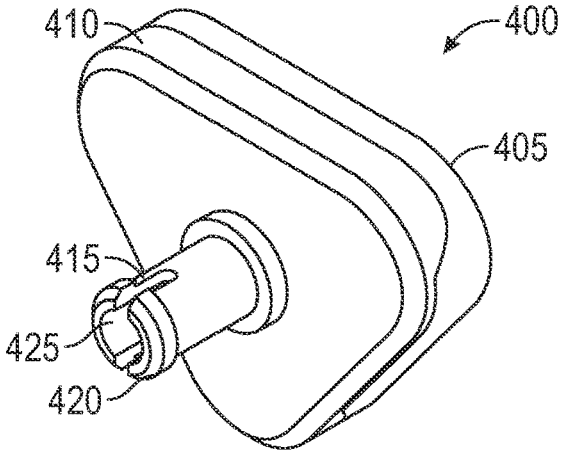
FIG. 4A shows a perspective view of a hinge connector attachment of present embodiments.

FIG. 4A shows a perspective view of a hinge connector 400 of present embodiments. Shown is the rear rubber casing 405, the connector body 410, and the hinge pin 415 which may further comprise a raised edge 420 to snap into other components which attach to the hinge connector 400, and a connecting gap 425. The surface of the hinge pin 415 pay be smooth or polished as to have a low coefficient of friction to permit other components of the system to rotate about it freely. The raised edge 420 may be slanted on a first side, flat on the upper most surface, and then have a 90-degree bend where it is vertical as it connects to the hinge pin surface. The connecting gap 425 may be used to lock components in place by pushing a corresponding member into the connecting gap, contacting the hinge pin in the center, and preventing rotation.

Figure 4B:
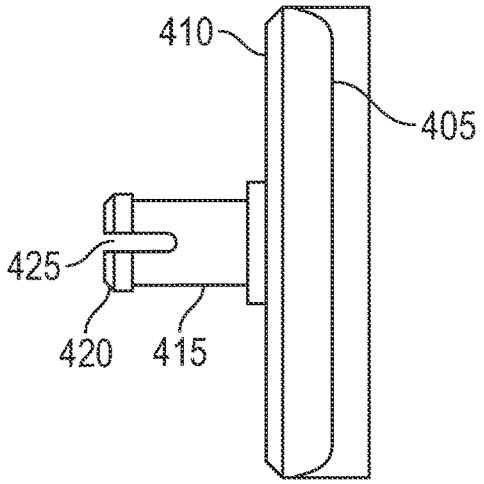
FIG. 4B shows a side view of a hinge connector attachment of present embodiments.
Figure 4C:
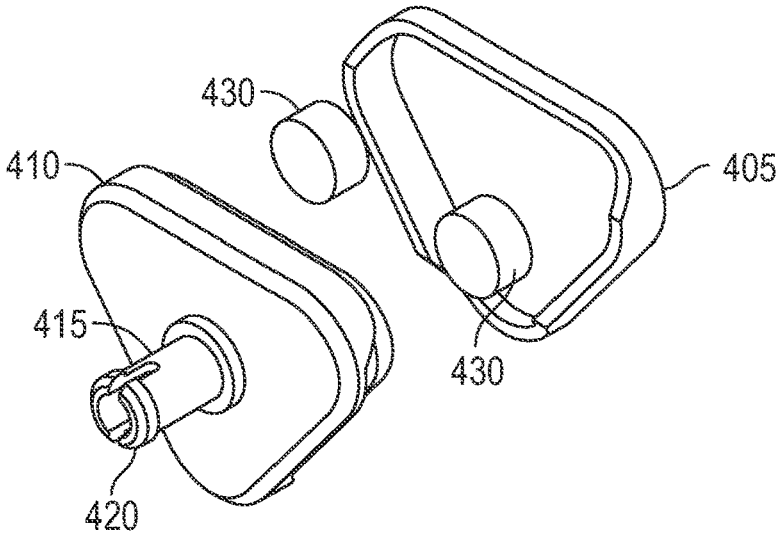
FIG. 4C shows an exploded view of a hinge connector attachment of present embodiments.

FIG. 4B shows a side view of a hinge connector of present embodiments. Shown is the rear rubber casing 405, the connector body 410, the hinge pin 415, the raised edge 420, and the connecting gap 425. FIG. 4C shows an exploded view of a hinge connector of present embodiments. Shown is the rear rubber casing, 405 the connector body 410, the hinge pin 415, the raised edge 420, and the connecting gap 425. Also shown are the magnets 430 which insert into the hinge connector 400 to hold it to a ferromagnetic surface.

Figure 5A:
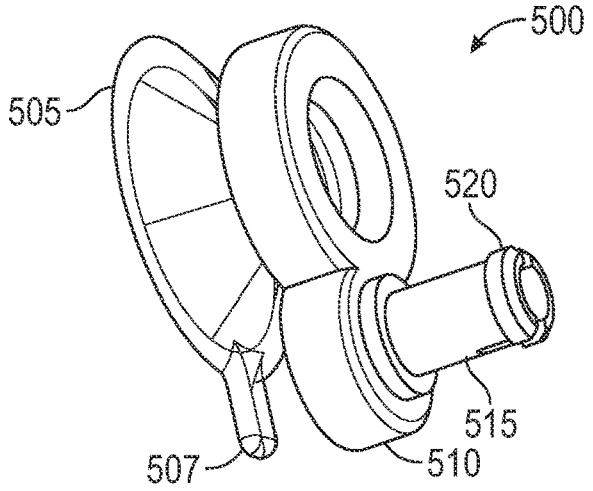
FIG. 5A shows a perspective view of a suction cup hinge connector attachment of present embodiments.

FIG. 5A shows a perspective view of a suction cup hinge connector 500 of present embodiments. Shown is the suction cup 505, suction cup removal tab 507, the connector body 510, the hinge pin 515, and the raised edge. The connector body 510 may have a shape defined by a smaller lower circle where the hinge pin extends from connected above a larger lower circle which defines a hole that the suction cup attaches to. The hinge pin 415 may function similarly to the one described in FIGS. 4A-C, having a smooth surface, a snap coupling feature, and a rotation locking feature.

Figure 5B:
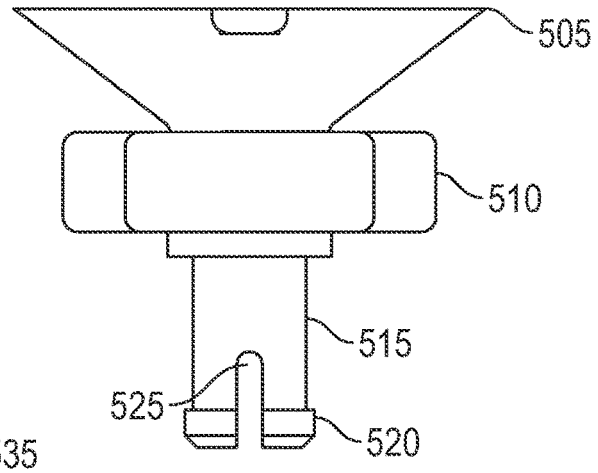
FIG. 5B shows a top view of a suction cup hinge connector attachment of present embodiments.
Figure 5C:
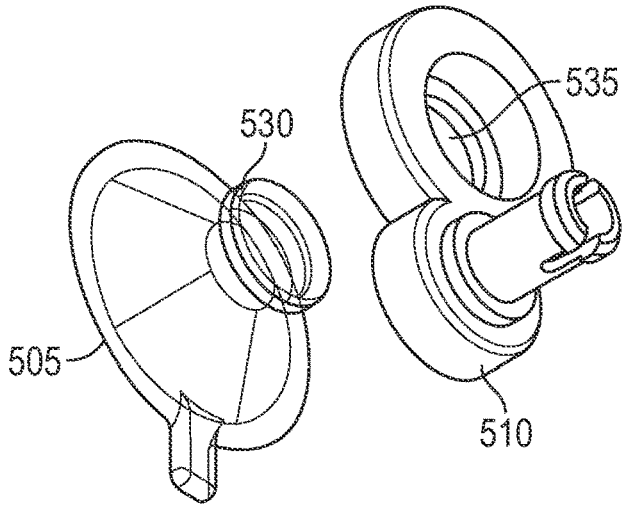
FIG. 5C shows an exploded view of a suction cup hinge connector attachment of present embodiments.
Figure 5D:
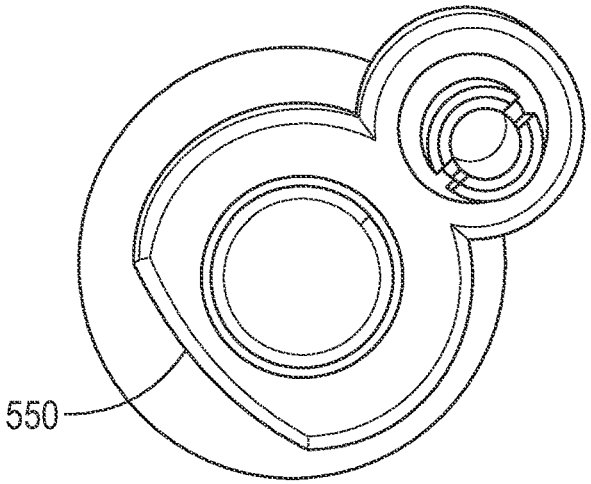
FIG. 5D shows a front view of a suction cup hinge connector attachment of present embodiments, with an alternative body member.

FIG. 5B shows a top view of a suction cup hinge connector of present embodiments. Shown is the suction cup 505, the connector body 510, the hinge pin 515, the raised edge 520, and the connecting gap 525. FIG. 5C shows an exploded view of a suction cup hinge connector of present embodiments. Shown is the suction cup 505, the inverted "8" shaped connector body 510, the suction cup male fitting 530 which may be in the shape of a circular protrusion, and the connector body female fitting 535 for attaching the connector body 510 to the suction cup 505. FIG. 5D shows a front view of a suction cup hinge connector attachment of present embodiments, with an alternative body 550. The alternative body 500 cuts short the larger circle of the body as to allow for better attachment and movement of attached components, and in particular may improve the rotation of the spinner attachments.

Figure 6A:
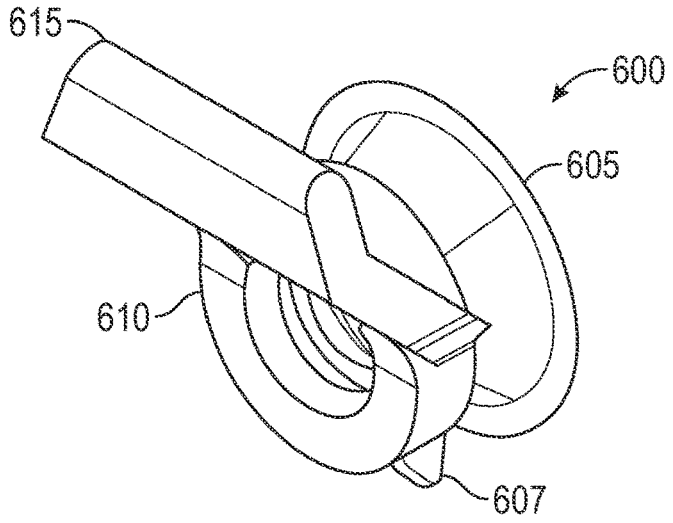
FIG. 6A shows a perspective view of a suction cup connector attachment of present embodiments.

FIG. 6A shows a perspective view of a suction cup connector 600 of present embodiments. Shown is the suction cup 605, the suction cup tab 607, the connector body 610, and the front rail 615. The connector body may primarily be defined by a circular ring shape having an opening for the suction cup male fitting to attach to, with the front rail 615 forming atop the upper surface of the ring. Extending from the upper rail 615 there may be a flat extension member which permits a subsequent track or another attachment to connect to the suction cup connector 600.

Figure 6B:
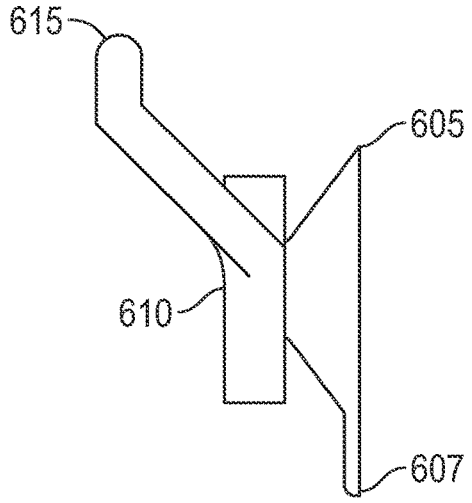
FIG. 6B shows a side view of a suction cup connector attachment of present embodiments.
Figure 6C:
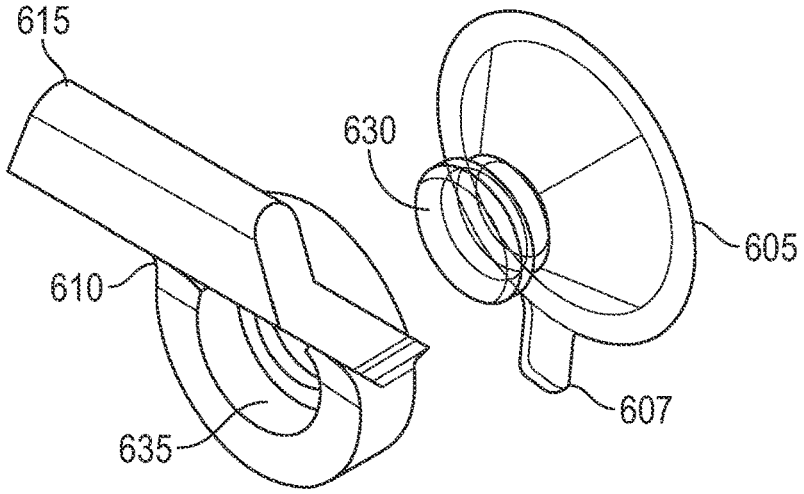
FIG. 6C shows an exploded view of a suction cup connector attachment of present embodiments.

FIG. 6B shows a side view of a suction cup connector of present embodiments. Shown is the suction cup 605, the suction cup removal tab 607, the connector body 610, and the upper rail 615, which defines the universal male connector. FIG. 6C shows an exploded view of a suction cup connector of present embodiments. Shown is the suction cup 605, the suction cup removal tab 607, the connector body 610, the upper rail 615, the suction cup male fitting 630, and the connector body female fitting 635 for attaching the connector body 610 to the suction cup 605.

Figure 7A:
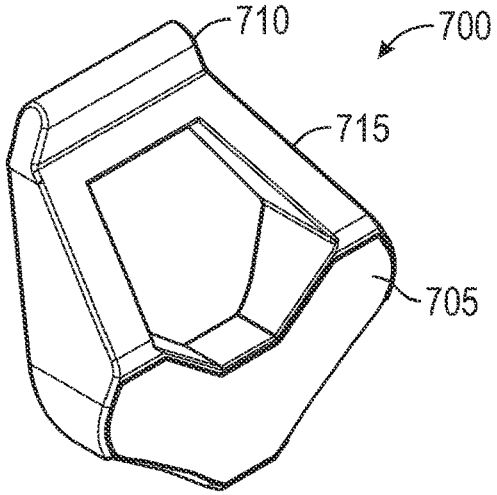
FIG. 7A shows a rear perspective view of a child safe connector attachment of present embodiments.

FIG. 7A shows a rear view of a child safe connector 700 of present embodiments. It may be safer for children than the standard connector because it is larger than the standard connector, doesn't fit into children's mouths, such that they won't inadvertently choke on it. The child safe attachments may be 33 mm by 17.4 mm by 17.5 mm in certain embodiments. Shown in this view is the rear casing 705, connector body 715, and front rail 710, which defines the universal male connector. The connector body 715 may generally be in the shape of an elongated trapezoid.

Figure 7B:
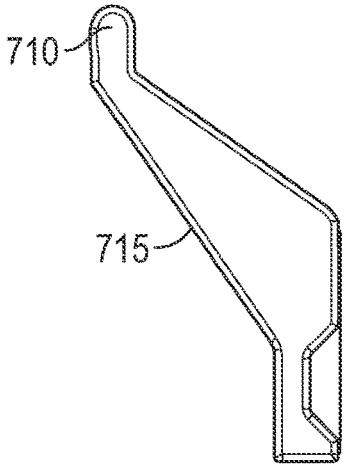
FIG. 7B shows a side view of a child safe connector attachment of present embodiments.
Figure 7C:
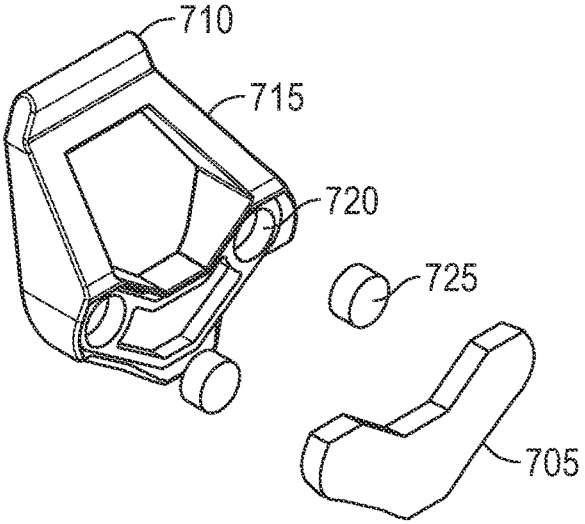
FIG. 7C shows a rear exploded view of a child safe connector attachment of present embodiments.

FIG. 7B shows a side view of a child safe connector of present embodiments. Shown is the elongated connector body 715, and the front rail 710. FIG. 7C shows a rear exploded view of a child safe connector of present embodiments. Shown is the rear casing 705, connector body 715, and front rail 710. Also shown are the magnets 725 and magnet slots 720 in the connector body 715.

Figure 8A:
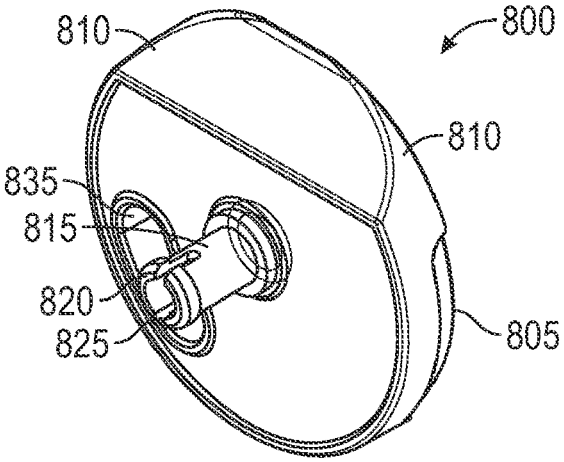
FIG. 8A shows a perspective view of a child safe hinge connector attachment of present embodiments.

FIG. 8A shows a perspective view of a child safe hinge connector 800 of present embodiments. It may be safer for children than the standard connector because it is larger and won't easily fit into children's mouths, such that they won't inadvertently choke on it. In certain embodiments, the safe hinge connector 800 may be approximately 32.6 mm in diameter. Shown is the rear casing 805, connector body 810, hinge pin 815, raised edge 820, connecting gap 825, through slot 835, and recessed upper surface 840. The connector body 810 may generally be in the shape of a circle, with an ovoid or kidney shaped slot 835 going through the body. The recessed upper surface 840 may be concave and arc shaped.

Figure 8B:
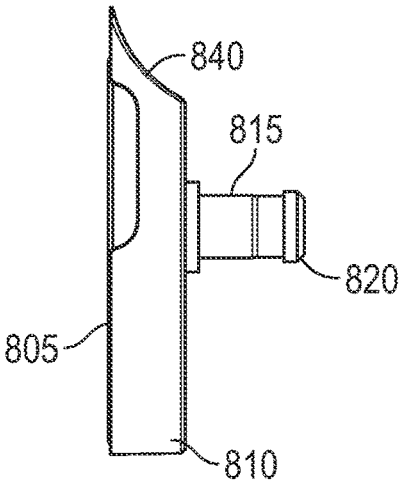
FIG. 8B shows a side view of a child safe hinge connector attachment of present embodiments.
Figure 8C:
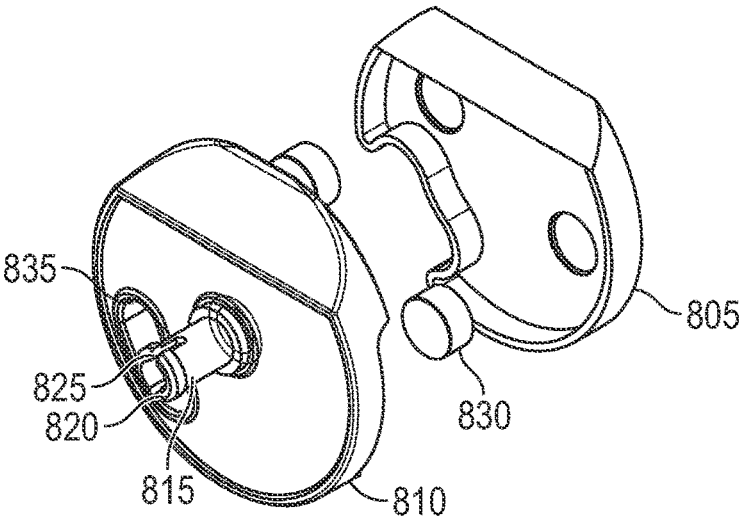
FIG. 8C shows an exploded view of a child safe hinge connector attachment of present embodiments.

FIG. 8B shows a side view of a child safe hinge connector of present embodiments. Shown is the rear casing 805, connector body 810, hinge pin 815, raised edge 820, and recessed upper surface 840. FIG. 8C shows an exploded view of a child safe hinge connector of present embodiments. Shown is the rear casing 805, connector body 810, hinge pin 815, raised edge 820, connecting gap 825, through slot 835, and magnets 830.

Figure 9A:
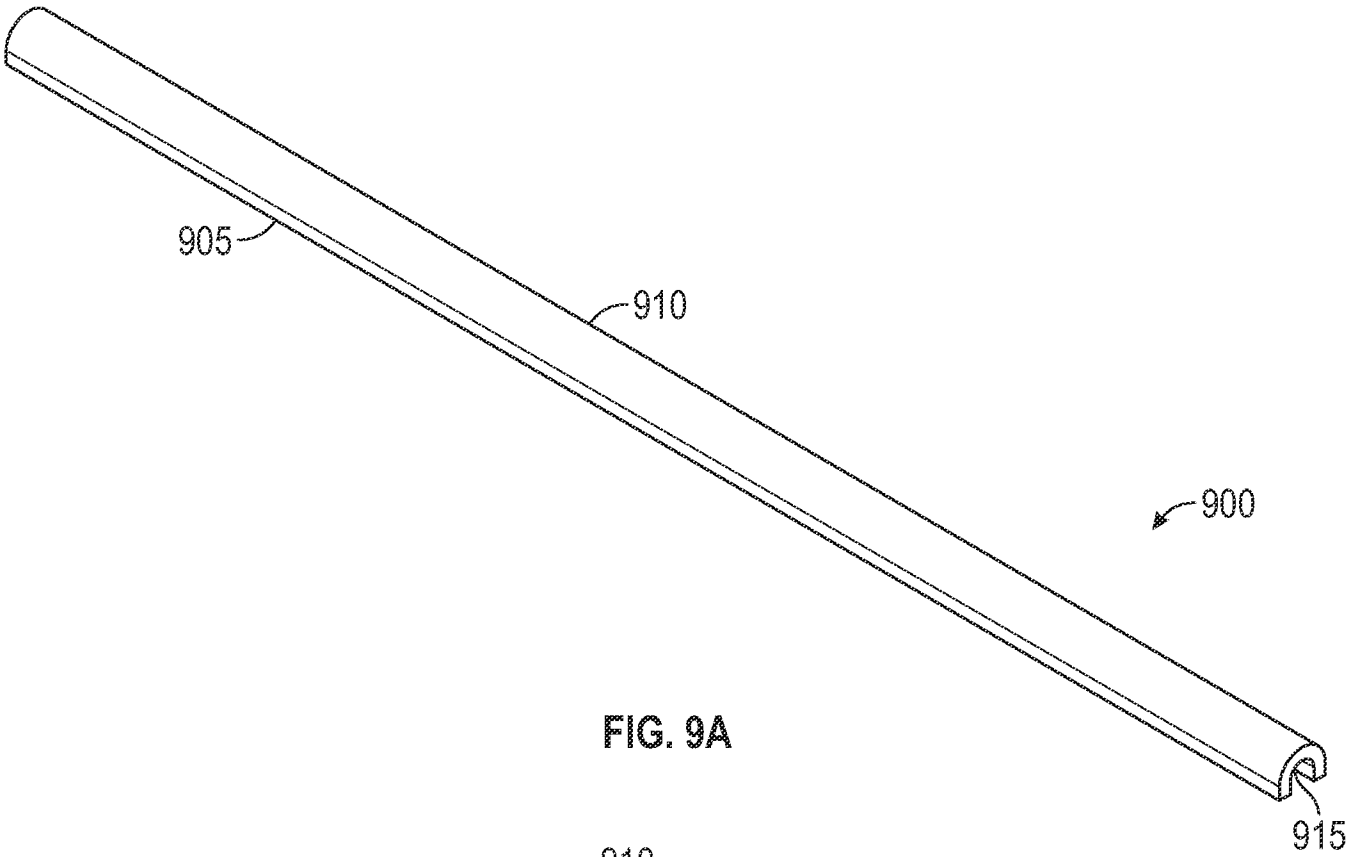
FIG. 9A shows a perspective view of a straight rail attachment of present embodiments.
Figure 9B:
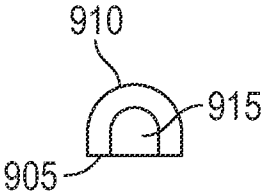
FIG. 9B shows a side view of a straight rail attachment of present embodiments.

FIG. 9A shows a perspective view of a straight rail attachment 900 of present embodiments. Shown is the flat lower edge 905, curved upper edge 910, and universal female connector 915 defined by the curved U-shaped body of the straight rail attachment 900. FIG. 9B shows a side view of a straight rail attachment of present embodiments. Shown is the rounded upper edge 910, flat lower edge 905, and universal female connector 915. The marble may travel atop the rounded upper edge, contacting the rail at approximately a 45-degree angle. The straight rail attachment 900 may be configured to connect to the connectors 300/600/700 by the universal female connector 915 fitting over the rounded upper rails of the attachments. The rounded upper rails may be circular and a corresponding smaller diameter such that they are configured to firmly fit into the universal female connector 915. In certain embodiments, the outer diameter of the track may be 4.4 mm, and the inner diameter of the universal female connector may be 3 mm. Each segment of track may be 160 mm in length.

Figure 10A:
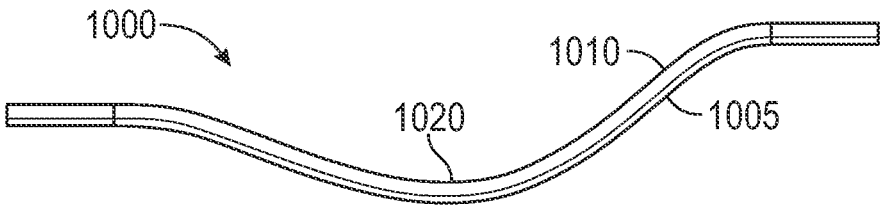
FIG. 10A shows a front view of a curved rail attachment of present embodiments.

FIG. 10A shows a front view of a curved rail attachment 1000 of present embodiments. Shown is the flat lower edge 1005, rounded upper edge 1010, and the curved path 1020 defined by the shape of the rail. Like other rail attachments, the marble may travel atop the rounded upper edge, contacting the rail at approximately a 45-degree angle. Similarly, the curved rail attachment 1000 may also be configured to connect to the connectors 300/600/700 by a universal female connector fitting over the rounded upper rails of the attachments. In certain embodiments, the outer diameter of the track may be 5.8 mm, and the inner diameter of the universal female connector may be 3 mm. Each segment of track may be 180 mm in length. The curved rail attachments 1000 may also be described as curved tracks.

Figure 10B:
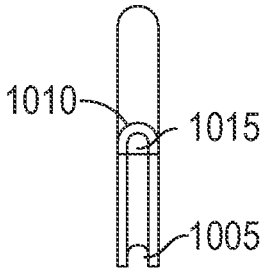
FIG. 10B shows a side view of a curved rail attachment of present embodiments.
Figure 10C:
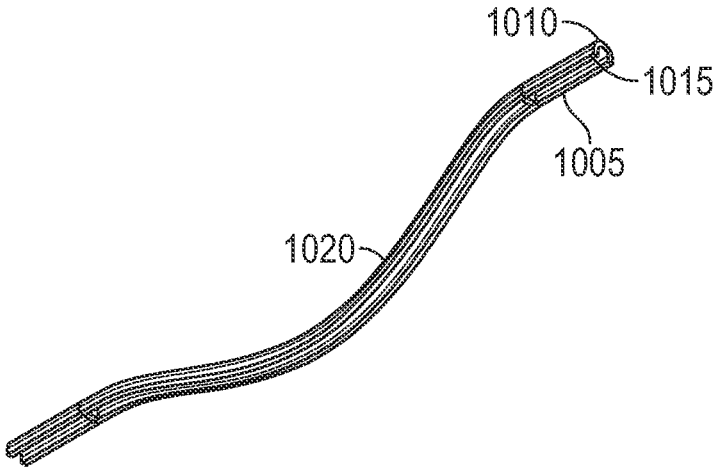
FIG. 10C shows an upward perspective view of a curved rail attachment of present embodiments.
Figure 10D:
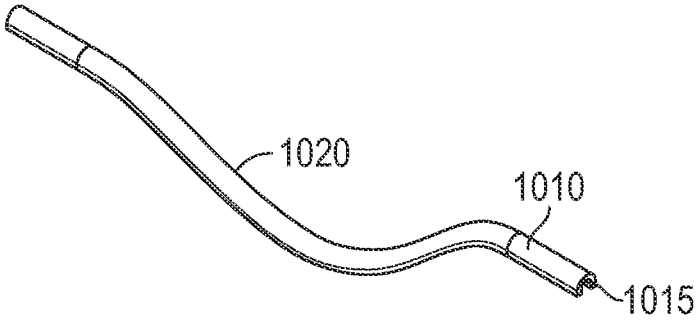
FIG. 10D shows a downward perspective view of a curved rail attachment of present embodiments.

FIG. 10B shows a side view of a curved rail attachment of present embodiments. Shown is the flat lower edge 1005, rounded upper edge 1010, and the universal female connector 1015 defined by the rounded shape of the rail body. FIG. 10C shows an upward perspective view of a curved rail attachment of present embodiments. Shown is the flat lower edge 1005, rounded upper edge 1010, and the curved path 1020 defined by the shape of the rail, and the universal female connector 1015. FIG. 10D shows a downward perspective view of a curved rail attachment of present embodiments. Shown is the rounded upper edge 1010, and the curved path 1020 defined by the shape of the rail, and the universal female connector 1015.

Figure 11A:
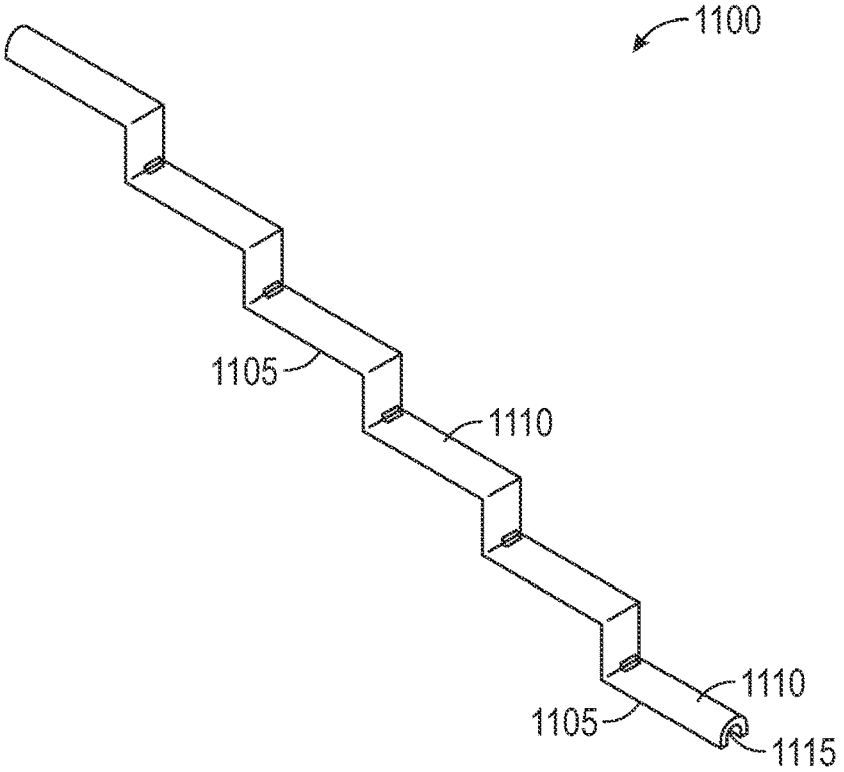
FIG. 11A shows a perspective view of a stair track of present embodiments.

FIG. 11A shows a perspective view of a stair track 1100 of present embodiments. Shown is the flat lower edge 1105, rounded upper edge 1110, and universal female connector 1115. Like other rail attachments, the marble may travel atop the rounded upper edge, contacting the rail at approximately a 45-degree angle. Similarly, the stair track 1100 may also be configured to connect to the connectors 300/600/700 by a universal female connector fitting over the rounded upper rails of the connectors.

Figure 11B:
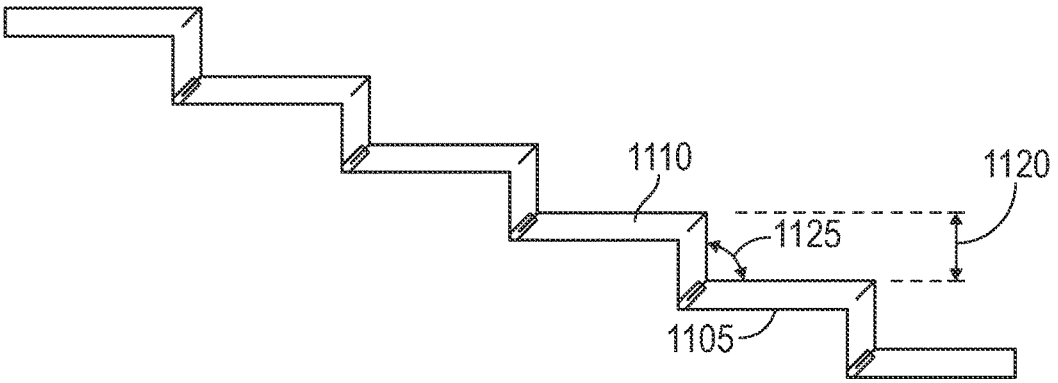
FIG. 11B shows a front view of a stair track of present embodiments.
Figure 11C:
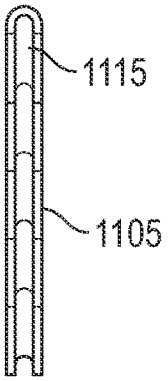
FIG. 11C shows a side view of a stair track of present embodiments.

FIG. 11B shows a front view of a stair track of present embodiments. Shown is the flat lower edge 1105, rounded upper edge 1110, the orthogonal (90 degree) angle 1125 where the vertical surface of the upper edge meets the horizontal surface of the upper edge, and the space between each step 1120, which may be approximately 10 mm in some embodiments. In other embodiments, it may be various sizes, such as between 5 mm to 30 mm. In a particular embodiment, the length of the track may be 160 mm, with the length of each horizontal segment 26.7 mm, and the vertical displacement of each track 11 mm. FIG. 11C shows a side view of a stair track of present embodiments. Shown is the semicircular shaped crevice and flat lower edge 1105.

Figure 12A:
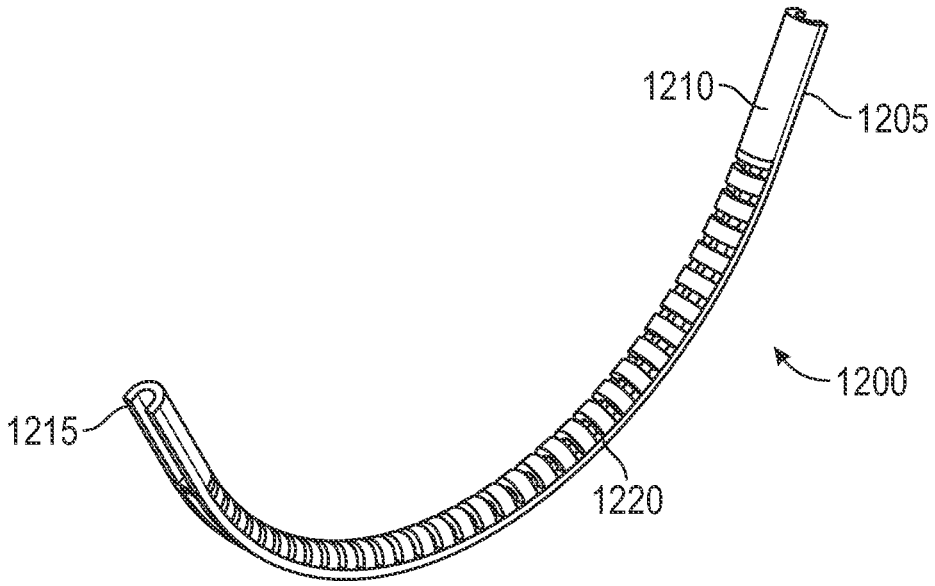
FIG. 12A shows a perspective view of a flexible track of present embodiments in a flexed position.
Figure 12B:
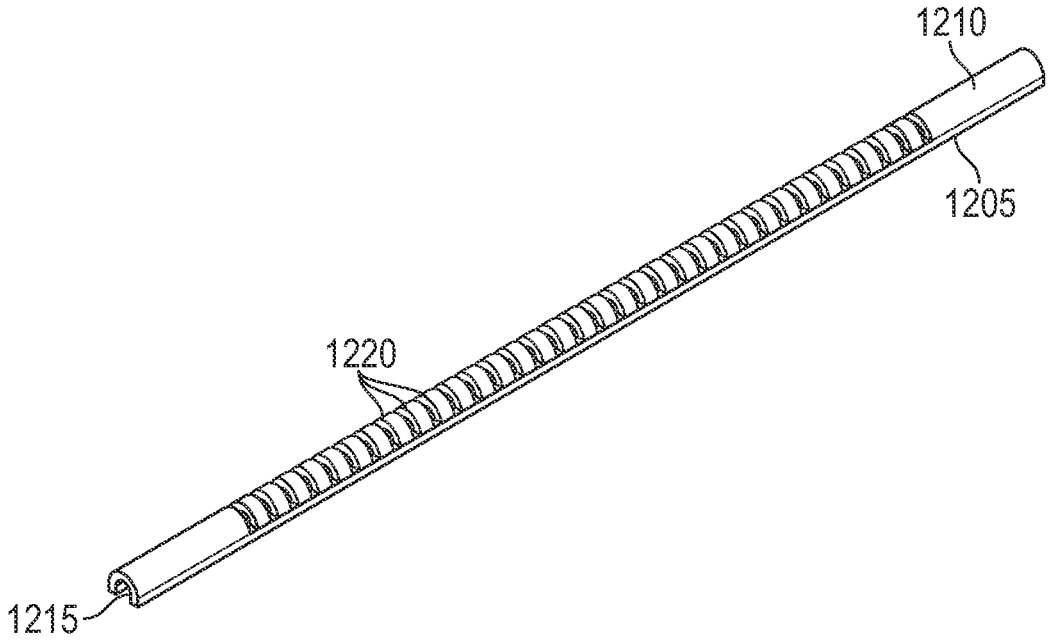
FIG. 12B shows a perspective view of a flexible track of present embodiments in a straight position.

FIG. 12A shows a perspective view of a flexible track 1200 of present embodiments in a flexed position. Shown is the flat lower edge 1205, curved upper edge 1210, the semicircular shaped recess 1215 defined by the body of the attachment, and the plurality of curved segments 1220 which define the length of the track. FIG. 12B shows a perspective view flexible track of present embodiments in a straight position. Shown is the flat lower edge 1205, curved upper edge 1210, the semicircular shaped recess 1215 defined by the body of the attachment, and the plurality of curved segments 1220. Due to the plurality of curved segments 1220 which make up the track, the track may bend in one direction in a plane as is shown in FIG. 12A. This may permit users to create curved paths that go outward, up and down, or around corners, in a unique and modular path as designed by each individual user. The width each side of the U-shaped base may be about 1.4 mm, may have a straight portion of about 1.5 mm before curving, and the semicircular shaped recess may be 3 mm across. In certain embodiments, the outer diameter of the track may be 5.8 mm, and the inner diameter of the universal female connector may be 3 mm. Each segment of track may be 180 mm in length. The flexible tracks may be composed of nylon, and, in particular, a PA66 resin. The flexible tracks may be highly flexible and be able to accommodate a full 180-degree bend in the track with a horizontal displacement of the ends of about 40 mm.

Figure 12C:
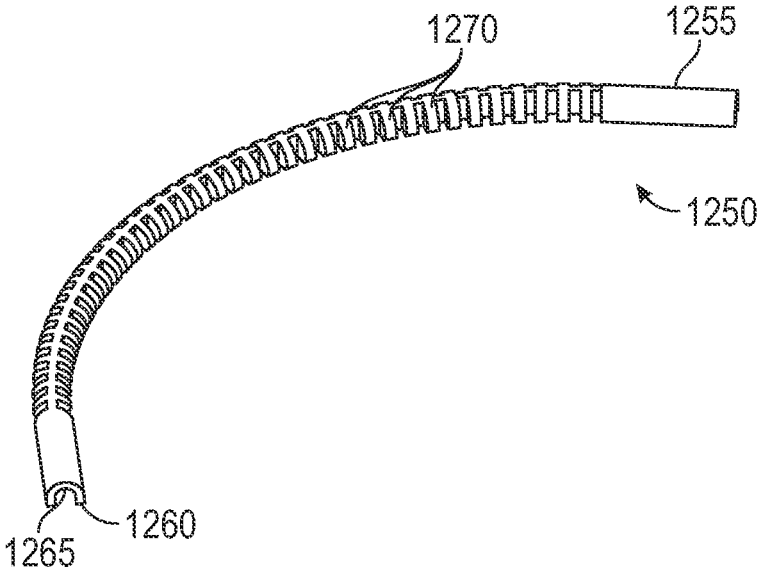
FIG. 12C shows a perspective view of a secondary flexible track of present embodiments in a flexed position.
Figure 12D:
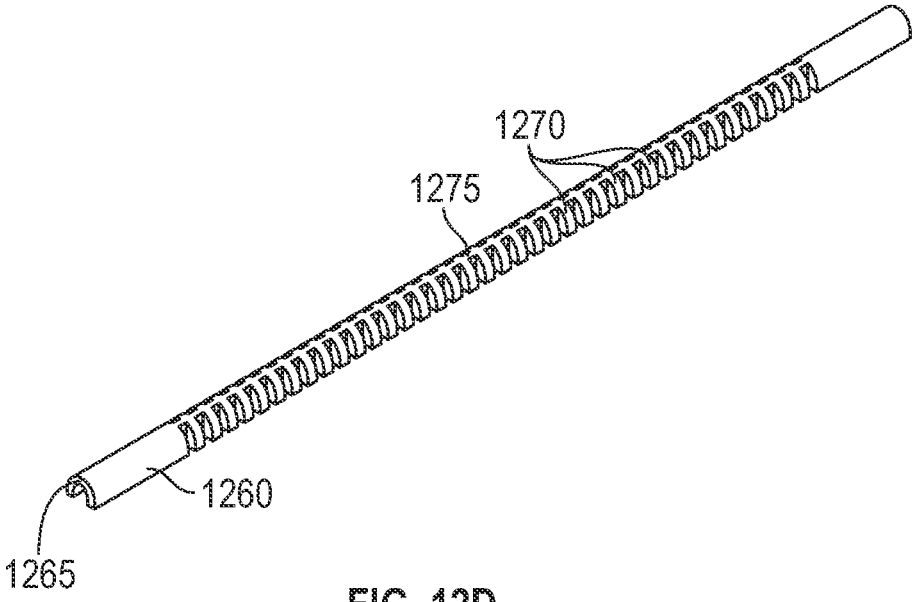
FIG. 12D shows a perspective view of a secondary flexible track of present embodiments in a straight position.
Figure 12E:
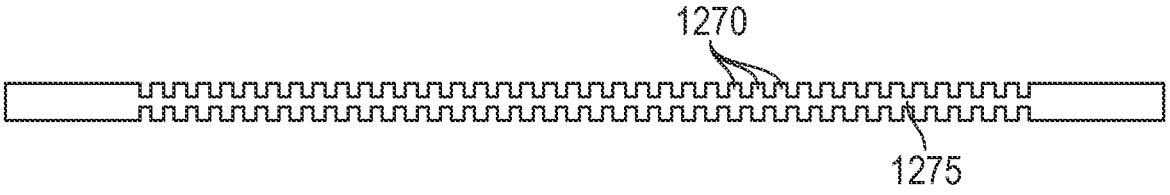
FIG. 12E shows a top view of a secondary flexible track of present embodiments in a straight position.

FIG. 12C shows a perspective view of a secondary flexible track 1250 of present embodiments in a flexed position. Shown is the curved upper edge 1255, flat lower edge 1260, semicircular shaped recess 1265, and plurality of curved segments 1270. FIG. 12D shows a perspective view of a secondary flexible track of present embodiments in a straight position. Shown is the curved upper edge 1255, flat lower edge 1260, semicircular shaped recess 1265, plurality of curved segments 1270, and the connecting spine 1275 which bisect the curved segments 1270 down the middle. FIG. 12E shows a top view of a secondary flexible track of present embodiments in a straight position where the connecting spine 1275 which bisects the curved segments 1270 down the middle is more clearly shown. With the connecting spine 1275 bisecting each curved segment, each curved segment may span a quarter arc on each side of the connecting spine 1275. Relative to the first flexible track 1200, the secondary flexible track 1250 may bend in two directions in a plane (e.g. both right to left, as opposed to only right). In such an embodiment, it may allow for the user to create curved paths which travel in another plane relative to the curved paths which can be established by the first flexible track 1200 (e.g. x-z plane vs x-y plane). Further, in some embodiments, the orientation of the non-segmented part of the tracks 1200/1250 may be turned at a 90-degree angle relative to the linear orientation shown in FIGS. 12A-E in order to allow for the user to define curved paths in yet another plane (e.g. y-z plane) from a connector attachment in the same starting position.

Figure 13A:
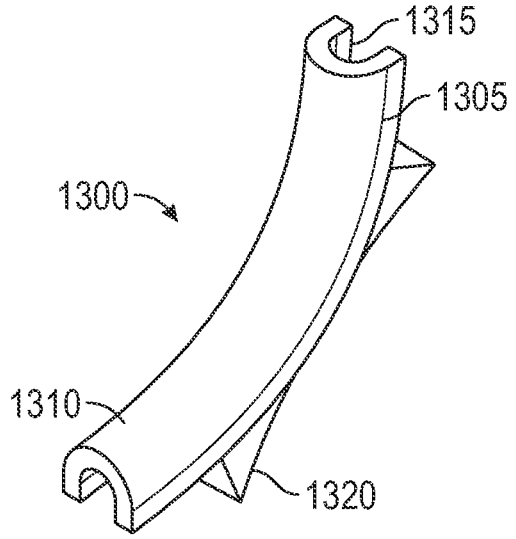
FIG. 13A shows a perspective view of an edge track of present embodiments.
Figure 13B:
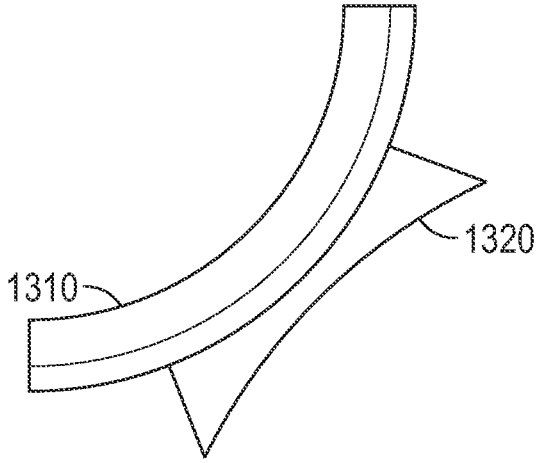
FIG. 13B shows a side view of an edge track of present embodiments.
Figure 13C:
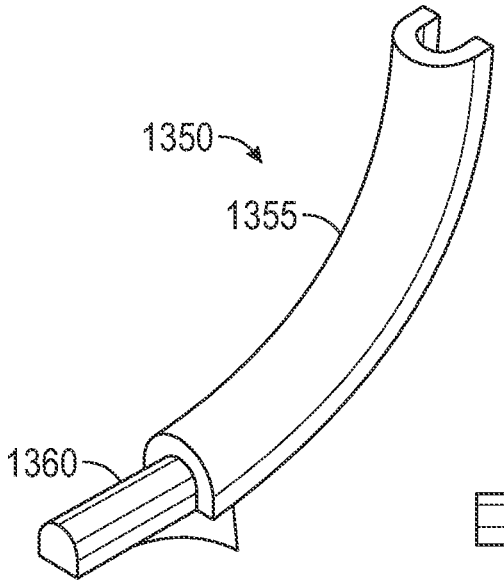
FIG. 13C shows a perspective view of an alternative edge track of present embodiments.
Figure 13D:
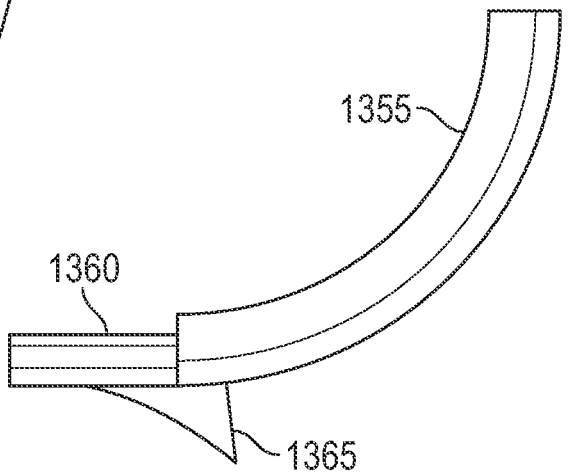
FIG. 13D shows a side view of an alternative edge track of present embodiments.

FIG. 13A shows a perspective view of an edge track 1300 of present embodiments. Shown is the flat lower edge 1305, curved upper edge 1310, universal female connector 1315, and the crescent shaped base 1320. FIG. 13B shows a side view of an edge track of present embodiments. Shown is the curved upper edge 1310 which defines an approximately 90-degree arc, and the crescent shaped base 1320. FIG. 13C shows a perspective view of an alternative edge track 1350 of present embodiments, and FIG. 13D shows a side view of the alternative edge track 1350. Shown is the universal male connector 1360, and the 90-degree arc 1355 defined by the curved edge, and the crescent shaped base 1365.

The edge track 1300 may be useful to create an upward sloped track for a marble to travel upward slightly before falling back down, and may be especially useful for subsequent tracks which receive a falling marble from a track above, as to accommodate room for error in the positioning of the lower tracks. When placed at the rear end of a lower track in this matter, the marble may slightly travel up the 90-degree arc defined by the curved upper edge 1310 to release additional kinetic energy imparted from the drop-in elevation, and then go back down and along the intended path without falling off the back of the track, as might otherwise occur in the event of a slightly misplaced lower track. Alternatively, it may be used to catch a falling marble in the 90-degree arc defined by the curved upper edge 1310, and direct it along subsequent sections of track.

Figure 14A:
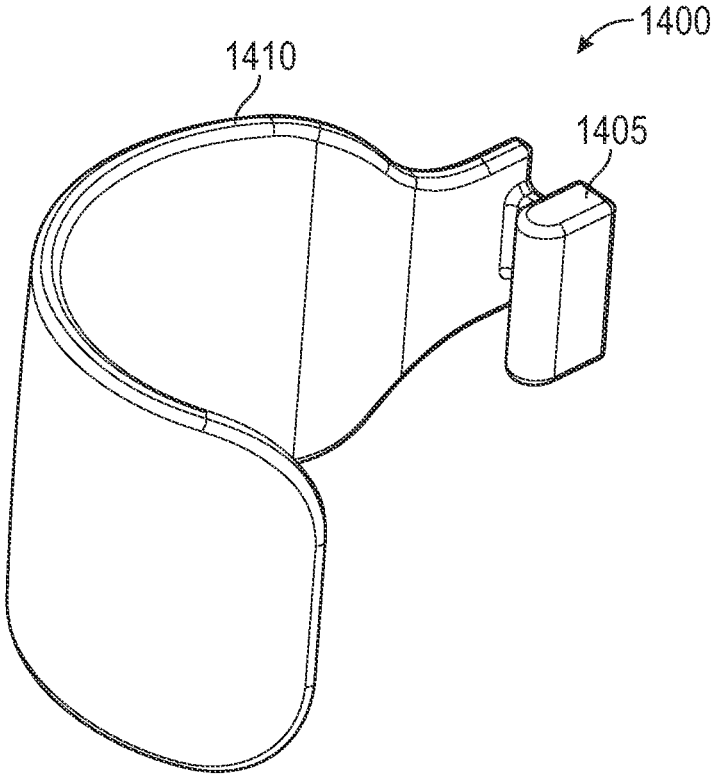
FIG. 14A shows a perspective view of a clip attachment of present embodiments.
Figure 14B:
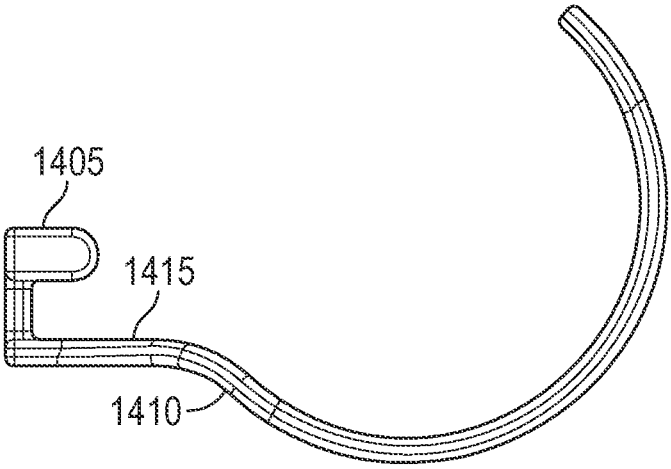
FIG. 14B shows a side view of a clip attachment of present embodiments.

FIG. 14A shows a perspective view of a clip attachment 1400 of present embodiments. Shown is the magnetic base 1405, and the semicircular shaped body 1410. FIG. 14B shows a side view of a clip attachment of present embodiments. Shown is the magnetic base 1405, the semicircular shaped body 1410, and the flat connecting section 1415 which connects the case to the semicircular body 1410. The clip attachment 1400 may be useful for attaching various components of the system together, and in particular may be useful for holding the spiral lift attachment 2700 shown in FIGS. 27A-27C, and described below.

Figure 15B:
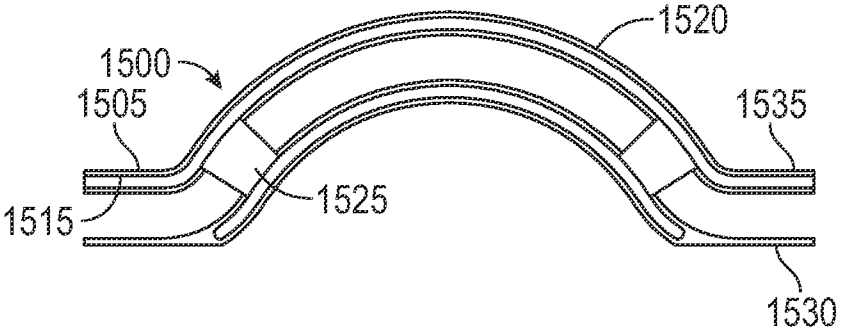
FIG. 15B shows an upward view of an around attachment of present embodiments.
Figure 15D:
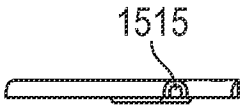
FIG. 15D shows a side view of an around attachment of present embodiments.
Figure 15A:
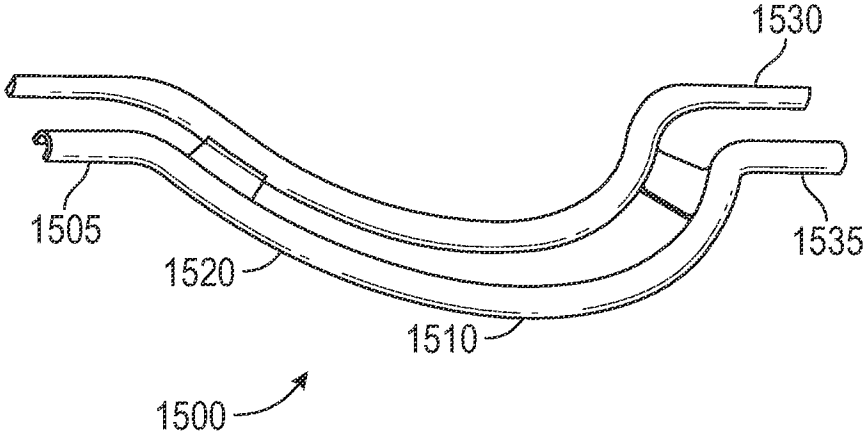
FIG. 15A shows a perspective view of an around attachment of present embodiments.

FIG. 15A shows a perspective view of an around attachment 1500 of present embodiments. Shown is the flat bottom edge 1505, the curved top edge 1510, the semicircular path 1520 defined by the two-track body, the narrow support arm 1530 on the inside edge of the attachment, and the wide connecting arm 1535 which is defined by the outer track and the curved top edge 1510. The around attachment 1500 attachment may be defined by two tracks which curve in a 180-degree path, beginning in a straight line, and ending in a straight line. The dual track structure may be necessary because the semicircular path 1520 defined by the two-track body may move the marble away from the wall, which it is normally in contact with while moving through the system. The around attachment 1500 may be useful for going around objects or protrusions on the surface which the various components of the system are mounted, or for producing a more interesting and aesthetically pleasing path. It may also be useful to allow the marble to travel from one surface to another, such as from the surface of the fridge to an oven, among many possibilities. The two-track body may define a rounded path which is generally semicircular and ends in the same direction as it began.

Figure 15C:
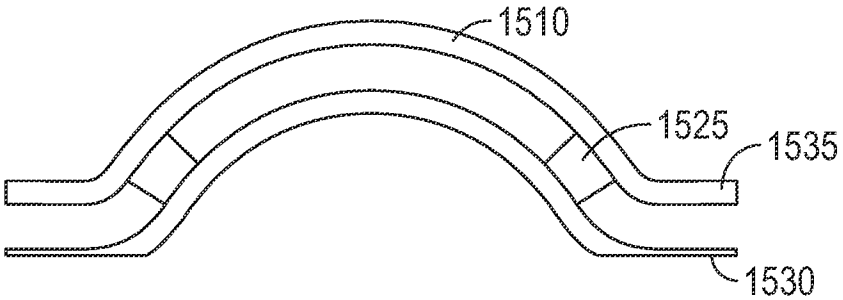
FIG. 15C shows a downward view of an around attachment of present embodiments.

FIG. 15B shows an upward view of an around attachment of present embodiments. Shown is the flat bottom edge 1505, the curved top edge 1510, the semicircular path 1520 defined by the two-track body, the narrow support arm 1530 on the inside edge of the attachment, the universal female connector 1515, and the support members 1525 which connect the two-track body. FIG. 15C shows a downward view of an around attachment of present embodiments. Shown is the curved top edge 1510, the narrow support arm 1530 on the inside edge of the attachment, and the support members 1525 which connect the two-track body. FIG. 15D shows a side view of an around attachment of present embodiments. Shown is the universal female connector 1515 and the low vertical profile.

Figure 16A:
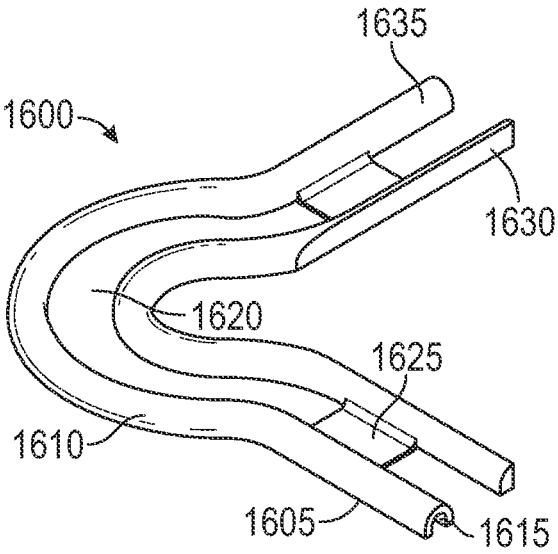
FIG. 16A shows a perspective view of a corner attachment of present embodiments.

FIG. 16A. shows a perspective view of a corner attachment 1600 of present embodiments. Shown is the flat lower edge 1605, the curved upper edge 1610, the universal female connector 1615, the % circle path 1620 defined by the two-track body which curves outward approximately 45 degrees before rounding an approximate a 125-degree curve to a trajectory that is approximately a 90 degrees difference relative to the initial vector, and the support members 1525 connecting the two-track body. The corner attachment 1600 may be useful for constructing tracks on two or more walls, around one or more corners. The dual track structure may be necessary because the % circle path 1620 defined by the two-track body may move the marble away from the wall, which it is normally in contact with while moving through the system.

Figure 16B:
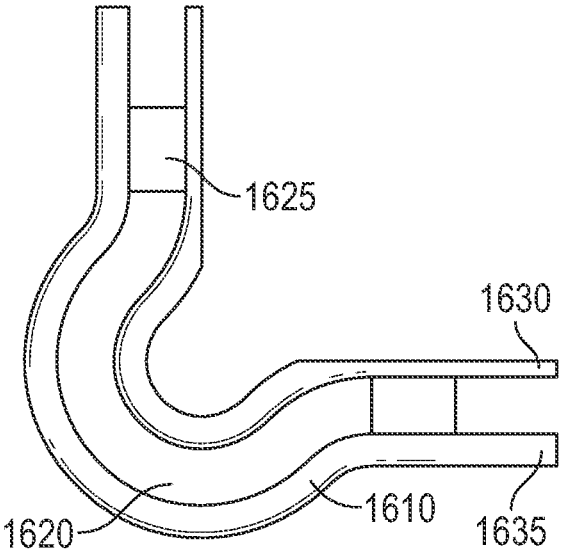
FIG. 16B shows a downward view of a corner attachment of present embodiments.
Figure 16C:
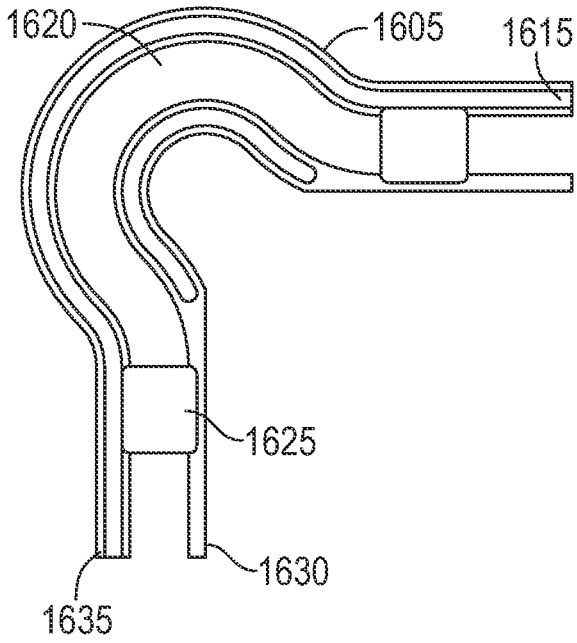
FIG. 16C shows an upward view of a corner attachment of present embodiments.
Figure 16D:
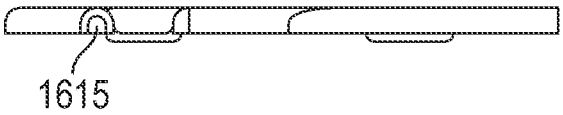
FIG. 16D shows a side view of a corner attachment of present embodiments.

FIG. 16B shows a downward view of a corner attachment of present embodiments. Shown is the flat lower edge 1605, the curved upper edge 1610, the % circle path 1620, the support members 1625 connecting the two-track body, the narrow support arm 1630, and the wide connecting arm 1635 which is defined by the outer track and the curved upper edge 1610. FIG. 16C shows an upward view of a corner attachment of present embodiments. Shown is the lower edge 1605, the curved upper edge 1610, the universal female connector 1615, the % circle path 1620, the support members 1625 connecting the two-track body, the narrow support arm 1530, and the wide connecting arm 1635. FIG. 16D shows a side view of a corner attachment of present embodiments. Shown is the universal female connector 1615, and the low vertical profile of the attachment.

Figure 17C:
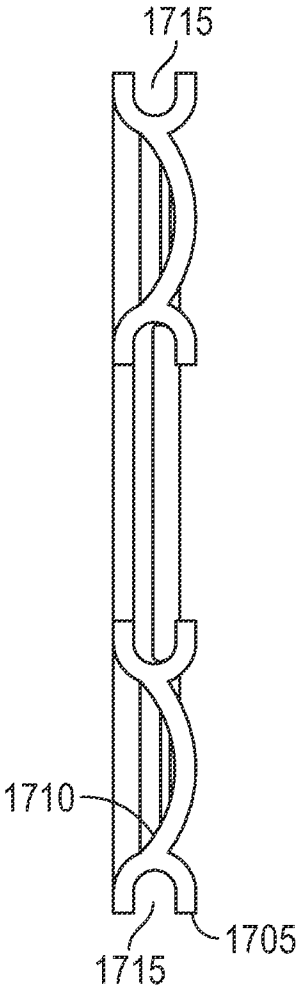
FIG. 17C shows a side view of a U turn attachment of present embodiments.
Figure 17B:
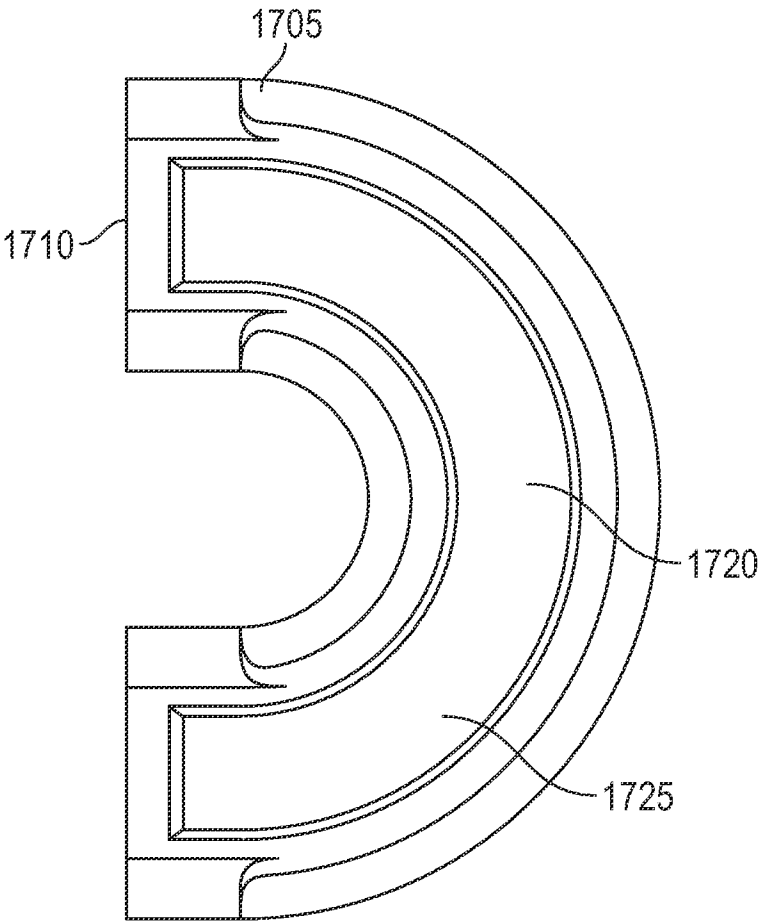
FIG. 17B shows a front view of a U turn attachment of present embodiments.
Figure 17A:
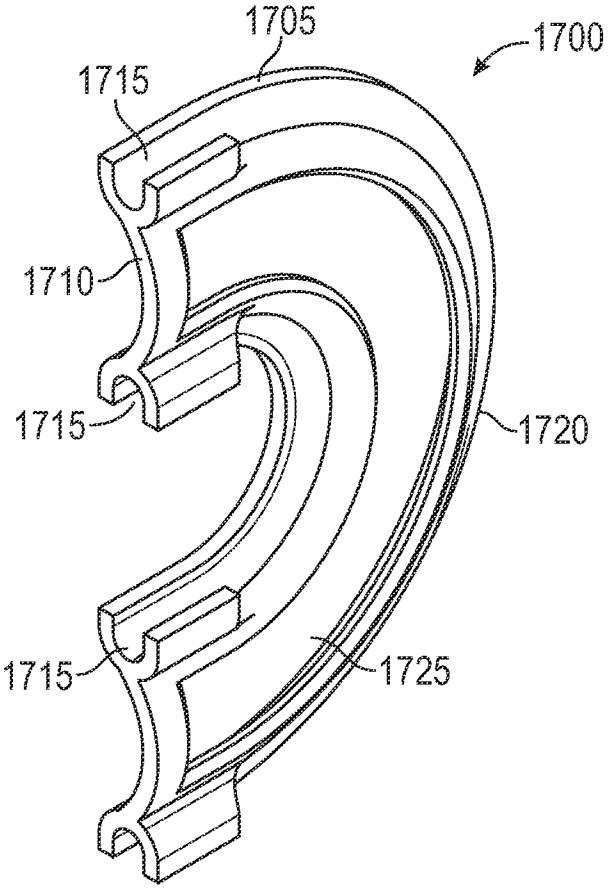
FIG. 17A shows a perspective view of a U turn attachment of present embodiments.

FIG. 17A shows a perspective view of a U turn attachment 1700 of present embodiments. Shown is the flat lower edge 1705, the semicircular edge 1710 which connects the two-track body at the first end and second end of the attachment, the universal female connector 1715, the ½ circle path 1720 which redirects a marble 180 degrees relative to the initial vector, and the curved marble recess 1725 which defies a curved surface to contact the surface of the marble. The U turn attachment 1700 may be orientated in either a vertical or horizontal manner, redirecting a marble about a 180-degree bend in the x-y plane (vertical orientation), or about a 180-degree bend in the x-z plane (horizontal orientation). The U turn attachment 1700 may be useful for quickly and smoothly changing the direction of motion of a marble with minimal vertical displacement the y direction and no horizontal displacement in the x direction, while still maintaining a significant amount of its initial velocity and kinetic energy. It may also be useful for quickly and smoothly allowing a marble to change from one level to another in the system. It can also be used to move marbles from left to right or from right to left courses by flipping it.

FIG. 17B shows a front view of a U turn attachment of present embodiments. Shown is the flat lower edge 1705, the semicircular edge 1710 which connects the two-track body at the first end and second end of the attachment, the universal female connector 1715, the ½ circle path 1720, and the curved marble recess 1725. FIG. 17C shows a side view of a U turn attachment of present embodiments. Shown is the flat lower edge 1705, the semicircular edge 1710 which connects the two-track body at the first end and second end of the attachment, universal female connector 1715, and low vertical profile.

Figure 39A:
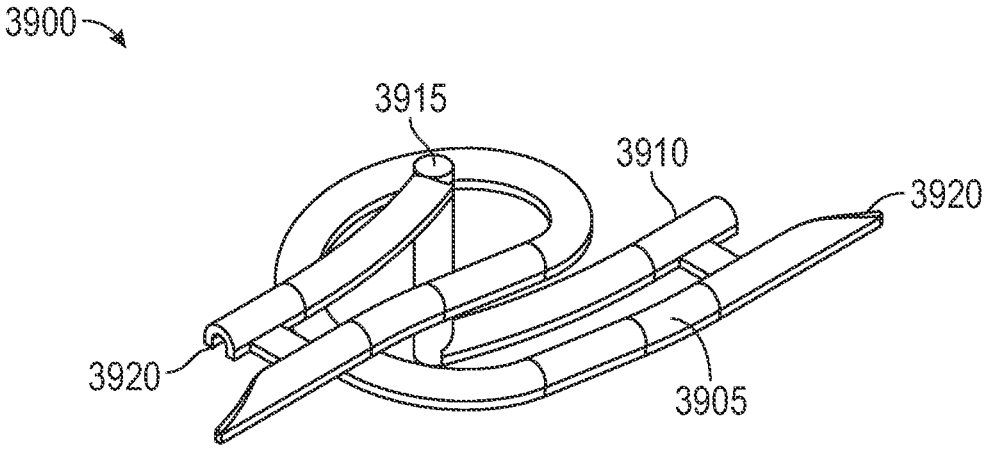
FIG. 39A shows a perspective view of a spiral track of present embodiments.
Figure 39B:
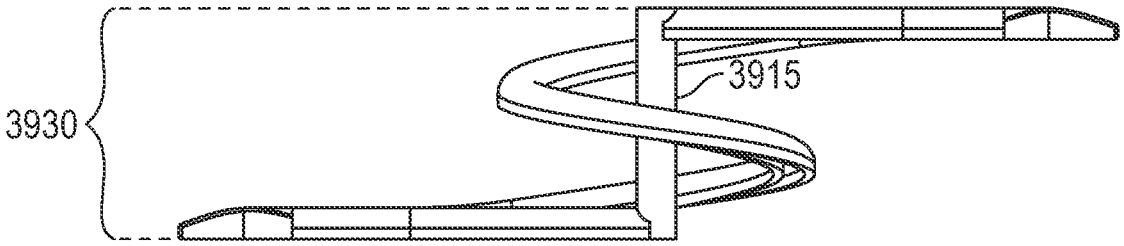
FIG. 39B shows a side view of a spiral track of present embodiments.
Figure 39C:
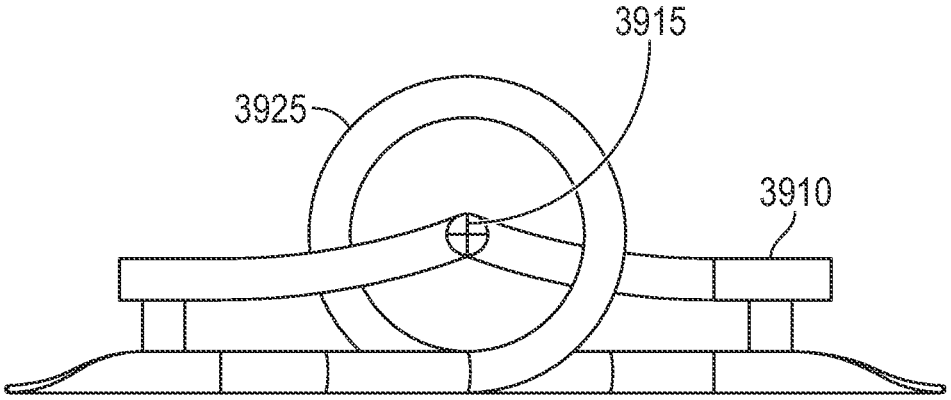
FIG. 39C shows a top view of a spiral track of present embodiments.

FIG. 39A shows a perspective view of a spiral track 3900 of present embodiments. The spiral track 3900 may function similar to the corner attachment or U turn attachment in that it is defined by a two-track body having a first outer rail 3905 and a second inner rail 3910 which supports a marble on both sides. The spiral track may go upwards or downwards, and may travel in either a clockwise or counterclockwise direction, and may define a spiral path 3925 which makes a 360-degree rotation. It may comprise a flat lower edge, curved upper edge on the surface of the first outer rail 3905, universal female connector 3920, central support column 3915, and support arms connecting the two-track body. It may be possible to position multiple spiral tracks in a series to create an even longer spiral track. Each segment of spiral track make one or more 360-degree rotations moving from the top of the track to the bottom of the track. The spiral track may be a three-dimensional piece which moves the marble outwards from the wall in the z direction as it rolls down the spiral track. FIG. 39B shows a side view of a spiral track and further shows the central support column 3915, and the vertical displacement 3930 of a single section of spiral track, which may be 32.5 mm in some embodiments. FIG. 39C shows a top view of the spiral track and further shows the first outer rail 3905, second inner rail 3910, and spiral path 3925 which makes a 360-degree rotation.

Figure 18A:
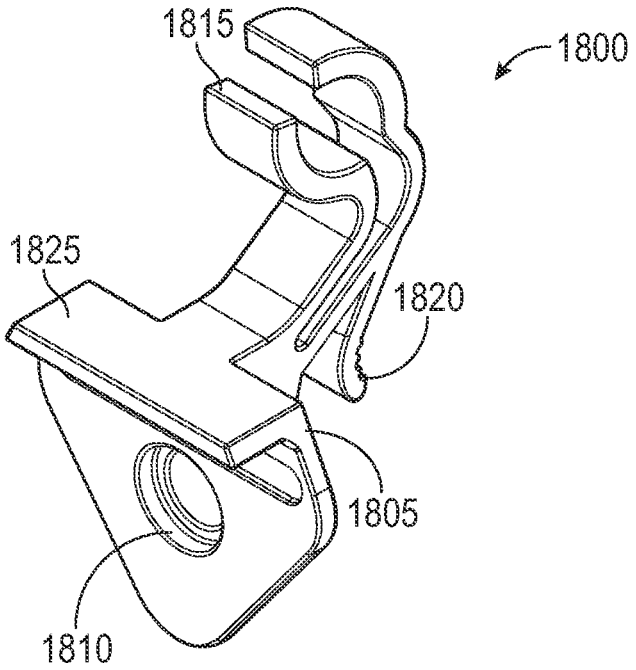
FIG. 18A shows a rear perspective view of a universal joint attachment of present embodiments.

FIG. 18A shows a rear view of a universal joint attachment 1800 of present embodiments. Shown is the attachment body 1805 defined by a flat triangular shaped member with a circular slot in the center which may serve as a hinge connector attachment point 1810, a flat platform 1825 which sits atop the triangular shaped member, the clamp 1815, and the clamp handle 1820. The universal joint attachment may be useful for clamping onto and supporting a number of different external objects within the system. The universal joint attachment 1800 may in particular be useful for adding objects such as pencils or pens to the course by clamping onto them, and allowing the marble to travel over the external object. The universal joint attachment 1800 may be able to support objects at any orientation about a 360-degree axis of rotation when connected to a hinge connector 400/500/800. The flat platform 1825 may contact of the flat surfaces of the generally triangular body of the hinge connectors 400/500/800, effectively locking it into place. The clamp 181 may be defined by two partial ovoid members which each connected to the attachment body 1805 by support members that extend outward from the body at approximately 45 degrees. The clamp handle 1820 may have a texture or knurling on the surface such that it is easier to grip.

Figure 18B:
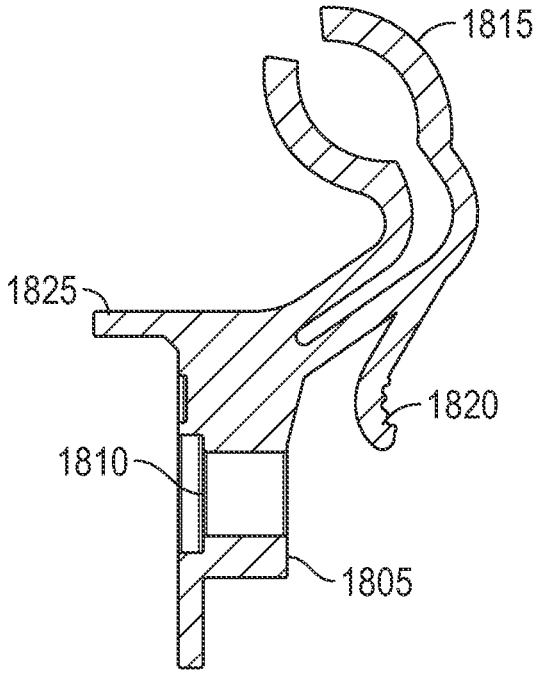
FIG. 18B shows a cross section side view of a universal joint attachment of present embodiments.
Figure 18C:
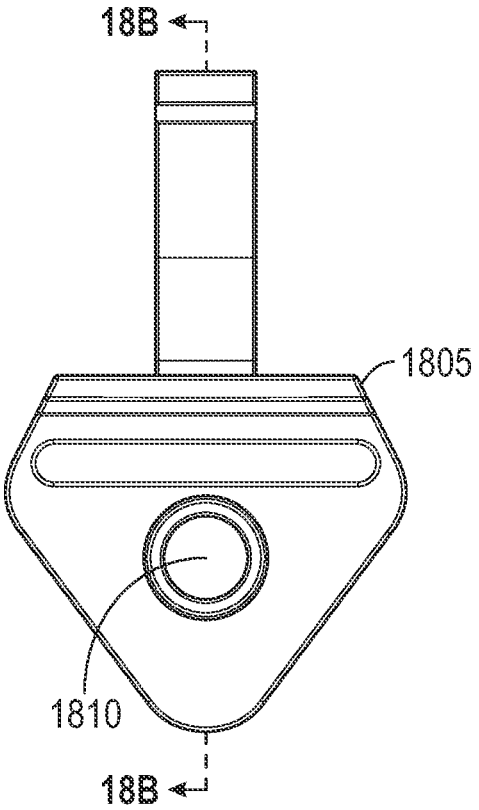
FIG. 18C shows a rear view of a universal joint attachment of present embodiments.

FIG. 18B shows a cross sectional view of a universal joint attachment of present embodiments. Shown is the attachment body 1805, flat platform 1825, the clamp 1815, and the clamp handle 1820. FIG. 18C shows a rear view of a universal joint attachment of present embodiments. Shown is the attachment body 1805 defined by a flat triangular shaped member, and a hinge connector attachment point 1810.

Figure 19A:
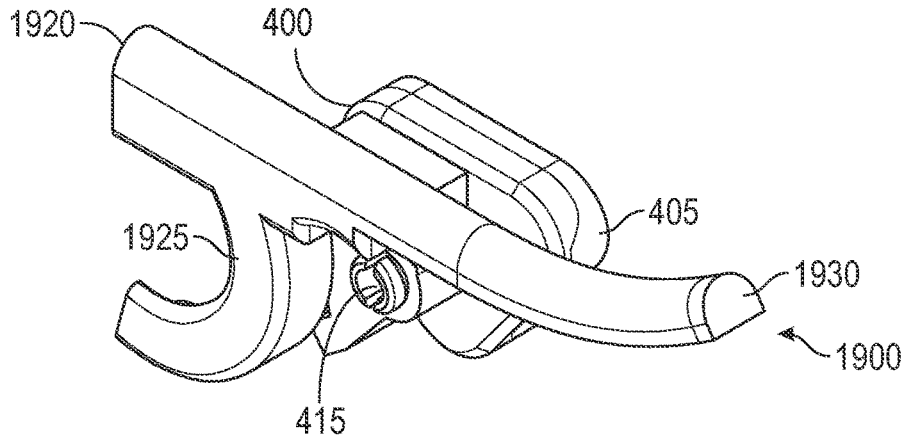
FIG. 19A shows a perspective view of a fork attachment of present embodiments.
Figure 19B:
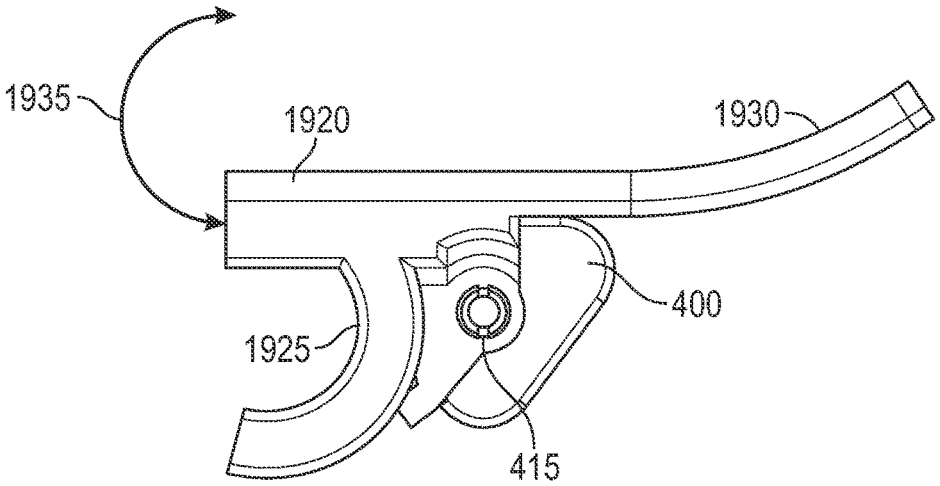
FIG. 19B shows a front view of a fork attachment of present embodiments.

FIG. 19A shows a perspective view of a fork attachment 1900 of present embodiments attached to a hinge connector 400. Shown is the curved upper edge 1920, semicircular marble catch 1925, and curved upper member 1930. Also shown is the hinge connector 400, the rear rubber casing 405 of the hinge connector, and the hinge pin 415. FIG. 19B shows a front view of a fork attachment of present embodiments. Shown is the curved upper edge 1920, semicircular marble catch 1925, curved upper member 1930, and the direction of rotation 1935 about the hinge pin 415.

As a marble travels over the curved upper edge 1920 and onto the curved upper member 1930, leverage is created over the fork attachment 1900 as the weight of the marble is placed over a point far to the right of and slightly above the hinge pin 415, which defines an axis of rotation, creating a downward force which rotates the fork attachment 1900 to the right. Once rotated to the right, a subsequent marble which travels about the same path will get caught in the semicircular marble catch 1925, which will be in a raised position, instead of travelling over the curved upper edge 1920. Once caught in the semicircular marble catch 1925, the weight of the marble will create a downward force which will rotate the fork attachment 1900 to the left, and back to its starting position, which will then release the marble to travel in a direction opposite relative to the first marble. In this manner, the fork attachment 1900 can serve to direct marbles in two opposite directions, in an alternating fashion.

Figure 20A:
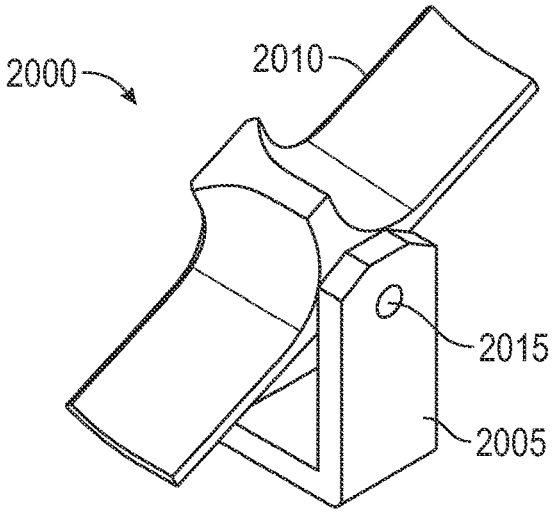
FIG. 20A shows a rear view of a switch attachment of present embodiments.
Figure 20B:
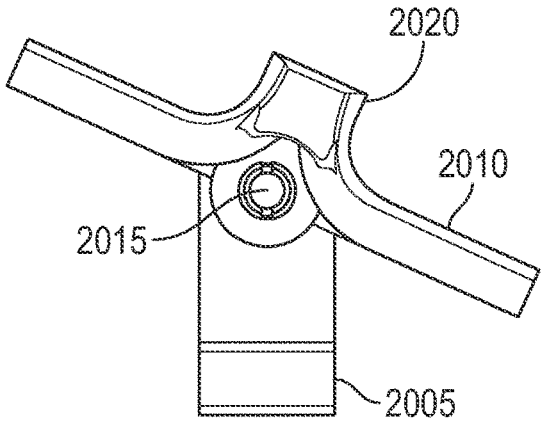
FIG. 20B shows a front view of a switch attachment of present embodiments.
Figure 20C:
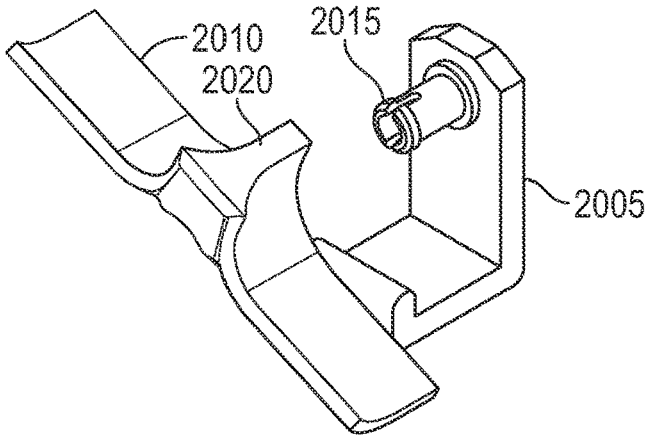
FIG. 20C shows an exploded view of a switch attachment of present embodiments.

FIG. 20A shows a rear view of a switch attachment 2000 of present embodiments. Shown is the switch base 2005, seesaw body 2010, and hinge 2015 upon which the seesaw pivots. FIG. 20B shows a front view of a switch attachment of present embodiments. Shown is the seesaw body 2010, hinge 2015, and symmetric ¼ arc marble receiving recess 2020. FIG. 20C shows an exploded view of a switch attachment of present embodiments. Shown is the switch base 2005, seesaw body 2010, hinge 2015, and symmetric ¼ arc marble receiving recess 2020.

The switch attachment 2000 may serve to send marbles that fall onto it in opposite directions in an alternating fashion. If positioned underneath a structure which drops a marble onto it, the marble may fall onto the symmetric ¼ arc marble receiving recess 2020, and the weight of the marble will cause the seesaw body 2010 to rotate either left or right, and send the marble along a subsequent track. Then a second marble will fall onto the opposite symmetric ¼ arc marble receiving recess 2020 on the opposite side, which will again rotate the seesaw body 2010, and the second marble will move along a subsequent track on the opposite side of the switch attachment 2000. As shown in FIG. 20B, each symmetric ¼ arc marble receiving recess 2020 can be positioned directly below a falling marble depending on which way the seesaw body 2010 is positioned, and it may change position every time a marble falls onto it.

Figure 21A:
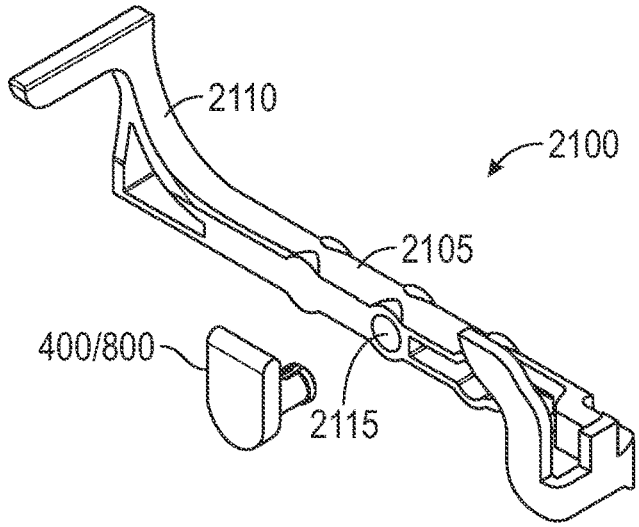
FIG. 21A shows a rear perspective view of a flip attachment of present embodiments.
Figure 21B:
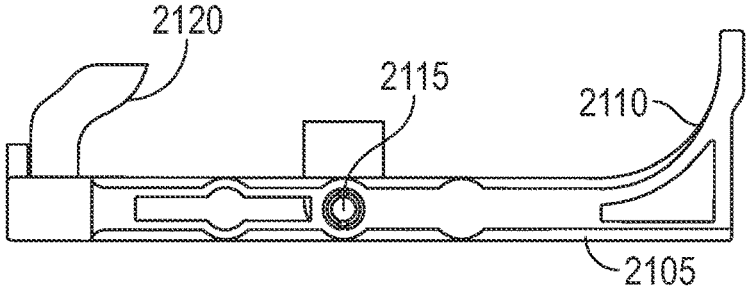
FIG. 21B shows a front view of a flip attachment of present embodiments.
Figure 21C:
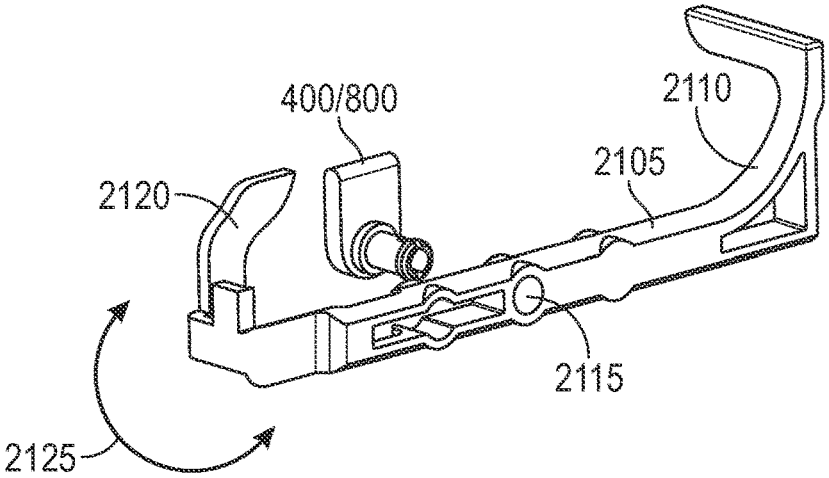
FIG. 21C shows an exploded view of a flip attachment of present embodiments.

FIG. 21A shows a rear view of a flip attachment 2100 of present embodiments. Shown is the body 2105, the ¼ arc curve 2110 at a first end of the attachment, rear hook 2120 at a second end of the attachment, and hinge attachment point 2115. FIG. 21B shows a front view of a flip attachment of present embodiments. Shown is the body 2105, the ¼ arc curve 2110, rear hook 2120, and hinge attachment point 2115. FIG. 21C shows an exploded view of a flip attachment of present embodiments. Shown is the body 2105, the ¼ arc curve 2110, rear hook 2120, and hinge attachment point 2115. Also shown is a hinge attachment 400/500/800, and the direction of rotation 2125 about the hinge. There may be a flat, straight member which extends orthogonally from the top of the ¼ arc curve 2110.

The flip attachment 2100 may function as a gate, by rotating about the hinge attachment 400/500/800 when a marble rolling along the course pushes the rear hook 2120 downwards. As the rear hook 2120 is pushed downwards, the other side of the flip attachment 2100 will rotate upwards, and the straight member which extends orthogonally from the top of the ¼ arc curve 2110 will be raised. Provided that there are one or more marbles already on the flip attachment 2100, one marble will be released as the straight member which extends orthogonally from the top of the ¼ arc curve 2110 is raised, and no longer obstructing its path. In this way, the flip attachment may serve as an alternative means of changing the flow of marbles in the system. The flip attachment 2100 may comprise means to automatically reset itself to a neutral horizontal position, with the right side of the attachment with the ¼ arc curve 2110 being heavier than the left side. Further, the hinge attachment point 2115 may be positioned slightly left of center such that the flip attachment 2100 will naturally rotate to the right.

Figure 22A:
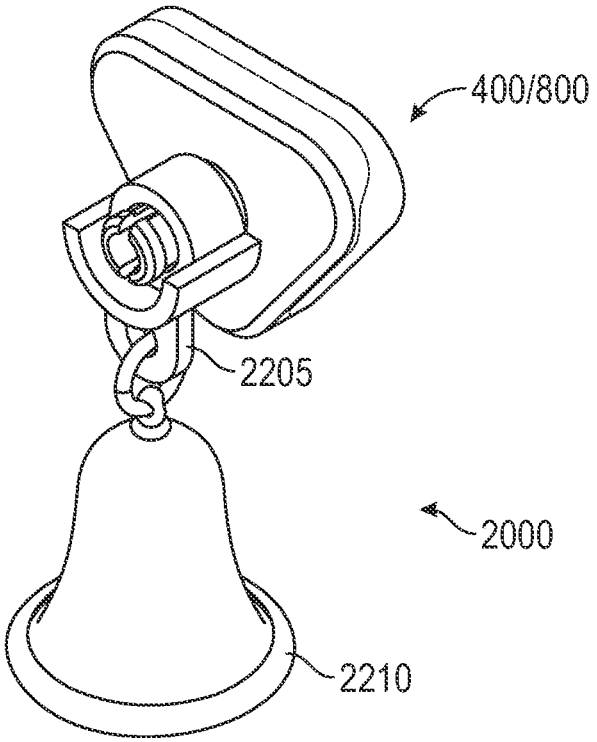
FIG. 22A shows a perspective view of a bell attachment of present embodiments.
Figure 22B:
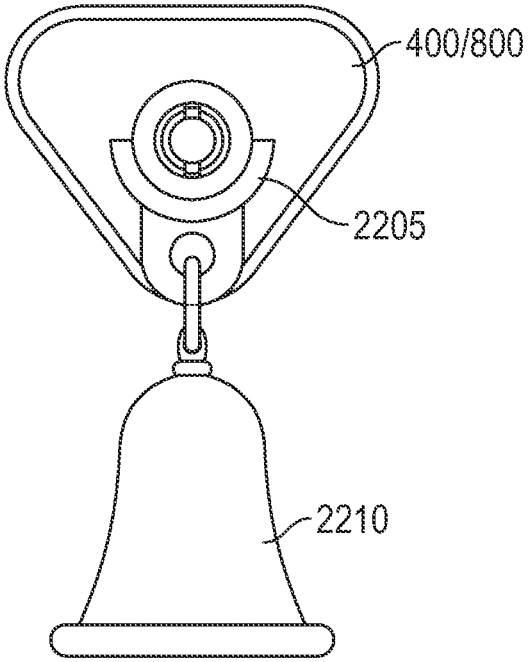
FIG. 22B shows a front view of a bell attachment of present embodiments.

FIG. 22A shows a perspective view of a bell attachment assembly 2200 of present embodiments attached to a hinge connector 400/500/800. Shown is the hinge attachment point 2205, and bell shell 2210. FIG. 22B shows a front view of a bell attachment of present embodiments. Shown is the hinge connector 400/500/800, hinge attachment point 2205, and bell shell 2210. The bell attachment assembly 2200 may be positioned above slightly a track such that a marble will ring the bell as it moves along the track, and strikes the bell shell 2210. The bell attachment assembly 2200 may further comprise a clapper positioned inside the bell shell 2210. In some embodiments, the bell may freely rotate about the hinge connector and produce a better sound because of its capacity to spin around.

Figure 23A:
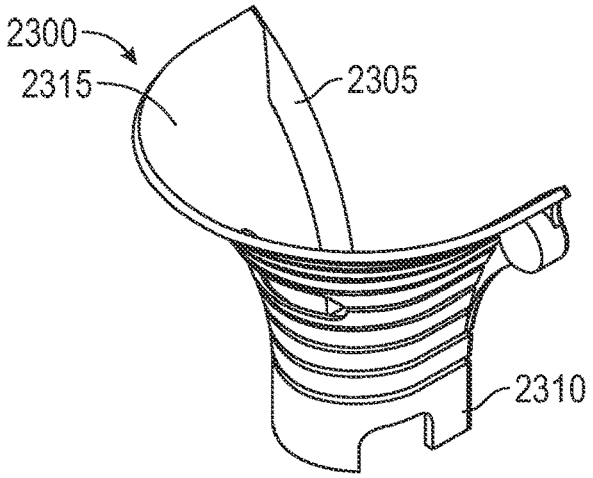
FIG. 23A shows a perspective view of a funnel attachment of present embodiments.
Figure 23B:
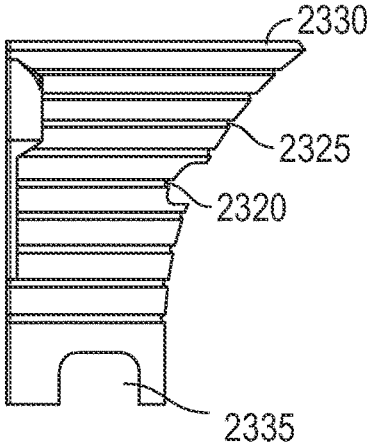
FIG. 23B shows a side view of a funnel attachment of present embodiments.
Figure 23C:
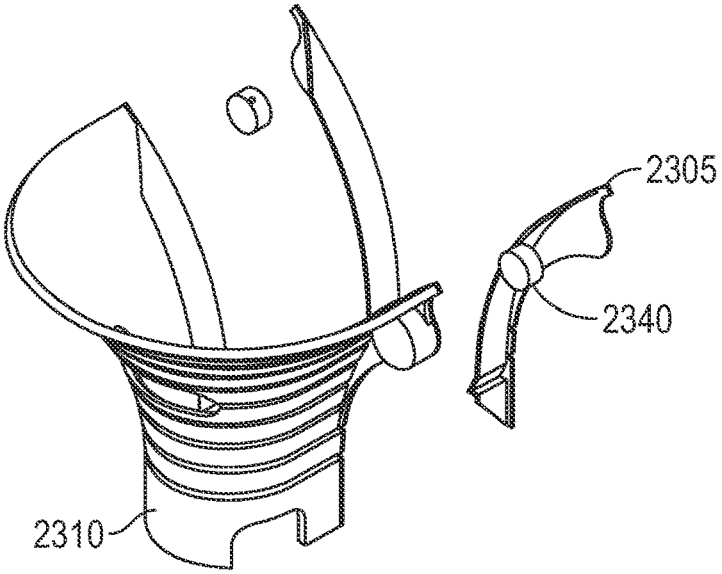
FIG. 23C shows an exploded view of a funnel attachment of present embodiments.

FIG. 23A shows a perspective view of a funnel attachment 2300 of present embodiments. Shown is the rear rubber cover 2305, the ½ concave conical shaped body 2310 with a wide diameter opening on a first end that tapers down to a smaller opening on the opposite end, and smooth half conical shaped interior 2315. FIG. 23B shows a side view of a funnel attachment of present embodiments. Shown is the ½ concave conical shaped body 2310, front slot 2320 positioned on the front face of the funnel body 2310, slanted and stepped exterior surface 2325, flat upper edge 2330, and marble sized lower bottom hole 2335. FIG. 23C shows an exploded view of a funnel attachment of present embodiments. Shown is the rear rubber cover 2305, the ½ concave conical shaped body 2310, and magnets 2340. The funnel attachment 2300 may serve to provide a wider target area to catch marbles falling from an upper level of the track and move them to a lower track more easily over a greater change in elevation than would otherwise be possible without the funnel attachment 2300.

Figure 24A:
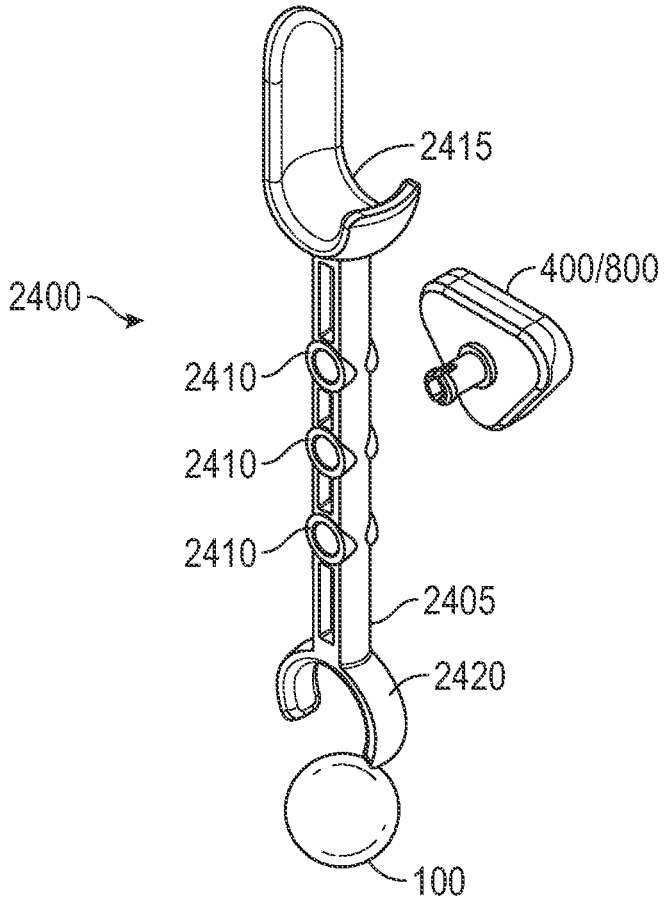
FIG. 24A shows a perspective view of a pole attachment of present embodiments.
Figure 24B:
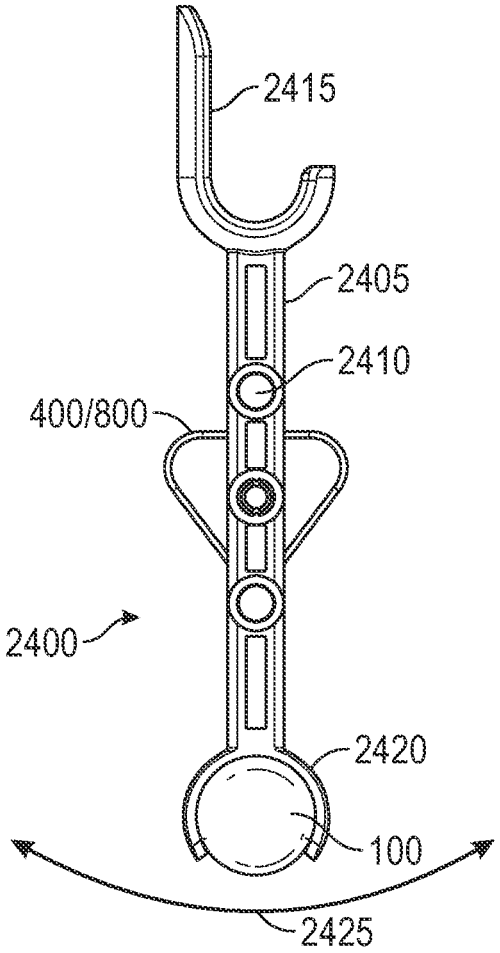
FIG. 24B shows a front view of a pole attachment of present embodiments.

FIG. 24A shows a perspective view of a pole attachment 2400 of present embodiments. Shown is the pole body 2405, the plurality of hinge attachment points 2410, the rounded hook marble recess 2415, lower marble clamp 2420, marble 100, and hinge connectors 400/500/800. FIG. 24B shows a front view of a pole attachment of present embodiments. Shown is the pole body 2405, the plurality of hinge attachment points 2410, the round hook marble recess 2415, lower marble clamp 2420 with a marble 100 inserted, with the pole attachment 2400 attached to a hinge connector 400/500/800. Also shown is the direction of rotation 2425 about the hinge connector 400/500/800.

As a marble falls into the rounded hook marble recess 2415 of the pole attachment 2400, it will cause the pole attachment to rotate about the hinge attachment 400/500/800 in the direction that the marble is traveling as the kinetic energy from the marble is transferred to the pole body 2405. This can effectively and efficiently move the marble from point A to point B along a well-defined path in a reliable manner. The weight of the marble 100 secured in the lower marble clamp 2420, having been displaced from center by the rotation of the pole, may then serve to provide a restoring force to the pole attachment 2400, moving it back to a neutral position where it is ready to receive another marble. The displacement of the pole attachment and the path along which it moves a marble can be altered by connecting the hinge connector 400/500/800 at different hinge connector attachment points 2410 along the pole body 2405, with the longest path being achieved by connecting the pole attachment 2400 to a hinge connector at the lowest point on the pole body, and the shortest path being achieved by connecting it to a hinge connector at the highest point. The marble may fit into the lower marble clamp 2420 by snapping in, using a friction fitting, or other fastening means known within the art. The weight of the marbles needed to move the pole can also be altered by the weight by connecting the hinge connector 400/500/800 at different hinge connector attachment points 2410 along the pole body 2405, with the weight of 2 marbles being needed to rotate the pole when it is positioned on the uppermost attachment point, adding additional possibilities to the operation of the system.

Figure 25A:
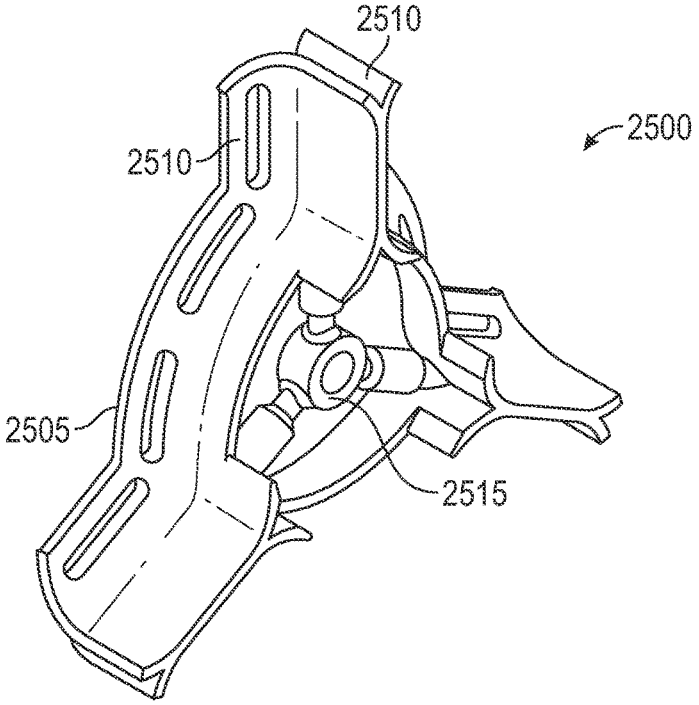
FIG. 25A shows a rear perspective view of a spinner attachment of present embodiments.
Figure 25B:
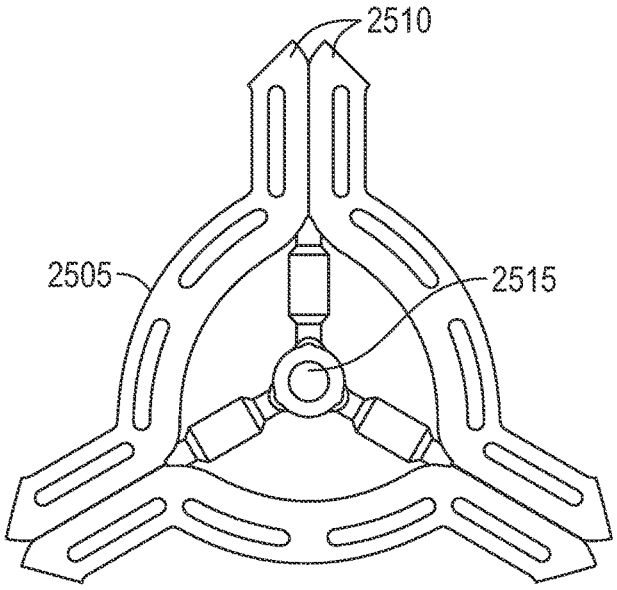
FIG. 25B shows a front view of a spinner attachment of present embodiments.

FIG. 25A shows a rear perspective view of a spinner attachment 2500 of present embodiments. Shown is the spinner body 2505, the symmetric fins 2510 which each span approximately 120 degrees around the spinner and have two curved, symmetric leading ends, and the hinge connector attachment point 2515. FIG. 25B shows a front view of a spinner attachment of present embodiments. Shown is the spinner body 2505, the symmetric fins 2510, and the hinge connector attachment point 2515. As a marble falls from above onto one of the symmetric fins 2510, it will cause the spinner to rotate, moving to one of the curved leading ends, further rotating the spinner, before moving onto a subsequent section of track. The spinner may add a visually appealing element to the course as it spins around when marbles travel over it. The spinner attachment 2500 can also trigger awaiting marbles when a marble from the course rolls along a track and turns the spinner.

Figure 26A:
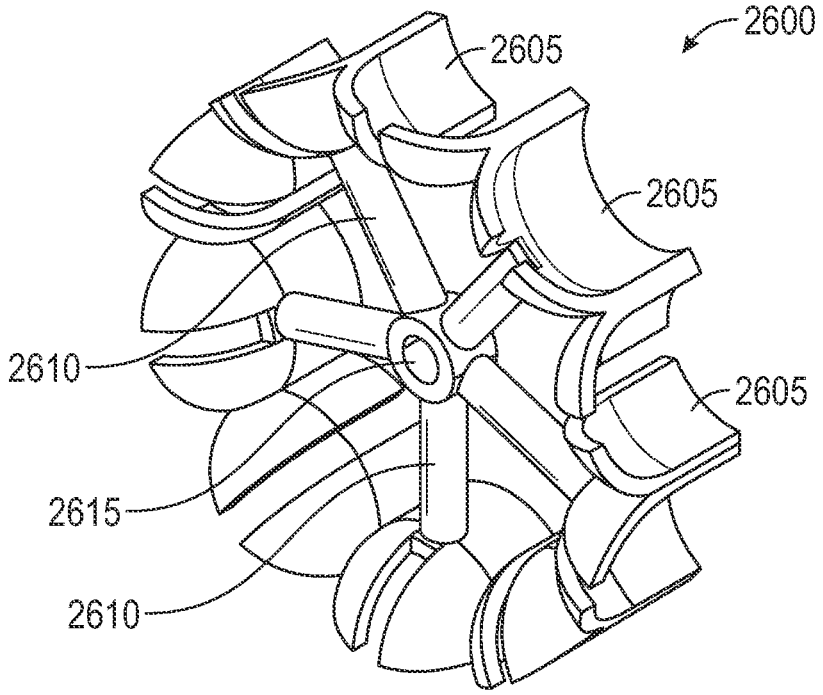
FIG. 26A shows a perspective view of a secondary spinner attachment of present embodiments.
Figure 26B:
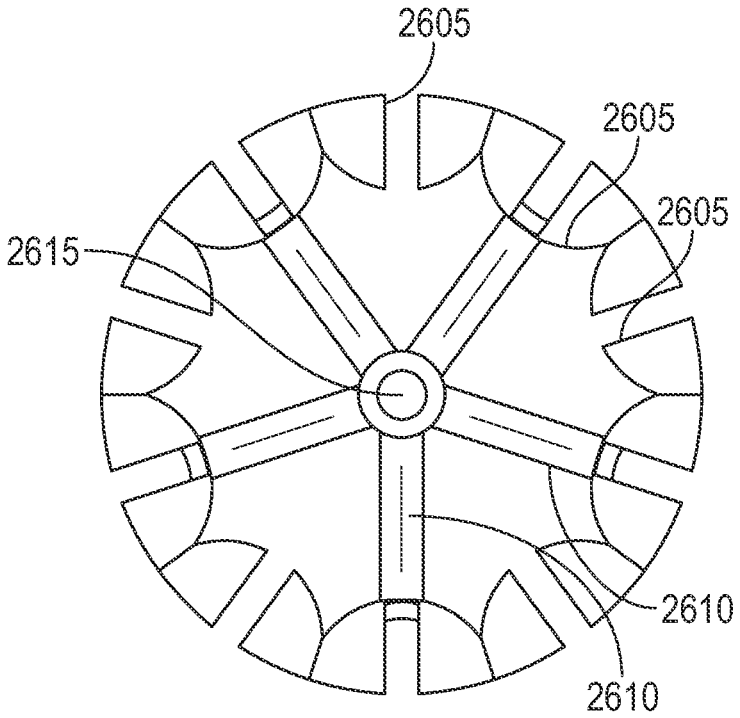
FIG. 26B shows a front view of a secondary spinner attachment of present embodiments.

FIG. 26A shows a perspective view of a secondary spinner attachment 2600 of present embodiments. Shown is the hinge connector attachment point 2615, a plurality of semispherical marble cups 2605, and a plurality of support arms 2610 attached to the cups. FIG. 26B shows a front view of a secondary spinner attachment of present embodiments. Shown is the hinge connector attachment point 2615, a plurality of semispherical marble cups 2605, and a plurality of support arms 2610 attached to the cups. As a marble falls from above onto one of the semispherical marble cups 2605, it will cause the secondary spinner attachment 2600 to rotate in a visually pleasing manner. The secondary spinner attachment 2600 may be advantageous over the standard spinner attachment 2500 in that it provides a plurality of semispherical marble cups 2605 to catch a falling marble in more positions, and may move the marble through the course more smoothly than the standard spinner attachment 2500. The secondary spinner attachment 2600 can also serve as a switch when a marble falls onto a semispherical marble cup 2605 which is exactly centered at the top of the of the spinner, turning either clockwise or counterclockwise, alternating randomly, and possibly changing the direction of a marble through the course.

Figure 27A:
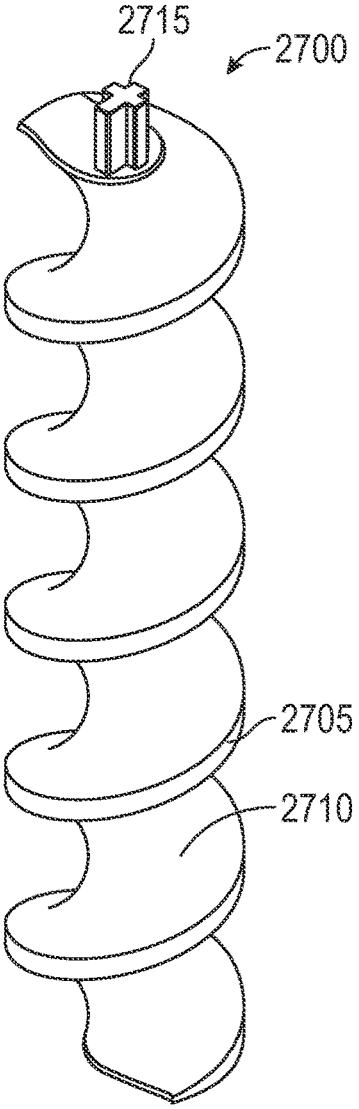
FIG. 27A shows a perspective view of a spiral lift attachment of present embodiments.
Figure 27B:
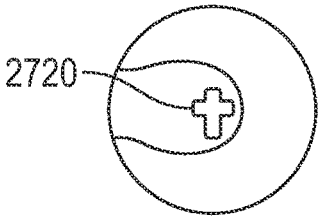
FIG. 27B shows a downward view of a spiral lift attachment of present embodiments.
Figure 27C:
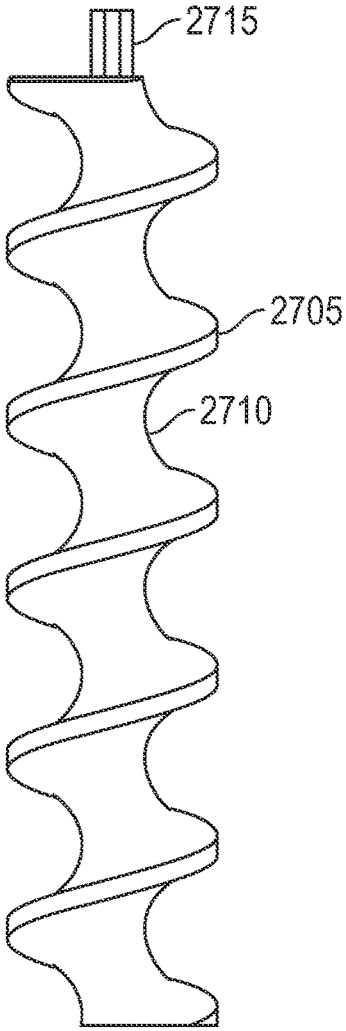
FIG. 27C shows a side view of a spiral lift attachment of present embodiments.

FIG. 27A shows a perspective view of a spiral lift attachment 2700 of present embodiments. Shown is the counterclockwise upward spiral body 2705, and the asymmetrical cross shaped male connector 2715 positioned on the top of the spiral lift attachments. FIG. 27B shows a downward view of a spiral lift attachment of present embodiments. Shown is the asymmetrical cross shaped female connector 2720 positioned on the bottom of the spiral lift attachments. FIG. 27C shows a side view of a spiral lift attachment of present embodiments. Shown is the counterclockwise upward spiral body 2705, and the asymmetrical cross shaped male connector 2715, and generally vertical center pillar 2710 which defines the axis of rotation that the spiral lift attachment 2700 rotates about. In combination with other components of the system, the spiral lift attachment 2700 can move a marble upwards. The asymmetrical cross shaped connectors may be advantageous in that they will only allow the spiral lift attachments 2700 to be connected in the correct orientation such that the multiple spiral lift attachments 2700 will be proper aligned when connected in series.

Figure 28A:
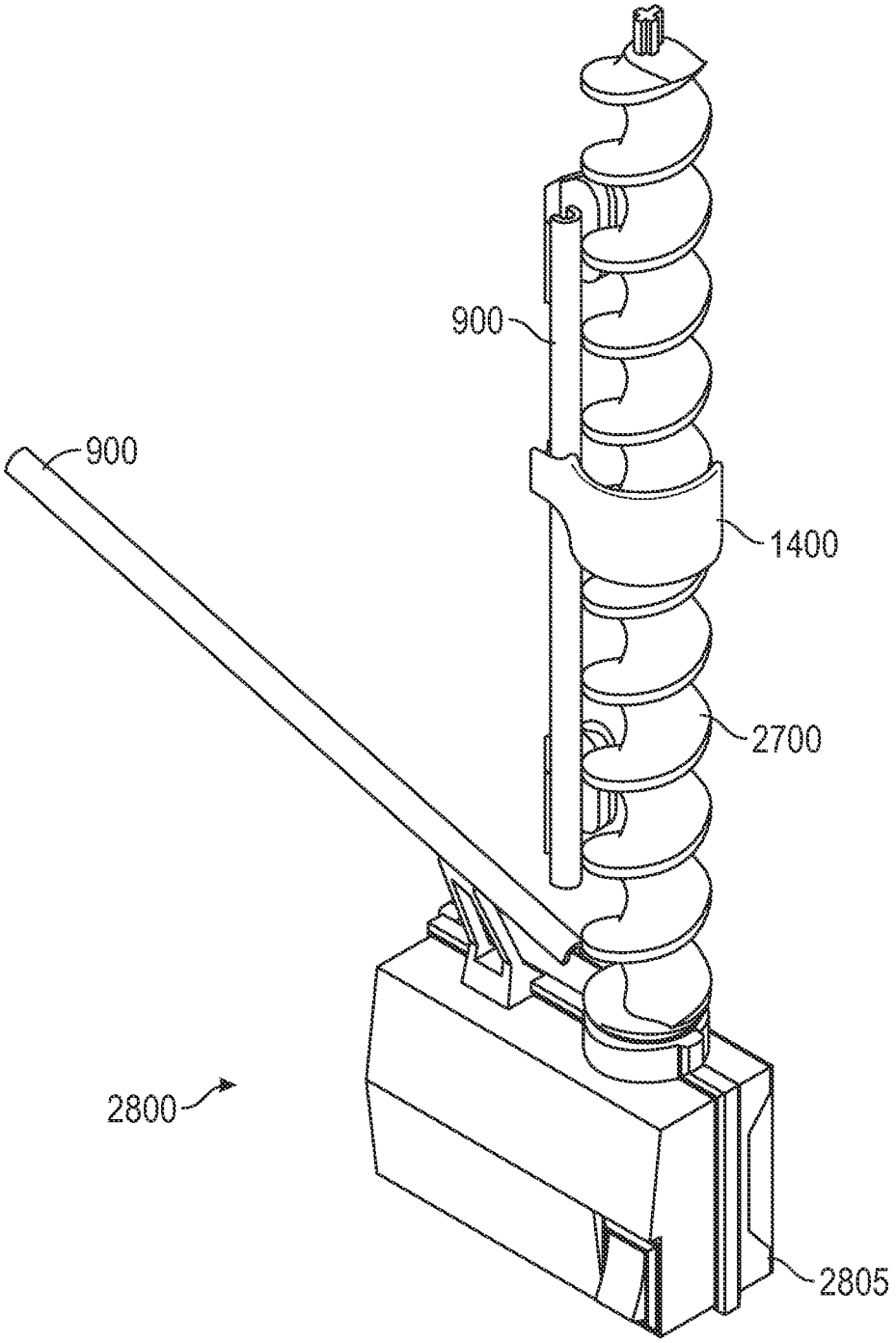
FIG. 28A shows a perspective view of a spiral lift assembly of present embodiments.
Figure 28B:
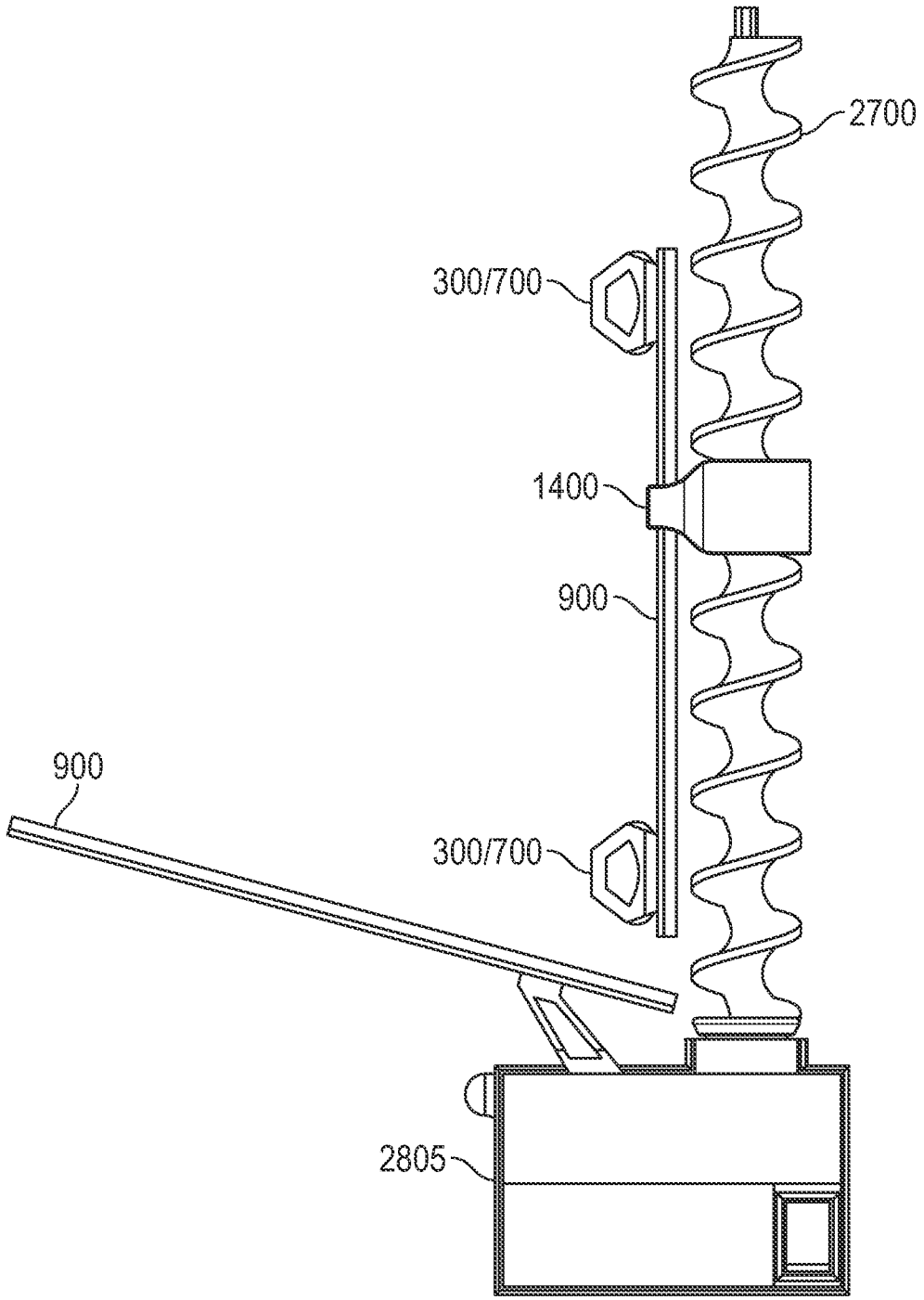
FIG. 28B shows a front view of a spiral lift assembly of present embodiments.

FIG. 28A shows a perspective view of a spiral lift assembly 2800 of present embodiments. Shown is the spiral lift attachment 2700, battery powered motor 2805 which comprises an asymmetrical cross shaped male to connect to and rotate the spiral lift attachment, one or more straight rail attachments 900, and a clip attachment 1400 to hold the spiral lift attachment 2700. FIG. 28B shows a front view of a spiral lift assembly of present embodiments. Shown is the spiral lift attachment 2700, battery powered motor 2805, one or more straight rail attachments 900, a clip attachment 1400, and connectors 300/600/700 which may hold the straight rail attachments 900. The straight rail 900 positioned adjacent and parallel to the length of the spiral lift attachment 2700 may be necessary to keep a marble from falling off the lift, and moving upward as the spiral lift attachment 2700 is rotated by the motor. In combination, the spiral lift assembly may allow for a marble to move upward and through a course repeatedly without any additional human intervention following the initial launch of the marble, and turning the motor on. The spiral lift assembly 2800 can also be positioned in a horizontal or diagonal orientation, moving marbles horizontally or diagonally through the course, either upwards or downwards. The motor and additional components of the system may also use a universal connection which will allow the motor to power future components of the system with a motorized movement, such as conveyor belts, among other possibilities.

The system may also comprise a manual gear box with a crank or a handle that can manually be turned by a user in order to power the spiral lift attachment. In such an embodiment, there may be a gear box in place of the battery powered motor 2805, and may be configured to rotate the spiral lift attachment when the handle is turned, rotating the gears in the gear box, which in turn rotates the spiral lift. The gear box may comprise a ratchet or stopping mechanism to prevent rotation in an opposite direction which would result in the spiral lift turning in reverse, and moving the marble downward.

Figure 29A:
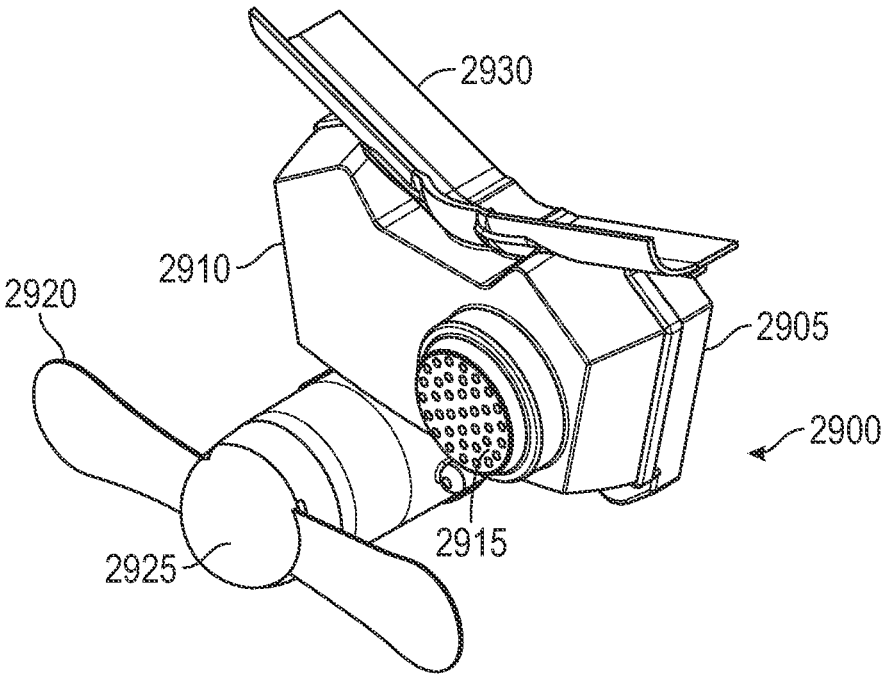
FIG. 29A shows a rear perspective view of a fan attachment of present embodiments.
Figure 29B:
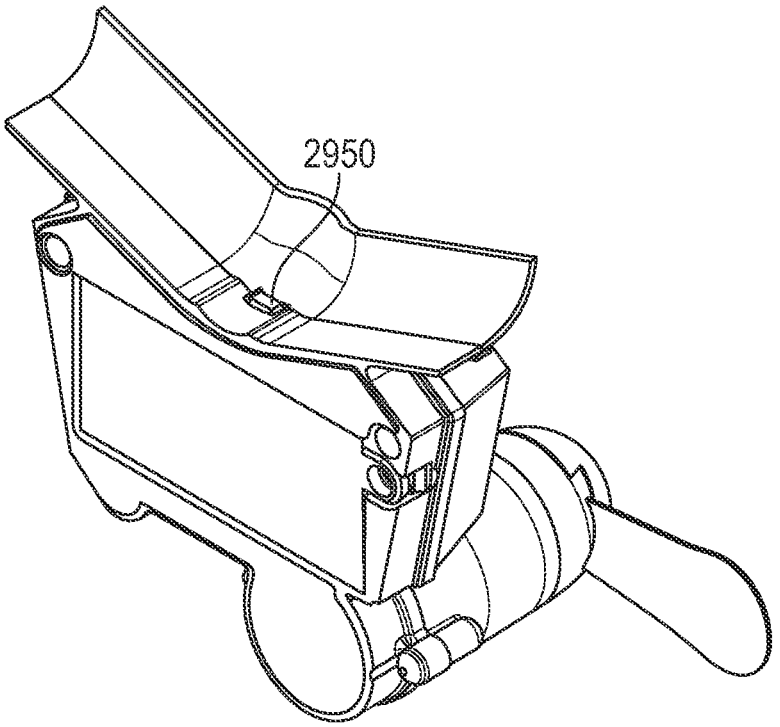
FIG. 29B shows a forward perspective view of a fan attachment of present embodiments.
Figure 29C:
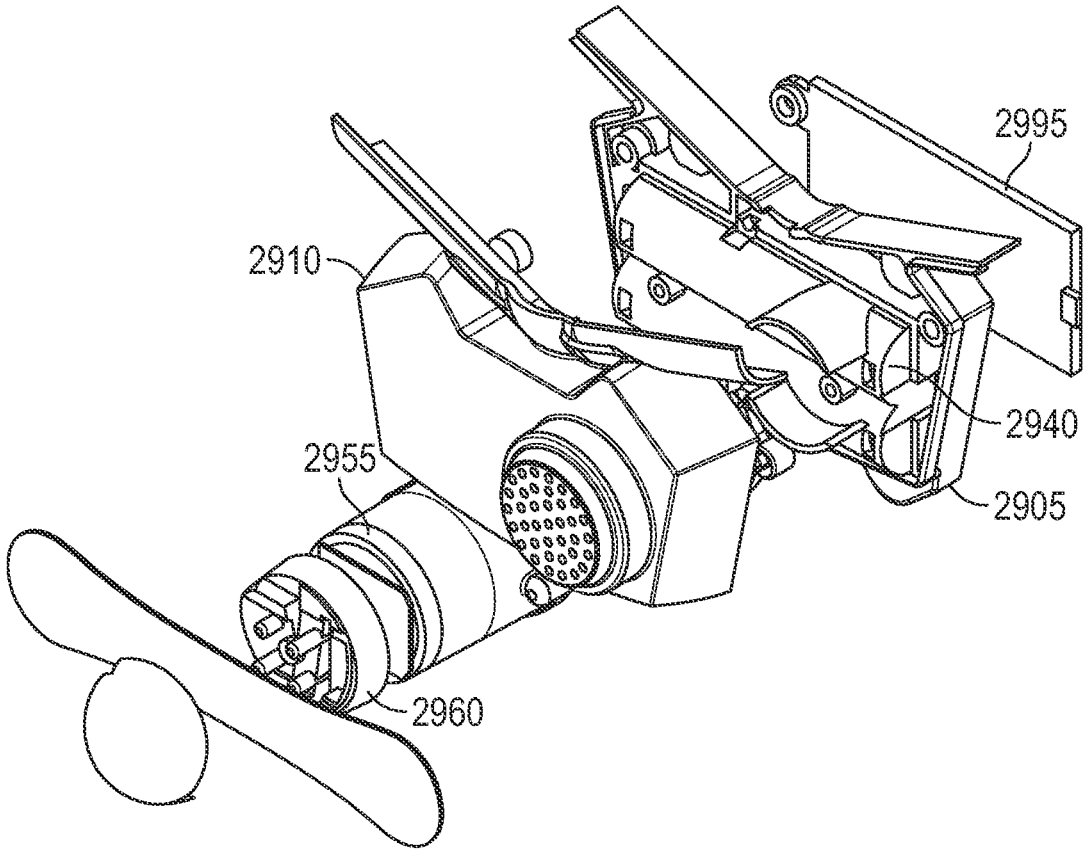
FIG. 29C shows an exploded view of a fan attachment of present embodiments.

FIG. 29A shows a rear perspective view of a fan attachment 2900 of present embodiments. Shown is the rear casing 2905, front casing 2910, speaker 2915, fan blades 2920, front fan support 2925, and V shaped marble funnel 2930. FIG. 29B shows a forward perspective view of a fan attachment of present embodiments which also shows a microswitch 2950 that can be pressed by a marble to trigger the fan and speaker. FIG. 29C shows an exploded view of a fan attachment of present embodiments. Shown is the fan motor 2955, rear fan support 2960, battery cover 2995, rear casing 2905, front casing 2910, and batteries 2940. The fan attachment 2900 may rotate the fan, which may further comprise lights and light up, and play a sound as a marble falls into the V shaped marble funnel 2930 and hits the microswitch 2950, adding exciting visual and auditory elements to the system.

Figure 30A:
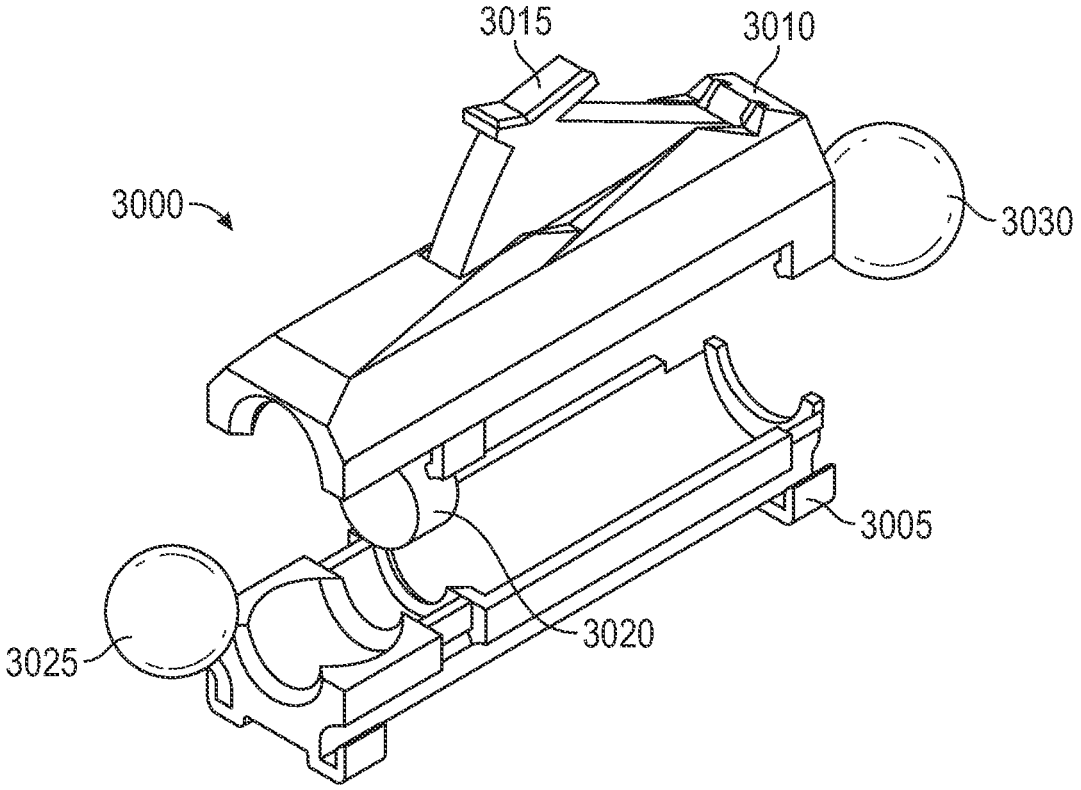
FIG. 30A shows an exploded view of a canon attachment of present embodiments.
Figure 30B:
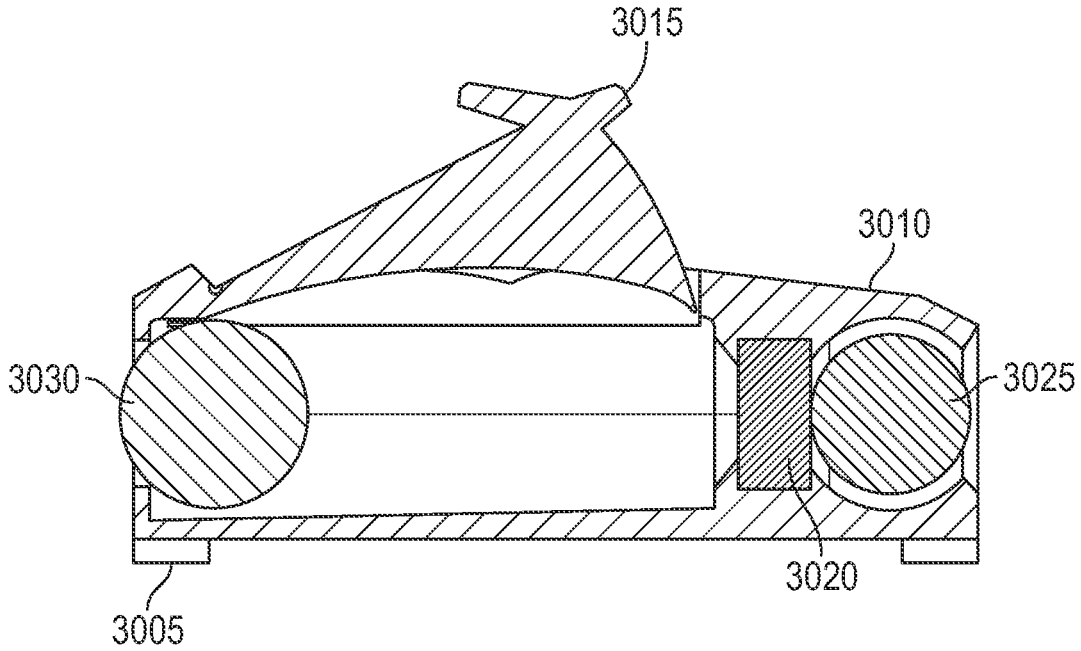
FIG. 30B shows a side cross sectional view of a canon attachment of present embodiments.

FIG. 30A shows an exploded view of a canon attachment 3000 of present embodiments. Shown is the lower housing 3005, upper housing 3010, reloading lever 3015, a high strength magnet 3020, and stationary marble 3025 and large diameter internal ferromagnetic marble 3030 which are permanently affixed in the housing 3005/3010. FIG. 30B shows a side cross sectional view of a canon attachment of present embodiments. Shown is the lower housing 3005, upper housing 3010, reloading lever 3015, a high strength magnet 3020, stationary marble 3025, and large diameter internal marble 3030 which is permanently affixed in the housing 3005/3010. The stationary marble 3025 and large diameter internal ferromagnetic marble 3030 can alternatively be described as a stationary sphere and ferromagnetic sphere fixed in the housing.

The canon attachment 3000 may serve to launch a marble 3025 which is in contact with the stationary marble 3025 in front of the housing, upon contact from another marble at the rear of the housing. As a marble proceeds along a track and contacts the large diameter internal ferromagnetic marble 3030, the ferromagnetic marble 3030 will move very quickly from the rear of the housing and through the shaft in the center of the housing, being attracted to the high strength magnet 3020, striking the high strength magnet 3020, and transferring the inertia to the magnet which is in contact with the stationary marble 3025 positioned in the spherical recess in the front of the housing, which then receives the transferred inertia from the magnet. The stationary marble 3025 will then transfer its inertia to a waiting glass marble positioned in front of the housing. The position of the large diameter internal ferromagnetic marble 3030 can then be reset by pressing the reloading lever 3015 downward, which will push the large diameter internal ferromagnetic marble 3030 back into its starting position as it moves along the long ½ ovoid arc defined by the lower surface of the reloading lever 3015. The housing 3005/3010 may be composed of nylon as to allow the hinge of the reloading lever 3015 to hold the stress for many usages, and to accommodate for the shear stress placed upon the material during launching of the marble by the high strength magnet 3020.

The large diameter internal ferromagnetic marble 3030 may have an attractive ferromagnetic force between itself and the high strength magnet 3020 which causes it to move quickly towards the magnet 3020, and transfer its momentum to magnet 3020 when it strikes it, which then transfers the momentum to the stationary marble 3025 in contact with the magnet 3020. The stationary marble 3025 is positioned in the spherical recess in the front of the housing, and will transfer the momentum to yet another marble which is outside of the housing and in contact with the front end of the stationary marble 3025. The diameter of the opening of the spherical recess in the front of the housing may be smaller than the diameter of standard sized marbles used in the system, and smaller than the diameter of the stationary marble 3025 as to keep it in place. The inner surface of the housing and shaft may be smooth as to generate minimal friction with the marble surface.

Figure 31A:
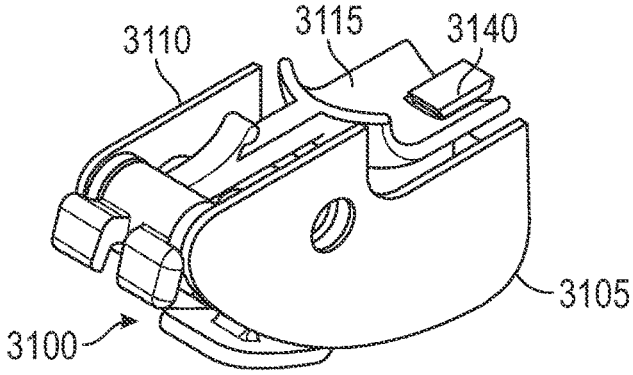
FIG. 31A shows a perspective view of a catapult attachment of present embodiments.
Figure 31B:
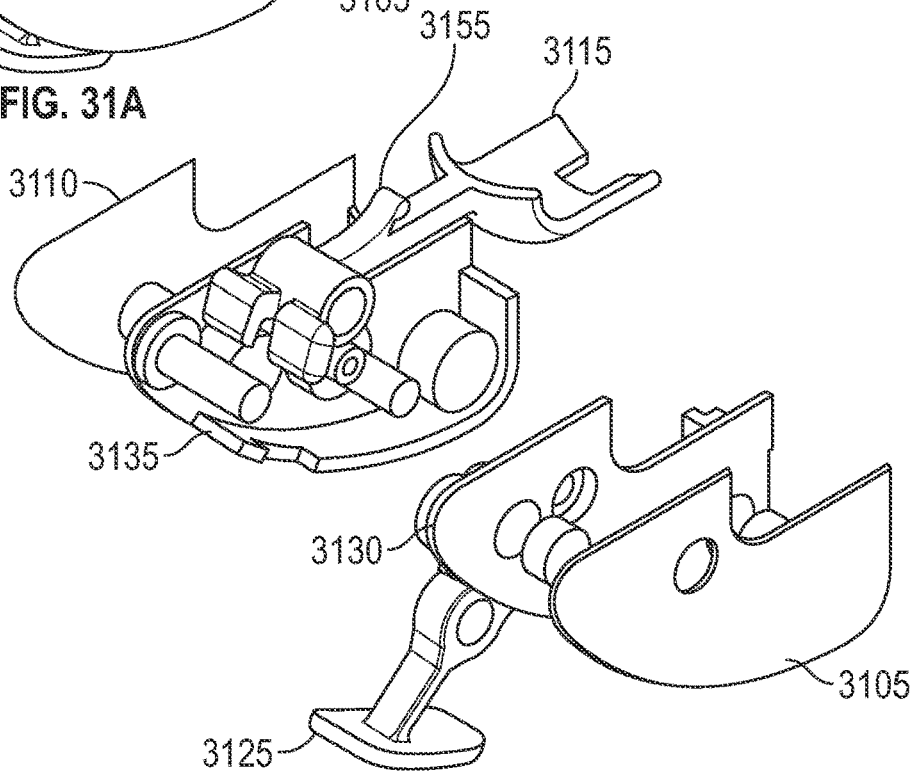
FIG. 31B shows an exploded view of a catapult attachment of present embodiments.
Figure 31C:
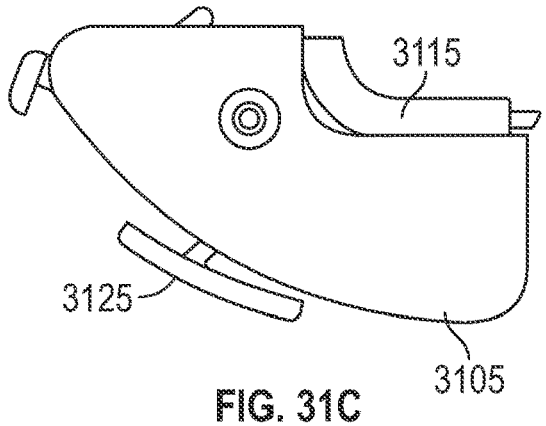
FIG. 31C shows a front view of a catapult attachment of present embodiments.
Figure 31D:
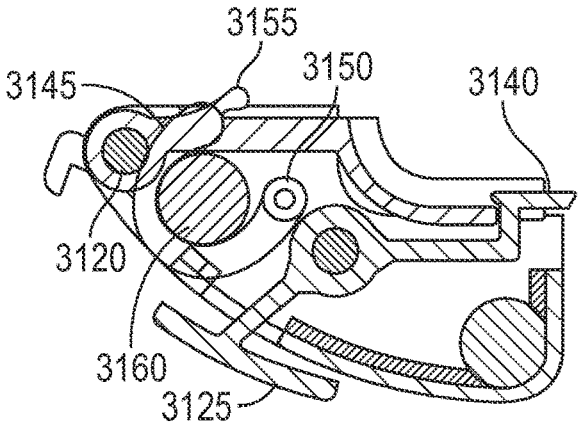
FIG. 31D shows a cross sectional view of a catapult attachment of present embodiments.

FIG. 31A shows a perspective view of a catapult attachment 3100 of present embodiments. Shown is the right rubber cover 3105, left rubber cover 3110, catapult palm 3115, and catapult trigger 3140. FIG. 31B shows an exploded view of a catapult attachment of present embodiments. Shown is the right rubber cover 3105, left rubber cover 3110, catapult palm 3115, the fulcrum 3120 about which the catapult arm pivots, catapult trigger arm 3125, right side housing 3130, and left side housing 3135. FIG. 31C shows a front view of a catapult attachment of present embodiments. Shown is the catapult palm 3115, right rubber cover 3105, and catapult clip 3125. FIG. 31D shows a cross sectional view of a catapult attachment of present embodiments. Shown is the rubber band 3145, first rubber band anchor point 3155, wraparound point 3160 for the rubber band, and second rubber band anchor point 3150.

The catapult attachment 3100 is designed to launch a marble which comes into contact with it into the air as a projectile to move it through the course. The catapult trigger 3140 may be attached to a catapult trigger arm 3125 which are both part of a bent member that pivots about a fulcrum point in between the trigger 3140 may be attached to a catapult trigger arm 3125. The trigger 3140 can be described as flat platform positioned coextensive with the horizontal surface of the catapult palm 3115, which is connected to the bent body be a support arm that bends at 90 degrees, before attaching to the fulcrum with a hinge connector. The catapult trigger arm 3125 may then extend downward at approximately a 45-degree and terminate in a flat platform generally coextensive with the curved surface of the housing. The catapult trigger arm 3125 may serve as a counterweight and allow the trigger to more easily be depressed by the weight of a marble.

The catapult attachment 3100 may launch a marble which rolls into the catapult palm 3115, by the weight of the marble pressing the catapult trigger 3140 downward, removing it from being in contact with the catapult palm 3115, and allowing the tension stored in the rubber band 3145 to release. The rubber band may be anchored to a first rubber band anchor point 3155 attached to the base of the catapult arm, may bend 180 degrees around a wraparound point 3160, before attaching to a second rubber band anchor point 3150. The rubber band should be short enough that pulling the catapult palm back to the seated position 3115 will place the rubber band under tension. The tension is held in place by the trigger 3140 which passes through a slot in the catapult palm 3115 to contact a narrow vertical surface of the catapult palm 3115, and hold it in place. Once the trigger 3140 is depressed such that it is no longer contacting the narrow vertical surface of the catapult palm 3115, the tension in the rubber band will be released, pulling the catapult arm around the fulcrum point by the first rubber band anchor point 3155. The catapult attachment 3100 may be reset by pressing it back into a neutral position.

Figure 32A:
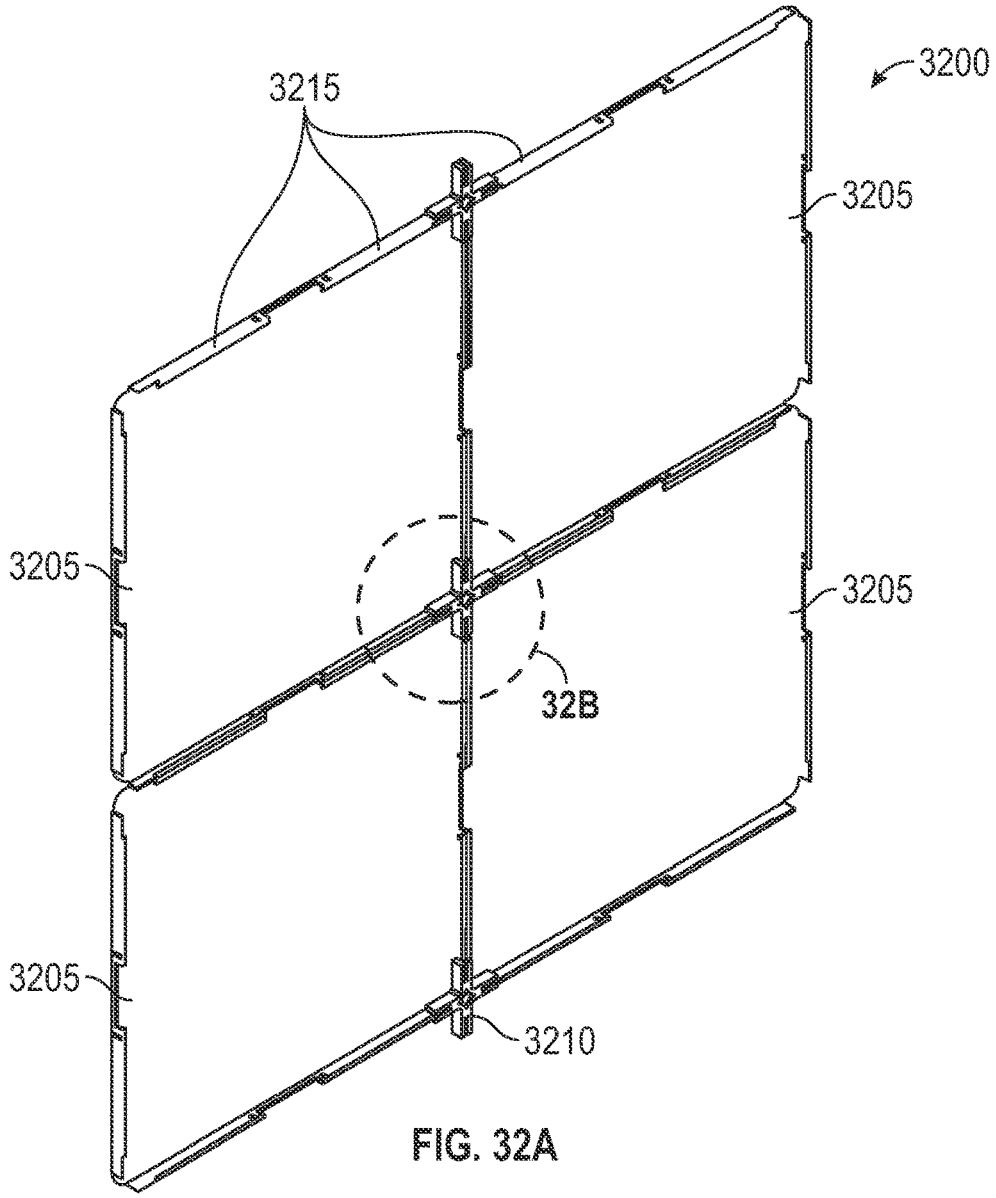
FIG. 32A shows a rear perspective view of a compact ferromagnetic wall assembly of present embodiments.
Figure 32B:
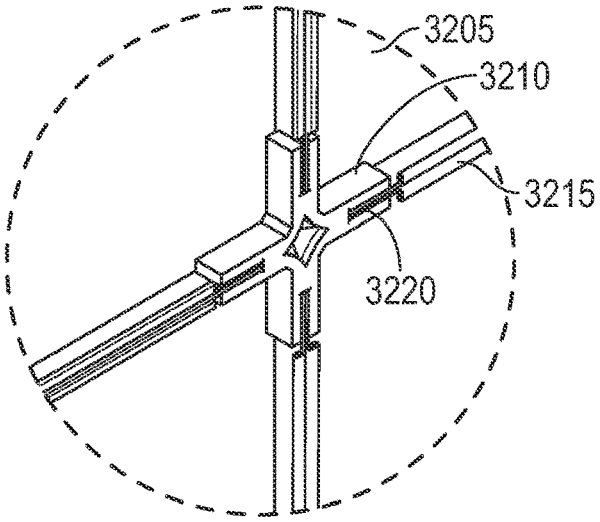
FIG. 32B shows a rear close-up of view of the attachment points of the compact ferromagnetic wall assembly of present embodiments.

FIG. 32A shows a rear perspective view of a compact ferromagnetic wall assembly 3200 of present embodiments. Shown are the ferromagnetic plates 3205, connecting cross spacers 3210, and rear ridges 3215 which extend orthogonally from the back surface of the plates. The rear ridges 3215 may also comprise a second orthogonal surface that extends inward towards the center of the ferromagnetic plate from the first orthogonal surface of the ridges, and which is only present in the center portion of the ridges. FIG. 32B shows a rear close-up of view of the attachment points of the compact ferromagnetic wall assembly of present embodiments. Shown are the ferromagnetic plates 3205, rear ridges 3215, as well as a connecting spacer 3210, and the receiving channels 3220 in the connecting spacer for receiving the ends of the rear ridges 3215 which lack a second orthogonal surface.

Figure 32C:
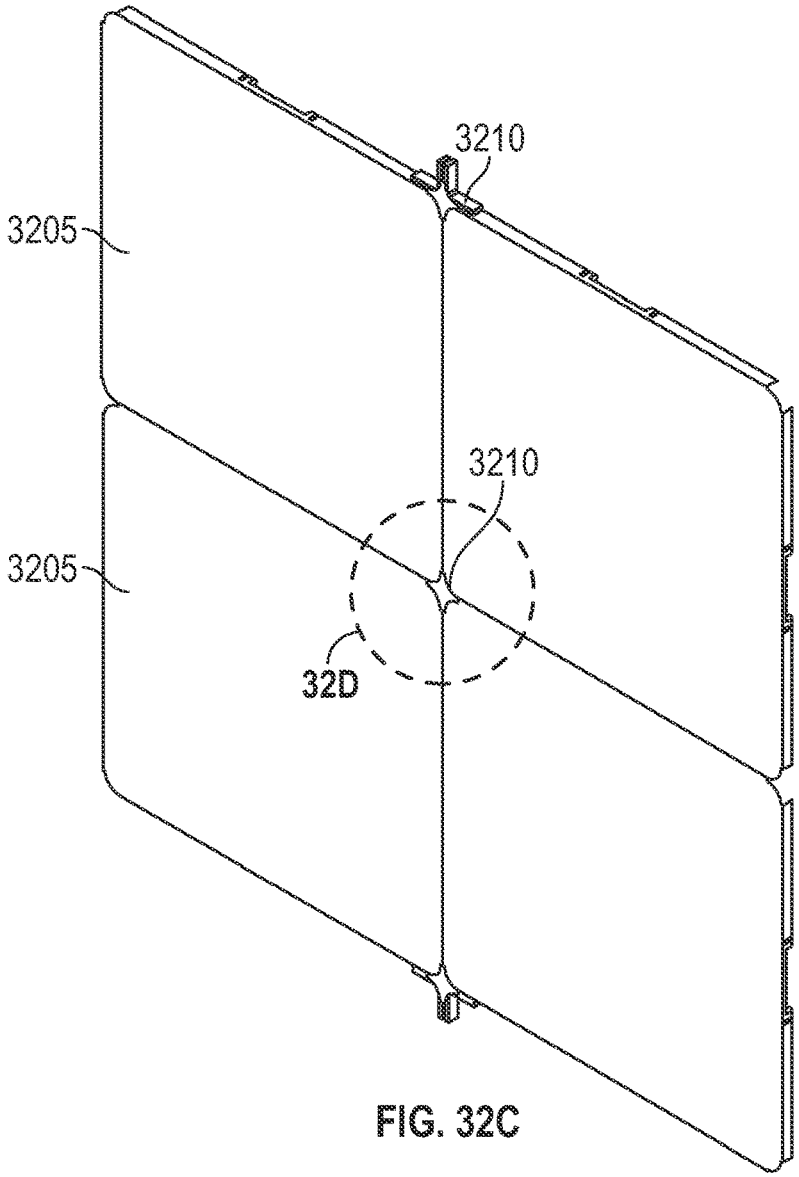
FIG. 32C shows a front perspective view of a compact ferromagnetic wall assembly of present embodiments.
Figure 32D:
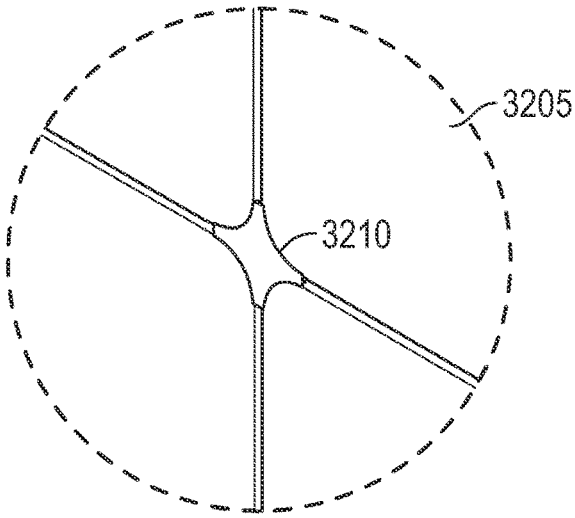
FIG. 32D shows a front close-up of view of the attachment points of the compact ferromagnetic wall assembly of present embodiments.
Figure 32E:
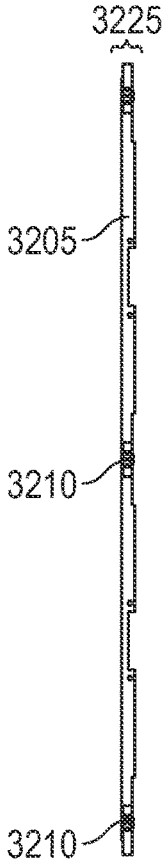
FIG. 32E shows a side view of a compact ferromagnetic wall assembly of present embodiments.

FIG. 32C shows a front perspective view of a compact ferromagnetic wall assembly of present embodiments. Shown is the smooth, flat, front surface of the ferromagnetic plates 3205, and connecting cross spacers 3210. FIG. 32D shows a front close-up of view of the attachment points of the compact ferromagnetic wall assembly of present embodiments. Shown is the rounded cross shape formed by the front surface of the cross spacers 3210 where it contacts the front surface of the ferromagnetic plates 3205. FIG. 32E shows a side view of a compact ferromagnetic wall assembly of present embodiments. Shown are the ferromagnetic plates 3205, connecting cross spacers 3210, and the low vertical profile 3225 of the ferromagnetic plates.

Figure 33A:
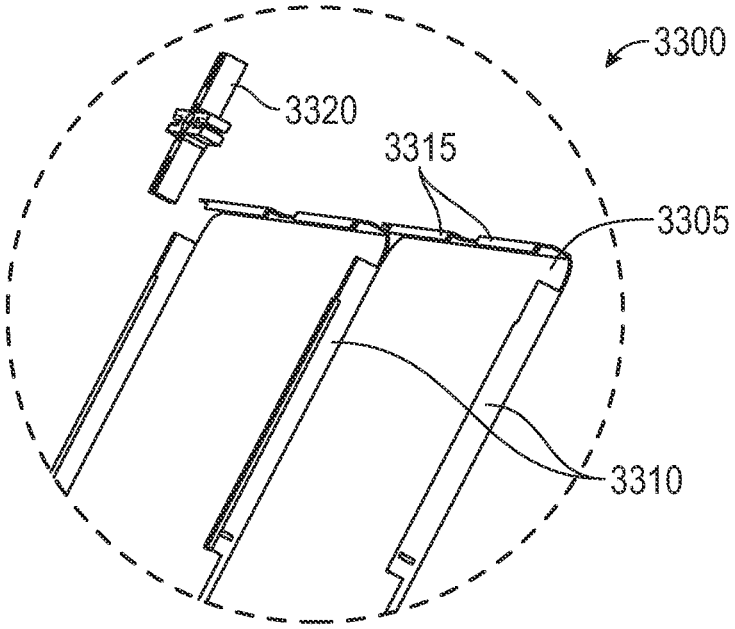
FIG. 33A shows a close-up perspective view of a ferromagnetic wall assembly of present embodiments.
Figure 33B:
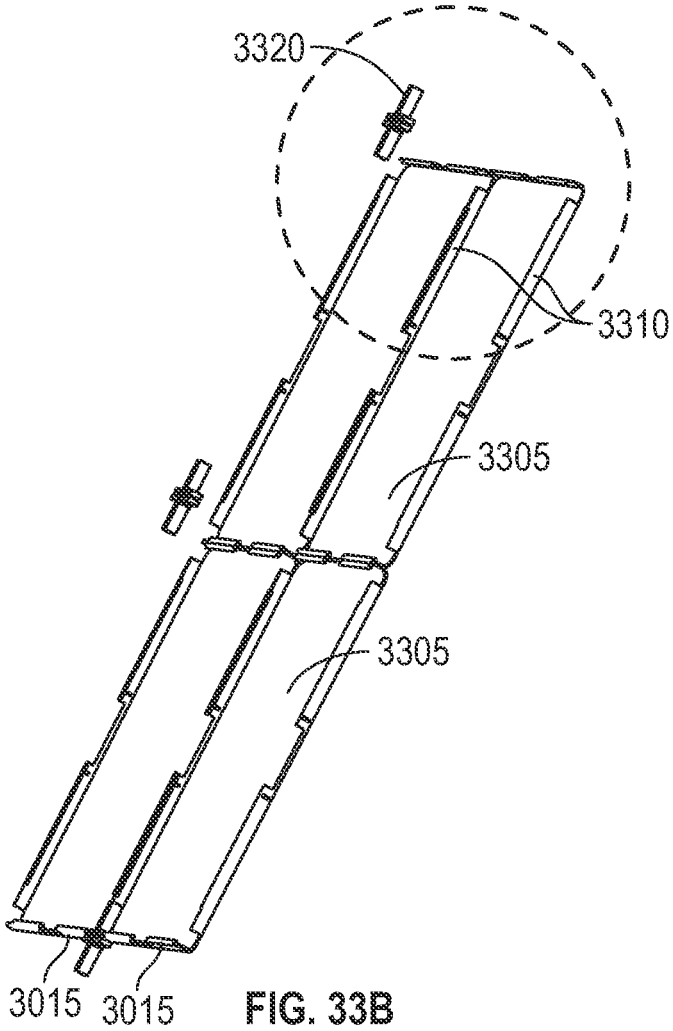
FIG. 33B shows a perspective view of a ferromagnetic wall assembly of present embodiments.
Figure 33C:
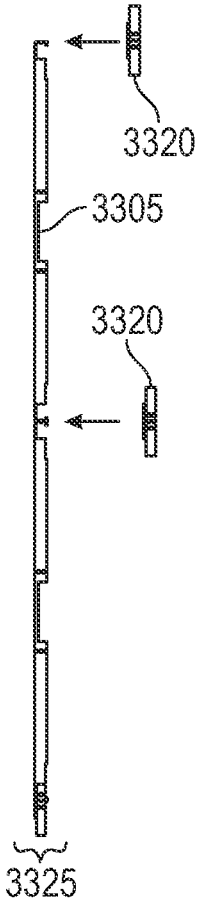
FIG. 33C shows a side view of a ferromagnetic wall assembly of present embodiments.

FIG. 33A shows a close-up perspective view of an alternative ferromagnetic wall assembly 3300 of present embodiments. FIG. 33B shows a perspective view of a ferromagnetic wall assembly of present embodiments. FIG. 33C shows a side view of a ferromagnetic wall assembly of present embodiments, showing its low vertical profile 3325. Shown are the ferromagnetic plates 3305, elongated cross spacers 3320, and the side ridges 3310 and vertical ridges 3315 which extend orthogonally from the back surface of the plates.

Figure 34A:
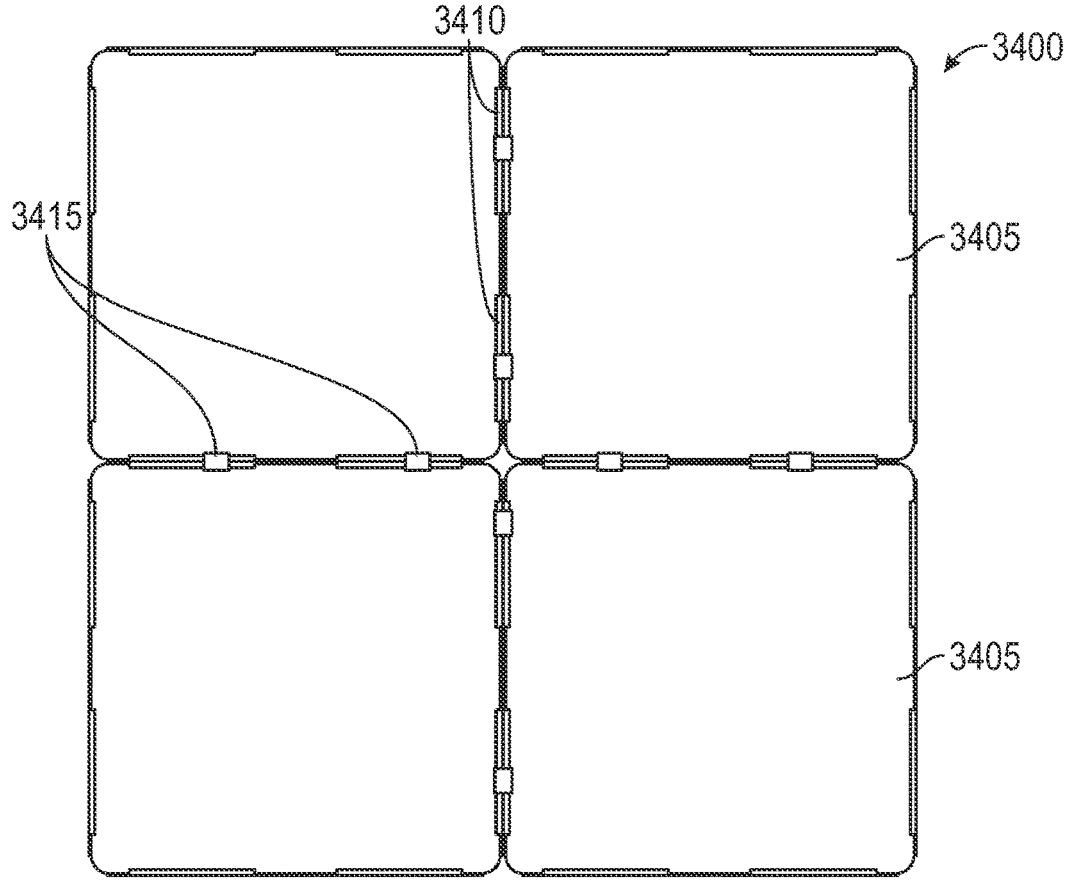
FIG. 34A shows a rear view of a ferromagnetic wall assembly of present embodiments.
Figure 34B:
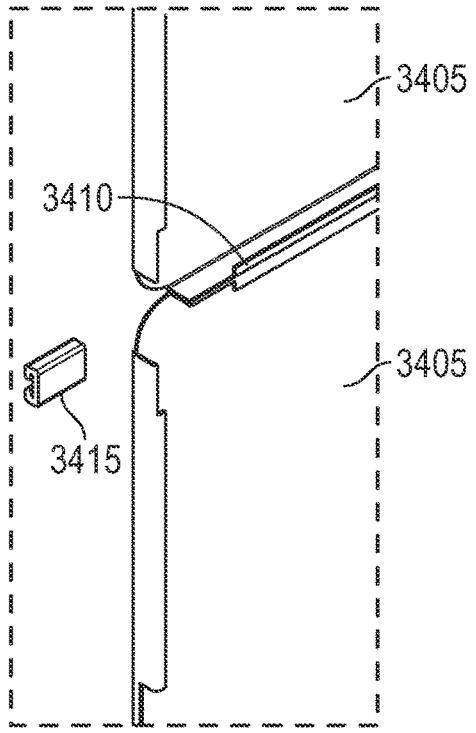
FIG. 34B shows a close-up perspective view of a ferromagnetic wall assembly of present embodiments.
Figure 34C:
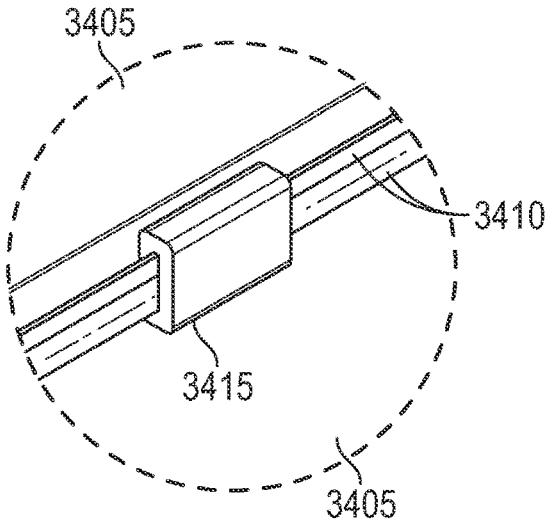
FIG. 34C shows a close-up perspective view of the attachment points of a ferromagnetic wall assembly of present embodiments.

FIG. 34A shows a rear view of another alternative ferromagnetic wall assembly 3400 of present embodiments. FIG. 34B shows a close-up perspective view of a ferromagnetic wall assembly of present embodiments. FIG. 34C shows a close-up perspective view of the attachment points of a ferromagnetic wall assembly of present embodiments. Shown are the ferromagnetic plates 3405, C clip 3415, and symmetrical rear ridges 3410 which extend orthogonally from the back surface of the plates. This ferromagnetic wall assembly 3400 may differ from other ferromagnetic wall assemblies 3300/3200 in that it uses C clips 3415 to connect the ferromagnetic plates instead of cross spacers.

Figure 37A:
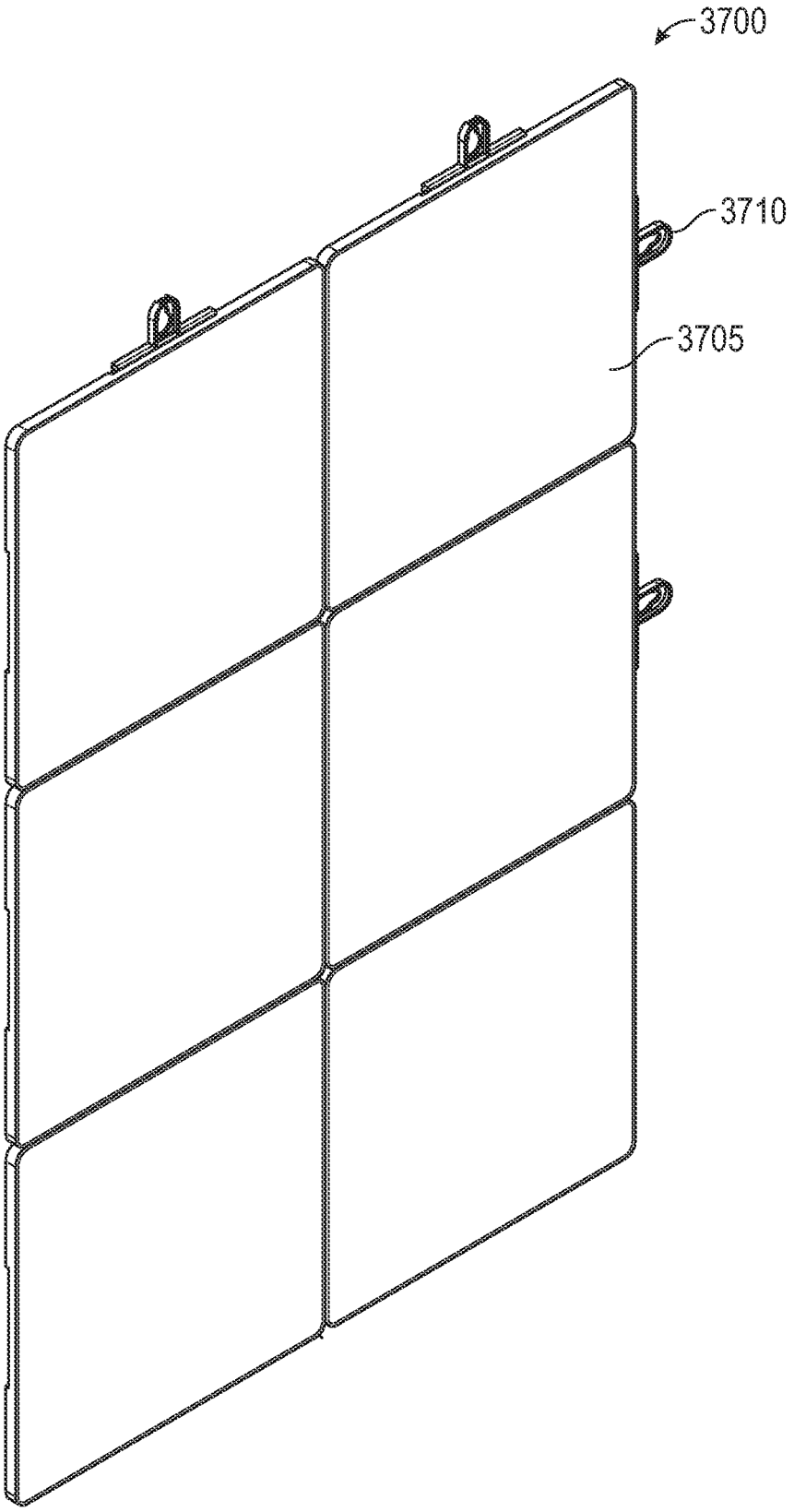
FIG. 37A shows a perspective view of an alternative ferromagnetic wall assembly of present embodiments.
Figure 37B:
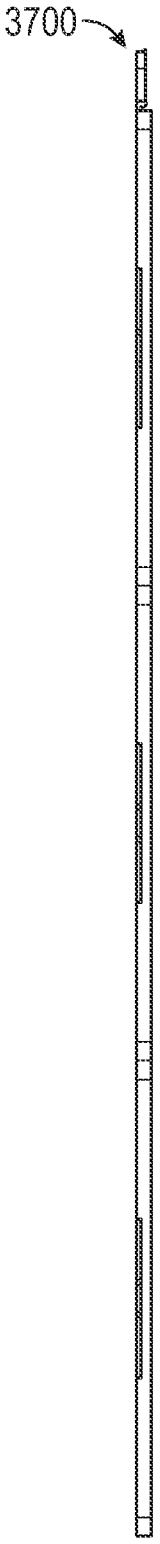
FIG. 37B shows a side view of the alternative ferromagnetic wall assembly of present embodiments.
Figures 37C, 37D:
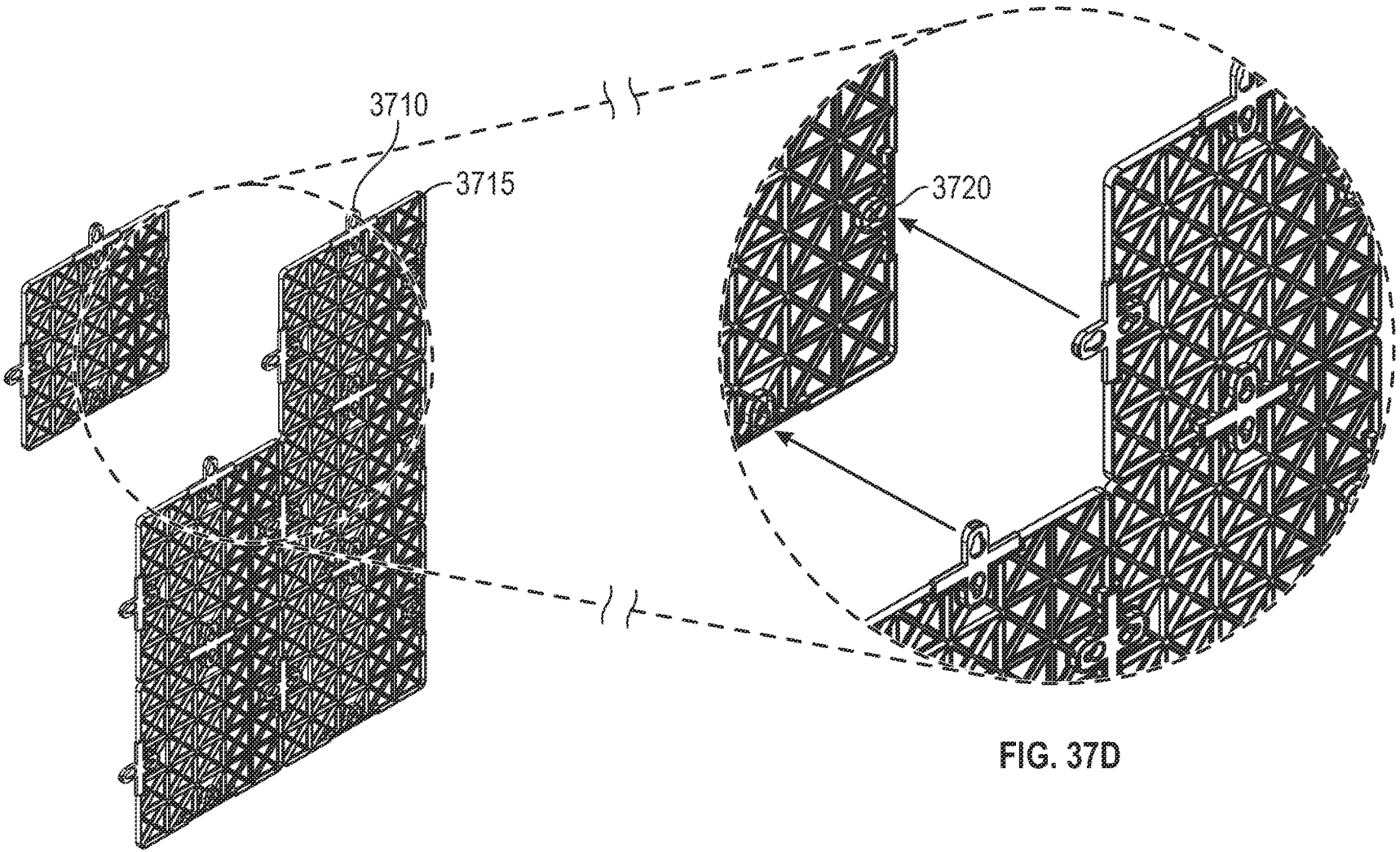
FIG. 37C shows a rear perspective view of the alternative ferromagnetic wall assembly of present embodiments.
FIG. 37D shows a close-up rear perspective view of the alternative ferromagnetic wall assembly of present embodiments.

FIG. 37A shows a perspective view of an alternative ferromagnetic wall assembly 3700 of present embodiments. Shown is a plurality of thin ferromagnetic plates 3705, and secondary connecting cross spacers 3710. FIG. 37B shows a side view of the alternative ferromagnetic wall assembly 3700. Shown in this view is its low vertical profile. FIG. 37C shows a rear perspective view of the alternative ferromagnetic wall assembly 3700, which includes a plurality of plastic frames 3715 on the back side, each plastic frame 3715 comprising a grid of cross members spanning the center of the frames, connecting the perimeter. FIG. 37D shows the connecting keys 3720 in the plastic frames which connect to the connecting keyholes 3725 in the secondary connecting cross spacers 3710.

Each plastic frame 3715 may be configured to attach to a thin ferromagnetic plate 3705, and hold it in place on the front side of the plastic frame, possibly with clips that hold the edges of the plate. The secondary connecting cross spacers 3710 may be in the general shape of a cross, have a vertical support member, and two ovoid members which extend for the center of the vertical support member. There may be connecting keyholes 3725 on each ovoid member. The connecting keys 3720 in the plastic frames and connecting keyholes 3725 on the connecting cross spacers 3710 may be in the shape of a number 8, with one of the circles that form the 8 being smaller than the other, and fit into one another. In combination, a plurality of plastic frames 3715 and thin ferromagnetic plates 3705 can be connected together, using the connecting keyholes 3725 in the secondary connecting cross spacers 3710 to attach to the connecting keys 3720 in the plastic frames, forming the alternative ferromagnetic wall assembly 3700. The ferromagnetic plates 3705 may very thin, in between 0.005 mm and 0.1 mm, and in a particular embodiment, 0.02 mm thick. The ferromagnetic wall assembly 3700 can be broken down into individual squares by detaching the connecting cross spacers, for easy travel and storage. The use of plastic frames and thin ferromagnetic plates may reduce manufacturing costs relative to other ferromagnetic wall assemblies of present embodiments.

Figure 38A:
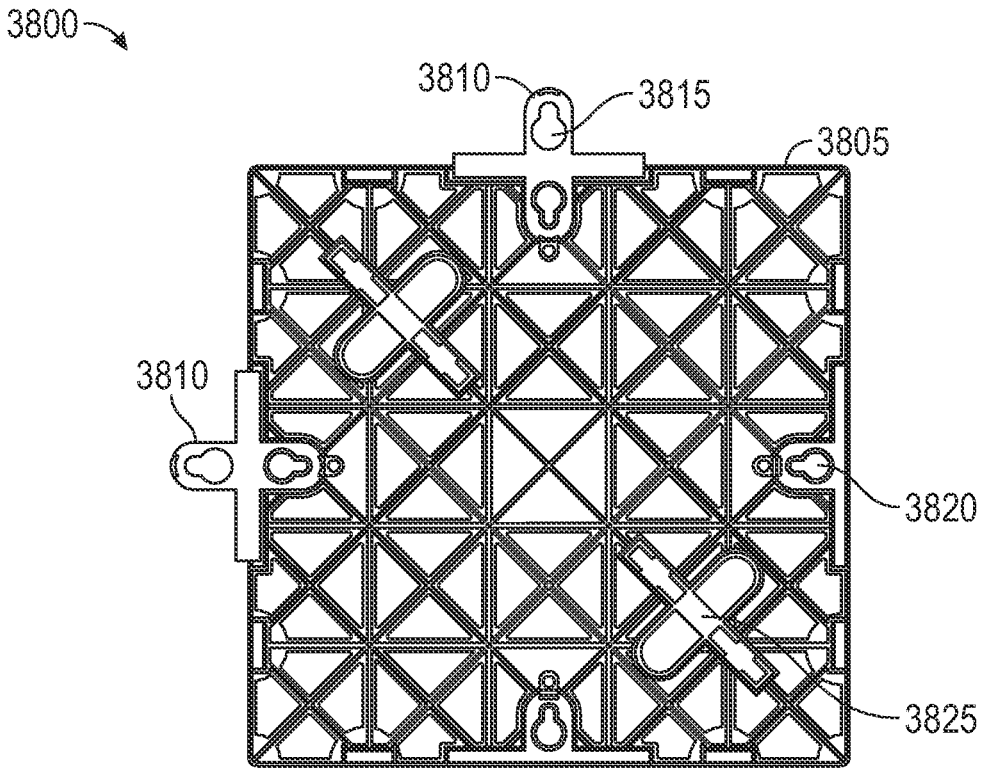
FIG. 38A shows a rear view of yet another alternative ferromagnetic wall assembly of present embodiments in assembly mode.
Figure 38B:
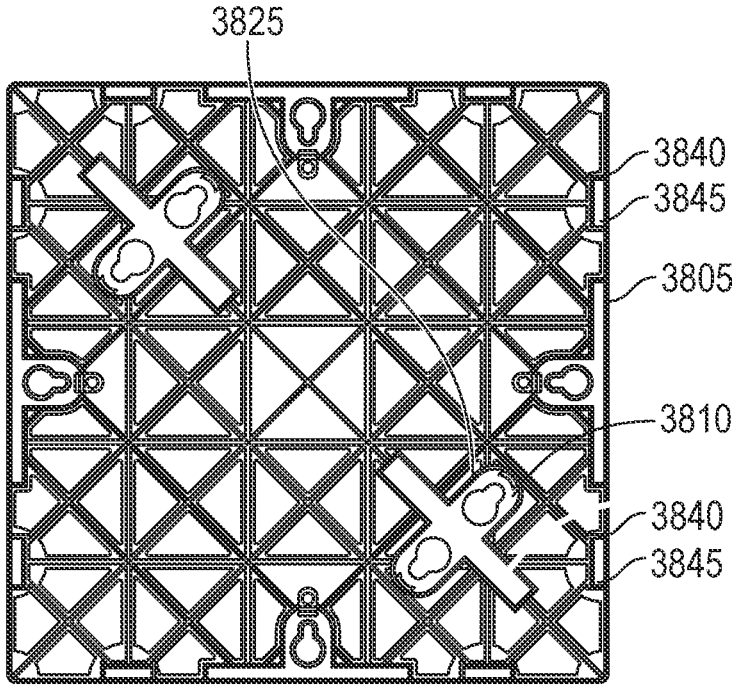
FIG. 38B shows a rear view of yet another alternative ferromagnetic wall assembly of present embodiments in pack mode.
Figure 38C:
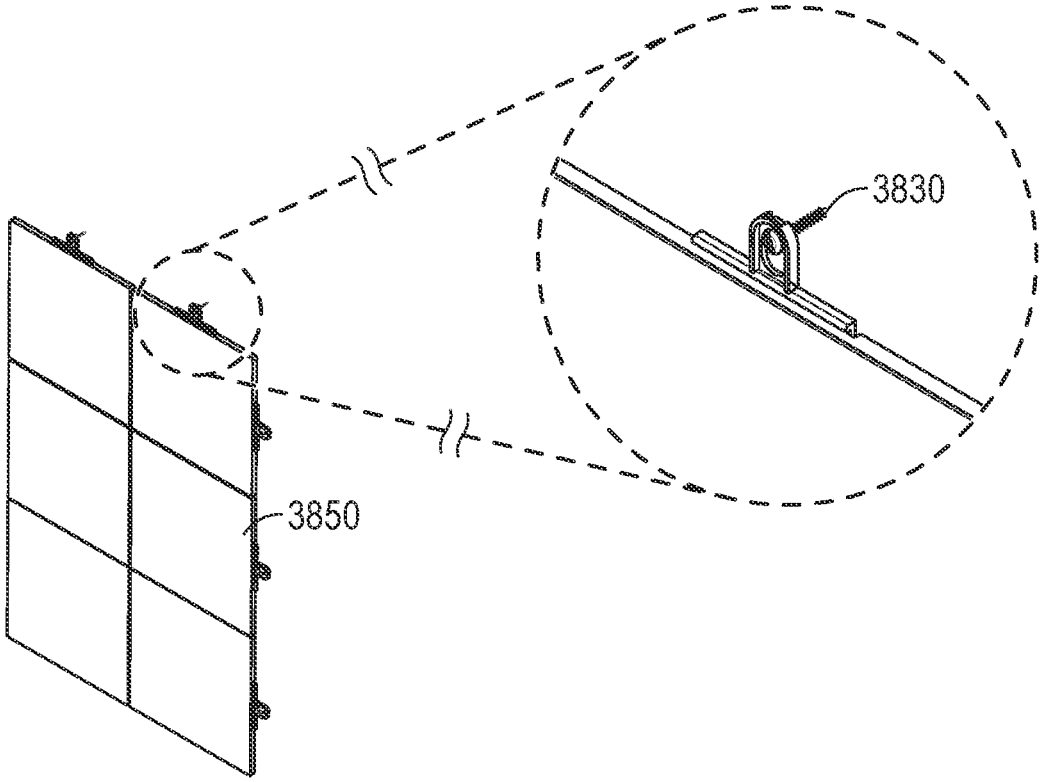
FIG. 38C shows a close-up perspective view of yet another alternative ferromagnetic wall assembly of present embodiments with a screw support.
Figure 38D:
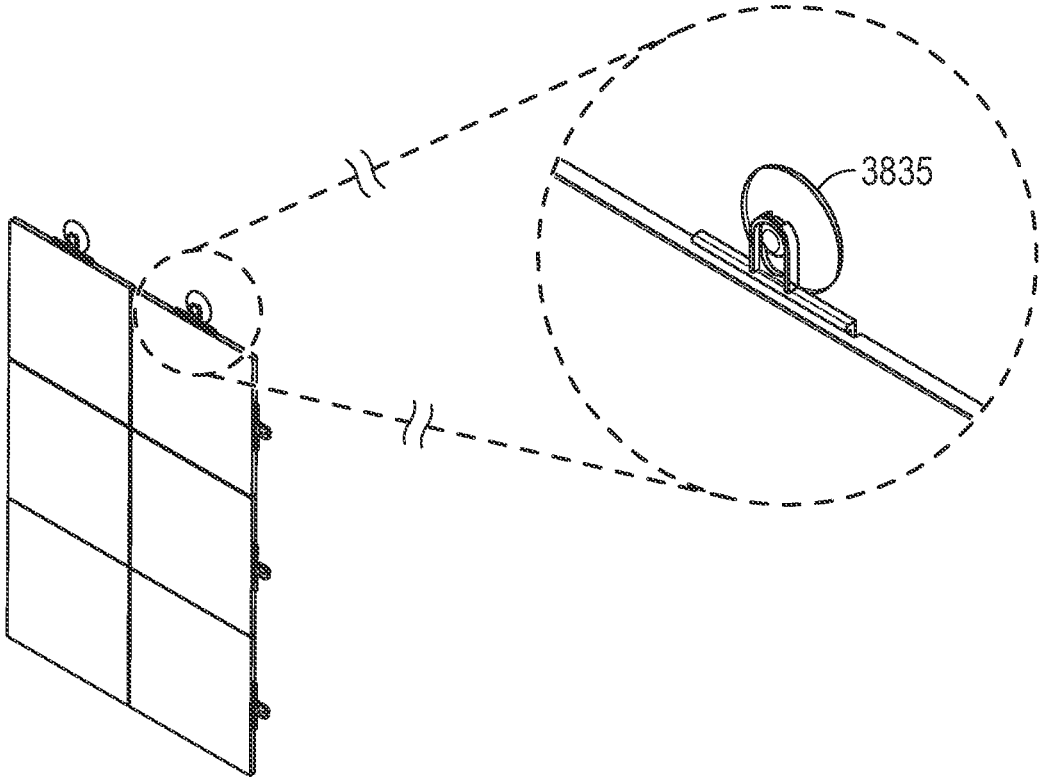
FIG. 38D shows a close-up perspective view of yet another alternative ferromagnetic wall assembly of present embodiments with a suction cup support.

FIG. 38A shows a rear view of yet another alternative ferromagnetic wall assembly 3800 of present embodiments in assembly mode. FIG. 38B shows a rear view of the additional alternative ferromagnetic wall assembly of present embodiments in pack mode. FIG. 38C shows a close-up perspective view of the additional ferromagnetic wall assembly of present embodiments with a screw support. FIG. 38D shows a close-up perspective view of the additional ferromagnetic wall assembly of present embodiments with a suction cup support. Shown in these views is the plastic frame 3805 which supports the thin ferromagnetic plate 3850, connecting cross spacers 3810 which comprise keyholes 3815, connecting keys 3820 in the plastic frame, and mounting slots 3825 which hold the connecting cross spacers 3810 when they are not in use. Also shown is a screw 3830 and suction cup 3835 which fits through the keyholes 3815 of the connecting cross spacers 3810 in order to support the alternative ferromagnetic wall assembly 3800. The keyholes 3815 of the connecting cross spacers 3810 may be an appropriate size to firm a tight fit with the base of a suction cup used in the system, popping or snapping into place. The thin ferromagnetic plate 3850 may be attached to the plastic frame with glue or adhesive, and may comprise a plurality or ridges 3845 which extend orthogonally from sections of the perimeter of the plate. The ridges may insert into receiving channels 3840 which are positioned along the perimeter of the plastic frame 3805, and may be folded over onto the plastic frame in order to better secure the ferromagnetic plate 3850 to the plastic frame 3805.

The ferromagnetic plates in the ferromagnetic wall assemblies may be composed of any ferromagnetic material, and may be constructed from steel, galvanized steel, or tin plate. Each of the ferromagnetic wall assemblies may be configured to fit within a fabric or carbon case. The material which composes the case may be flexible, as to permit the case to be folded. The case may comprise individual compartments for housing each ferromagnetic plate such that they don't need to be tethered together with cross spacers or clamps. The case may comprise attachment points or loops at the top of the case such that it can be tethered to a non-magnetic surface, possibly with suction cups, Velcro, or other fastening means know within the art. The case may further comprise a pocket at the bottom of the case which may serve to catch marbles as they run through the system and fall off the final track. It may further comprise additional pockets in the case for storing various components of the system.

Figure 35:
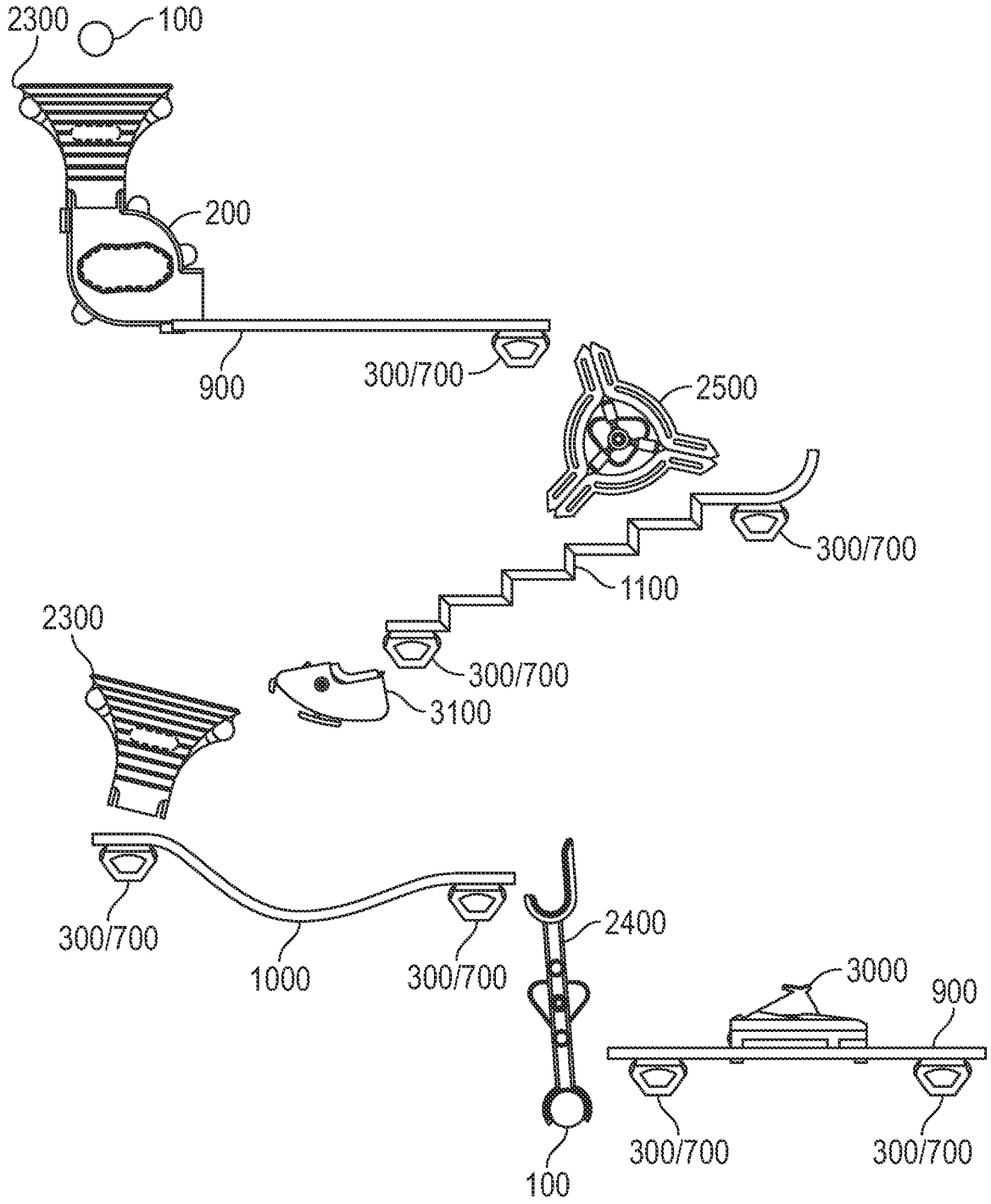
FIG. 35 shows a front view of a possible course which may be constructed using the system and components of present embodiments.

FIG. 35 shows a front view of a possible course which may be constructed using the system and components of present embodiments. Shown is a funnel attachment 2300 positioned above a starter attachment 200, with a marble 100 ready to be placed into the funnel. At the lower marble hole of the starter attachment 200 is attached a straight rail attachment 900 connected to a connector 300/700. Positioned at the end of the rail and just below the rail is a spinner attachment 2500, which will direct the marble towards the made edge attachment 1300, which is connected to the stair track 1100, which is supported by a connector 300/700 on each side.

Positioned at the end of the stair track is a catapult attachment 3100, which will launch the marble as it hits the catapult trigger, into a second funnel attachment 2300. The funnel is positioned above a curved track 1000, which is supported by a connector 300/700 on each side. At the end of the curved track there is a pole attachment 2400 attached to a hinge connector 400/800, which will move the marble across a fixed path and onto the straight track 900 which follows the pole attachment 2400. The pole attachment is shown mounted about its center hinge connector with a marble 100 in the marble clam. The straight track 900 following the pole attachment is positioned atop two connectors 300/700, one on each side. Positioned in the center of the straight track 900 is a cannon attachment 3000, which will launch a marble loaded into the cannon upon being contacted by a marble moving through the system.

Figure 36:
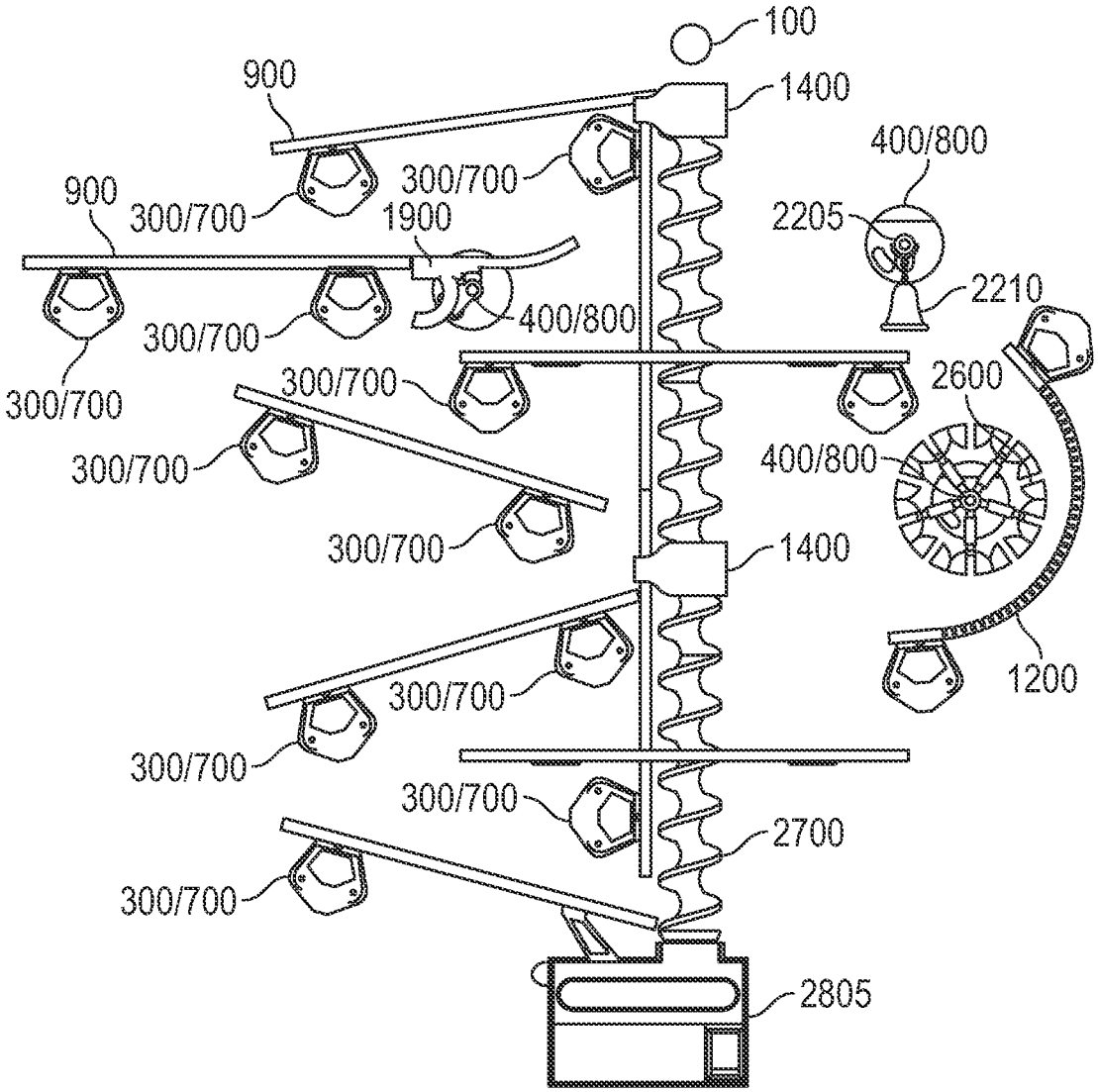
FIG. 36 shows a front view of another possible course which may be constructed using the system and components of present embodiments.

FIG. 36 shows a front view of another possible course which may be constructed using the system and components of present embodiments. Shown is a marble 100 positioned next to a straight track 900, which is supported by a connector 300/700 on one side, and a clip attachment 1400 on the other side. After falling off the straight track, the marble will fall down onto another straight track 900 being supported by two connectors 300/700, one on each side. Following the straight track is a fork attachment 1900 attached to the wall with a suction cup hinge connector 500. As a first marble rolls over the fork attachment 1900 to the right, it will cause the fork attachment 1900 to rotate to the right, exposing the semicircular marble catch. As a second marble rolls through the course, it will get caught in the semicircular marble catch, and roll to the left, rotating the fork attachment 1900 leftwards back to its original starting position. The second marble will then pass along the series of declining straight rails until it reaches the lower most rail, and rolls into the spiral lift.

The first marble to pass over the fork attachment 1900 will then roll onto the next straight track 900, through the bell attachment assembly 2200, ringing the bell. It will then roll onto the secondary spinner attachment 2600, spinning it, and then falling onto the flexible track 1200, positioned between two connectors, and then onto another straight rail. It will then continue along the straight rail, until it falls on the lowermost straight rail attachment, and rolls into the spiral lift 2700. The spiral lift 2700 is being rotated by a rotary motor 2805, which will move the marble up the course back to its starting point. The spiral lift attachments 2700 are connected vertically, and supported by straight rails running the length of the spiral lifts, connected to the straight rails by clip attachments 1400. The straight rails running the length of the spiral lifts also serve to support the marble as the spiral lift rotates and pushes the marble upwards, keeping it from falling off the lift.

Figure 40A:
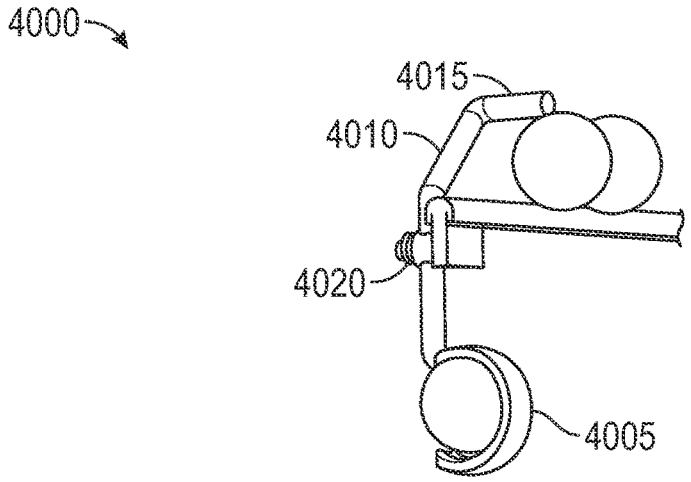
FIG. 40A shows a perspective view of an auto launcher attachment of present embodiments.
Figure 40B:
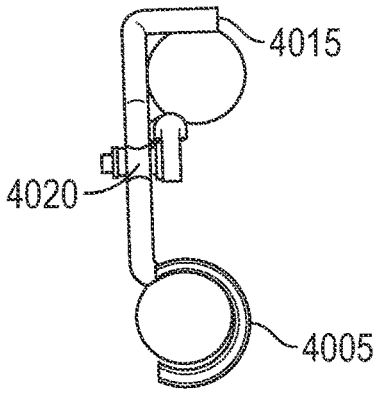
FIG. 40B shows a front view of an auto launcher attachment of present embodiments.
Figure 40C:
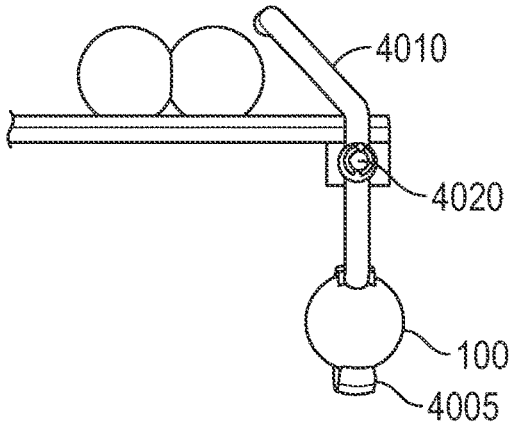
FIG. 40C shows a side view of an auto launcher attachment of present embodiments.

The system may further comprise an auto launcher attachment. FIG. 40A shows a perspective view of an auto launcher attachment 4000 of present embodiments. FIG. 40B shows a front view of an auto launcher attachment 4000 of present embodiments. FIG. 40C shows a side view of an auto launcher attachment 4000 of present embodiments. The auto launcher attachment may comprise an L shaped upper member 4010 with an orthogonal angle between the two arms of the L shaped member. The launcher body may comprise a hinge connection point 4020 located at the center of the auto launcher attachment. The L shaped upper member may extend away from the hinge connection point at approximately a 45-degree angle. Extending below the hinge connection point approximately at a 180-degree angle (straight) may be a hook shaped marble clamp 4005, configured to hold a marble. The auto launcher attachment may serve to automatically launch a marble which is held behind the lattermost, orthogonal arm 4015 of the L shaped member when the hook shaped marble clamp on the lower part of the attachment is displaced. As the marble clamp on the lower part of the attachment is displaced, the auto launcher will pivot about the hinge, and raise the lattermost, orthogonal arm of the L shaped member, releasing the marble held behind it, launching the marble automatically. The auto launcher attachment may be triggered by a number of different mechanisms, including the pole attachment, which may strike the lower part of the attachment as rotates about its hinge back and forth.

The various components of the system may be composed of plastics, polymers, nylon, PA66, steel, galvanized steel, tin, and other suitable materials known within the art. The product may be manufactured by casting, injection molding, 3D printing, or any other method of manufacturing suitable for the chosen material.

One of ordinary skill in the art will recognize the inventive principles disclosed are not limited to the embodiments disclosed herein, and that various aspects of the disclosed embodiments can be combined to achieve additional embodiments. The applications of the present invention have been described largely by reference to specific examples and in terms of particular allocations of functionality to certain components. However, those of skill in the art will recognize that the invention can also be produced by components that distribute the functions of embodiments of this invention differently than herein described. Such variations and implementations are understood to be captured according to the following claims and within this disclosure.

What is claimed is:

1. A system comprising:

a plurality of stationary connectors, each stationary connector comprising a body, a fastener capable of attaching it to a vertical surface, and a universal male connector configured to connect to a universal female connector;

a plurality of linear tracks, each linear track comprising a rounded upper surface and a universal female connector configured to connect to a universal male connector;

a plurality of non-linear tracks, the non-linear tracks comprising a rounded upper surface, and a universal female connector configured to connect to the universal male connector, a plurality of stair shaped tracks, each stair shaped track comprising a rounded upper surface, a star shaped track universal female connector configured to connect to a universal male connector, a plurality of generally horizontal surfaces, a plurality of vertical surfaces positioned in between and orthogonal to the horizontal surfaces;

a plurality of flexible tracks, each flexible track comprising a segmented body, a rounded upper edge along the segmented body, and a universal female connector configured to connect to a universal male connector, the flexible tracks being configured to bend in at least one direction; and a plurality of edge tracks, each edge track comprising a rounded upper surface, a curved path defined by the body, and a universal female connector configured to connect to a universal male connector wherein the stationary connector is configured to support the linear tracks and non-linear tracks by connecting to the stationary connector's universal male connector to the universal female connector of the linear tracks and the non-linear tracks, wherein each linear track and non-linear track is comprised of only a single rail, wherein each track contacts a marble at a point along its surface between 0 degrees and 90 degrees when mounted upon a stationary connector with the marble on the track, and wherein a marble positioned on top of a track contacts the vertical surface when the stationary connector is fastened to the vertical surface.

2. The system of claim 1 further comprising a plurality of hinge connectors, each hinge connector comprising a body, a hinge pin, and a securing edge at the end of the hinge pin.

3. The system of claim 2 further comprising a fork attachment, the fork attachment comprising a rounded upper surface, a curved lower member, and a hinge attachment point.

4. A system comprising:

a plurality of stationary connectors, each stationary connector comprising a body, a fastener capable of attaching it to a vertical surface, and a universal male connector configured to connect to a universal female connector;

a plurality of linear tracks, each linear track comprising a rounded upper surface and a universal female connector configured to connect to a universal male connector;

a plurality of non-linear tracks, the non-linear tracks comprising a rounded upper surface, and a universal female connector configured to connect to a universal male connector;

a plurality of hinge connectors, each hinge connector comprising a body, a hinge pin, and a securing edge at the end of the hinge pin;

a pole attachment comprising a body with at least one hinge attachment point, a marble clamp, and a hook shaped upper member with two sides, with one side twice as long as the other, wherein the stationary connector is configured to support the linear tracks and non-linear tracks by connecting to the stationary connector's universal male connector to the universal female connector of the linear tracks and the non-linear tracks, wherein each linear track and non-linear track is comprised of only a single rail, wherein each track contacts a marble at a point along its surface between 0 degrees and 90 degrees when mounted upon a stationary connector with the marble on the track, and wherein a marble positioned on top of a track contacts the vertical surface when the stationary connector is fastened to the vertical surface.

5. The system of claim 1 further comprising a spiral lift attachment, the spiral lift attachment comprising a spiral shaped body, an asymmetrical cross shaped male connector positioned on the top of the spiral shaped body, and an asymmetrical cross shaped female connector positioned on the bottom of the spiral shaped body.

6. The system of claim 1 further comprising a cannon attachment, the cannon attachment comprising a housing, a shaft within the housing, a magnet permanently affixed in the housing, a stationary sphere permanently affixed in the housing, and a ferromagnetic sphere permanently affixed in the housing.

7. The system of claim 1 further comprising a catapult attachment, the catapult attachment comprising a tension band, at least two anchor points configured to attach to the tension band, a fastener capable of attaching it to a vertical surface, a catapult palm with a trigger slot, and a trigger which partially extends through the trigger slot.

8. The system of claim 1 further comprising a U turn attachment, the U turn attachment comprising a two-track body, the two-track body defining a 180-degree curve, and a universal female connector configured to connect to a universal male connector.

9. The system of claim 1 further comprising a corner attachment, the corner attachment comprising a two-track body, the two-track body defining a rounded path which ends at a trajectory with a 90-degree difference relative to its initial trajectory, and a universal female connector configured to connect to a universal male connector.

10. The system of claim 1 wherein the fastener capable of attaching the stationary connectors to the vertical surface is at least one magnet inside the body.

11. The system of claim 1 wherein the fastener capable of attaching the stationary connectors to the vertical surface is a suction cup.

12. A modular marble course system comprising:

a plurality of stationary connectors, each stationary connector comprising a body, a fastener capable of attaching it to a vertical surface, and a universal male connector configured to connect to a universal female connector;

a plurality of hinge connectors, each hinge connector comprising a body, a fastener capable of attaching it to a vertical surface, a hinge pin, and a securing edge at the end of the hinge pin;

a plurality of linear tracks, each linear track comprising a rounded upper surface and a universal female connector configured to connect to a universal male connector;

a plurality of curved tracks, each curved track comprising a rounded upper surface, and a universal female connector configured to connect to a universal male connector;

plurality of stair shaped tracks, each stair shaped track comprising a rounded upper surface, a universal female connector configured to connect to a universal male connector, a plurality of generally horizontal surfaces, a plurality of vertical surfaces positioned in between and orthogonal to the horizontal surfaces; and a plurality of flexible tracks, each flexible track comprising a segmented body, a rounded upper edge along the segmented body, and a universal female connector configured to connect to a universal male connector, the flexible tracks being configured to bend in at least one direction, wherein at least one flexible track further comprises a connecting spine which bisects the segmented body and runs the length of the track, and is configured to bend in at least two directions, wherein each track is comprised of only a single rail, wherein the stationary connector is configured to support any track by connecting to the universal male connector of the stationary connector to the universal female connector of any track, wherein any track contacts a marble at a point along its surface between 0 degrees and 90 degrees when mounted upon a stationary connector with the marble on the track, and wherein a marble positioned on top of a track contacts a vertical surface when the stationary connector is fastened to the vertical surface.

13. The system of claim 12 wherein the fastener capable of attaching the stationary connectors and the hinge connectors to the vertical surface is at least one magnet inside the body.

14. The system of claim 12 wherein the fastener capable of attaching the stationary connectors and the hinge connectors to the vertical surface is a suction cup.

15. The system of claim 12 further comprising a spiral lift attachment, the spiral lift attachment comprising a spiral shaped body, an asymmetrical cross shaped male connector positioned on the top of the spiral shaped body, and an asymmetrical cross shaped female connector positioned on the bottom of the spiral shaped body.

16. The system of claim 12 further comprising:

a cannon attachment, the cannon attachment comprising a housing, a shaft within the housing, a magnet permanently affixed in the housing, a stationary sphere permanently affixed in the housing, and a ferromagnetic sphere permanently affixed in the housing; and a catapult attachment, the catapult attachment comprising a tension band, at least two anchor points configured to attach to the tension band, a fastener capable of attaching it to a vertical surface, a catapult palm with a trigger slot, and a trigger which partially extends through the trigger slot.

17. The system of claim 12 further comprising:

a U turn attachment, the U turn attachment comprising a two-track body, the two-track body defining a 180-degree curve, and a universal female connector configured to connect to a universal male connector;

a corner attachment, the corner attachment comprising a two-track body, the two-track body defining a rounded path which ends at a trajectory with a 90-degree difference relative to its initial trajectory, and a universal female connector configured to connect to a universal male connector; and an around attachment, the around attachment comprising a two-track body, the two-track body defining a rounded path which is generally semicircular and ends in the same direction as it began.

18. A universal, modular marble course system comprising:

a plurality of stationary connectors, each stationary connector comprising a body, a fastener capable of attaching it to a vertical surface, and a universal male connector configured to connect to a universal female connector;

a plurality of hinge connectors, each hinge connector comprising a body, a hinge pin, and a securing edge at the end of the hinge pin;

a plurality of linear tracks, each linear track comprising a rounded upper surface, and a universal female connector configured to connect to a universal male connector;

a plurality of curved tracks, each curved track comprising a rounded upper surface, and a universal female connector configured to connect to a universal male connector;

a plurality of stair shaped tracks, each stair shaped track comprising a rounded upper surface, a universal female connector configured to connect to a universal male connector, a plurality of generally horizontal surfaces, a plurality of vertical surfaces positioned in between and orthogonal to the horizontal surfaces;

a plurality of flexible tracks, each flexible track comprising a segmented body, a rounded upper edge along the segmented body, and a universal female connector configured to connect to a universal male connector, the flexible tracks being configured to bend in at least one direction;

a plurality of edge tracks, each edge track comprising a rounded upper surface, a curved path defined by the body, and a universal female connector configured to connect to a universal male connector;

a spiral lift attachment, the spiral lift attachment comprising a spiral shaped body, an asymmetrical cross shaped male connector positioned on the top of the spiral shaped body, and an asymmetrical cross shaped female connector positioned on the bottom of the spiral shaped body;

a cannon attachment, the cannon attachment comprising a housing, a shaft within the housing, a magnet permanently affixed in the housing, a stationary sphere permanently affixed in the housing, and a ferromagnetic sphere permanently affixed in the housing;

a catapult attachment, the catapult attachment comprising a tension band, at least two anchor points configured to attach to the tension band, a fastener capable of attaching it to a vertical surface, a catapult palm with a trigger slot, and a trigger which partially extends through the trigger slot;

a U turn attachment, the U turn attachment comprising a two-track body, the two-track body defining a 180-degree curve, and a universal female connector configured to connect to a universal male connector; and a corner attachment, the corner attachment comprising a two-track body, the two-track body defining a rounded path which ends at a trajectory with a 90-degree difference relative to its initial trajectory, and a universal female connector configured to connect to a universal male connector, wherein at least one flexible track further comprises a connecting spine which bisects the segmented body and runs the length of the track, and is configured to bend in at least two directions, wherein the stationary connector is configured to support any track by connecting to the universal male connector of the stationary connector to the universal female connector of any track, wherein each track is comprised of only a single rail, wherein any track contacts a marble at a point along its surface between 0 degrees and 90 degrees when mounted upon a stationary connector with the marble on the track, and wherein a marble positioned on top of a track contacts a vertical surface when the stationary connector is fastened to the vertical surface.

19. The system of claim 18 further comprising:

a starter attachment, the starter attachment comprising a housing, a first upper insertion slot, a second lower egress slot, and a turn wheel configured to hold a marble in the housing until it is rotated;

a fork attachment, the fork attachment comprising a comprising a rounded upper surface, a curved lower member, and a hinge attachment point;

a pole attachment, the pole attachment comprising a body with at least one hinge attachment point, a marble clamp, and a hook shaped upper member with two sides, with one side twice as long as the other; and a flip attachment, the flip attachment comprising an elongated body with an inward facing hook member on a first end and a linear member extending orthogonally from a curved second end, and a hinge attachment point.

* * * * *